US010180133B2

(12) United States Patent
Young et al.

(10) Patent No.: US 10,180,133 B2
(45) Date of Patent: Jan. 15, 2019

(54) CHANNEL-LESS PUMP, METHODS, AND APPLICATIONS THEREOF

(71) Applicant: Rheonix, Inc., Ithaca, NY (US)

(72) Inventors: Lincoln C. Young, Ithaca, NY (US); Peng Zhou, Newton, PA (US)

(73) Assignee: RHEONIX, INC., Ithaca, NY (US)

( * ) Notice: Subject to any disclaimer, the term of this patent is extended or adjusted under 35 U.S.C. 154(b) by 342 days.

(21) Appl. No.: 14/548,474

(22) Filed: Nov. 20, 2014

(65) Prior Publication Data

US 2015/0147195 A1 May 28, 2015

Related U.S. Application Data

(60) Provisional application No. 61/907,623, filed on Nov. 22, 2013, provisional application No. 61/919,115,
(Continued)

(51) Int. Cl.
*F04B 43/12* (2006.01)
*F04B 43/04* (2006.01)
(Continued)

(52) U.S. Cl.
CPC ..... *F04B 43/043* (2013.01); *B01L 3/50273* (2013.01); *F04B 43/0054* (2013.01);
(Continued)

(58) Field of Classification Search
CPC ..... F04B 43/043; F04B 19/006; F04B 43/14; F04B 43/028; F04B 43/0054; F04B 43/02;
(Continued)

(56) References Cited

U.S. PATENT DOCUMENTS 4,022,256 A 5/1977 Berkman et al.
5,376,252 A 12/1994 Ekstrom et al.
(Continued)

FOREIGN PATENT DOCUMENTS

CN 101282789 A 10/2008
CN 1012112229 A 6/2011
(Continued)

OTHER PUBLICATIONS

International Search Report Form PCT/ISA/220, International Search Report and Written Opinion PCT/US2014/066546, p. 1-12, International Filing Date—Nov. 20, 2014.
(Continued)

*Primary Examiner* — Philip Stimpert
(74) *Attorney, Agent, or Firm* — Bond, Schoeneck & King, PLLC; William Greener; Frederick Price

(57) ABSTRACT

A channel-less microfluidic pump includes a cartridge including a substrate and an actuatable film layer disposed on the substrate, and a manifold having at least three actuatable void volumes separated by a plurality of wall sections and an actuatable flexible layer disposed on the manifold interfacing the actuatable film layer. In operation, the pump can be in an unactuated state wherein the actuatable film layer is disposed against the surface of the substrate or an actuated state wherein at least a portion of the flexible layer and a corresponding portion of the actuatable film layer are deflected into a corresponding void volume thus forming a fluidic volume between the deflected portion of the actuatable film layer and the surface of the substrate. In the actuated state, there is a fluidic gap between immediately adjacent void volumes formed by a thinned region of the flexible layer at a point of contact with a top surface of a wall section. A method of transporting fluid using the channel-less microfluidic pump is described.

16 Claims, 41 Drawing Sheets

Related U.S. Application Data filed on Dec. 20, 2013, provisional application No. 61/941,118, filed on Feb. 18, 2014.

(51) Int. Cl.

| | |
|---|---|
| ***F04B 43/06*** | (2006.01) |
| ***B01L 3/00*** | (2006.01) |
| ***F04B 43/00*** | (2006.01) |
| ***F04B 43/02*** | (2006.01) |

(52) U.S. Cl.

CPC ..... *F04B 43/02* (2013.01); *F04B 43/06* (2013.01); *F04B 43/12* (2013.01); *B01L 2200/0668* (2013.01); *B01L 2200/16* (2013.01); *B01L 2300/087* (2013.01); *B01L 2300/0816* (2013.01); *B01L 2300/0861* (2013.01); *B01L 2300/1827* (2013.01); *B01L 2400/0481* (2013.01)

(58) Field of Classification Search

CPC ..... F04B 43/06; F04B 43/12; B01L 3/50273; B01L 2200/16; B01L 2200/0668; B01L 2300/0816; B01L 2300/087; B01L 2300/0861; B01L 2300/1827; B01L 2400/0481

See application file for complete search history.

(56) References Cited

U.S. PATENT DOCUMENTS

| | | | | |
|---|---|---|---|---|
| 5,478,751 | A | 12/1995 | Oosta et al. | |
| 5,571,410 | A | 11/1996 | Swedberg et al. | |
| 6,073,482 | A | 6/2000 | Moles | |
| 6,074,725 | A | 6/2000 | Kennedy | |
| 6,193,471 | B1 | 2/2001 | Paul | |
| 6,435,840 | B1 * | 8/2002 | Sharma | F04B 43/043 417/322 |
| 6,450,773 | B1 * | 9/2002 | Upton | F04B 17/003 417/413.2 |
| 6,517,736 | B1 | 2/2003 | Flannery et al. | |
| 6,521,188 | B1 | 2/2003 | Webster | |
| 7,122,153 | B2 | 10/2006 | Ho | |
| 7,186,383 | B2 | 3/2007 | Webster et al. | |
| 7,216,660 | B2 | 5/2007 | Troian et al. | |
| 7,335,984 | B2 | 2/2008 | Samper et al. | |
| 7,790,118 | B2 | 9/2010 | Maltezos et al. | |
| 7,814,928 | B2 | 10/2010 | Maltezos et al. | |
| 8,034,628 | B2 | 10/2011 | Harrison et al. | |
| 8,123,192 | B2 | 2/2012 | Maltezos et al. | |
| 8,485,793 | B1 | 7/2013 | Sapir | |
| 8,528,591 | B2 | 9/2013 | Pirk et al. | |
| 8,550,298 | B2 | 10/2013 | Mukaddam et al. | |
| 2002/0127736 | A1 | 9/2002 | Chou et al. | |
| 2003/0015425 | A1 | 1/2003 | Bohm et al. | |
| 2003/0180164 | A1 * | 9/2003 | Bunner | F04B 43/025 417/413.1 |
| 2006/0076068 | A1 * | 4/2006 | Young | B01F 5/0683 137/829 |
| 2008/0101971 | A1 * | 5/2008 | Mayer | F04B 19/006 417/533 |
| 2009/0253181 | A1 | 10/2009 | Vangbo et al. | |
| 2011/0076204 | A1 | 3/2011 | Schmidt et al. | |
| 2011/0094591 | A1 | 4/2011 | Jung et al. | |
| 2011/0135546 | A1 | 6/2011 | Kurowski et al. | |

FOREIGN PATENT DOCUMENTS

| | | | |
|---|---|---|---|
| DE | 102011015184 | A1 | 12/2011 |
| EP | 0010456 | A1 | 10/1979 |
| EP | 1918586 | A1 | 5/2008 |

OTHER PUBLICATIONS

Anderson, et al., "A Miniature Integrated Device for Automated Multistep Genetic Assays", Oxford University PRess, Nucleic Acids Research, 2000, vol. 28, No. 12.

Grover, et al., "Monolithic Membrane Valves and Diaphragm Pumps for Practical Large-Scale Integration Into Glass Microfluidic Devices", Science Direct, Sensors and Actuators, 2003, B89, pp. 315-323.

* cited by examiner 2
3
4

20
21
29
24
25
22
23
28

A
B 3
4
21
21
21
21
23
1-1

4
5a
6a
7a
29a
21a
22a 29b
6b
22b
5b
21b
7b

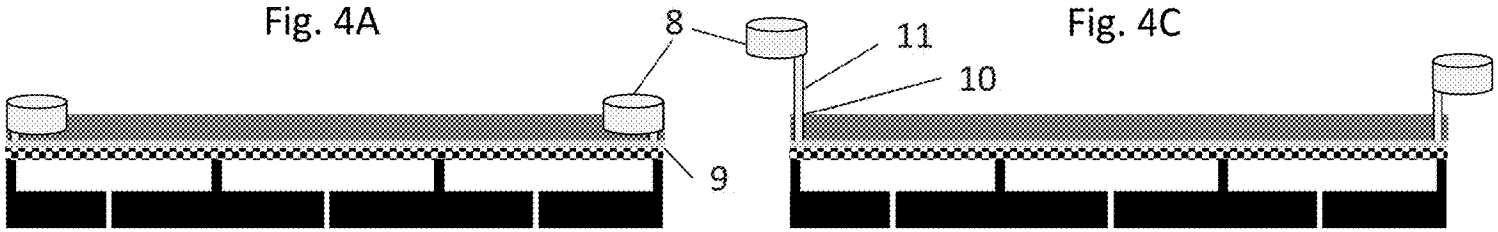
Fig. 4A
Fig. 4C
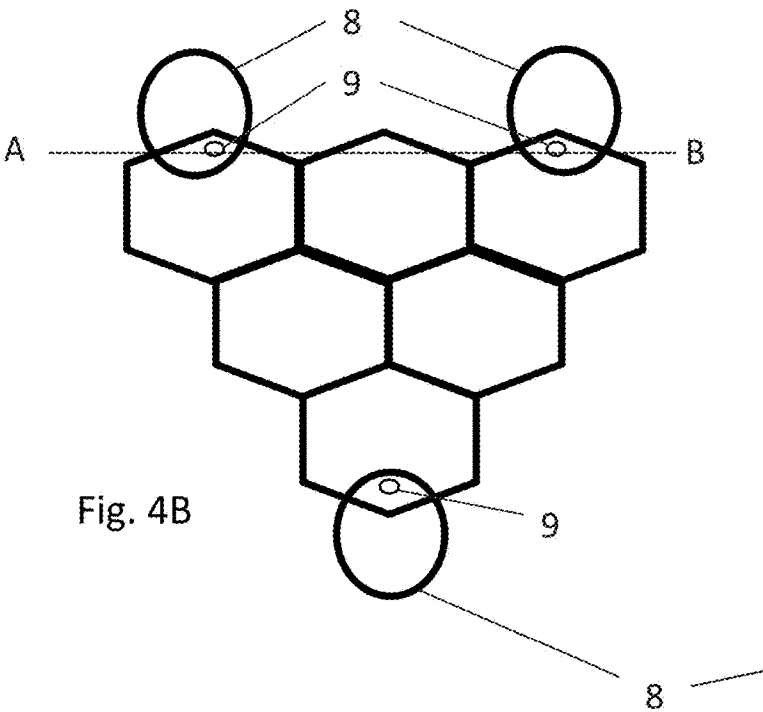
Fig. 4B
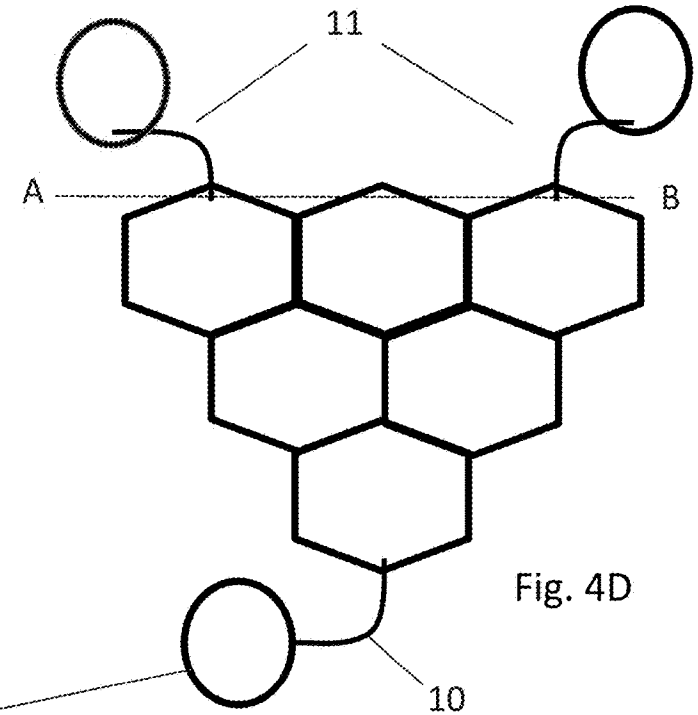
Fig. 4D 3
4
33
33
33
33
1-2

4
5a
6a
7a
34a
33a 33b
34b
6b
5b
7b

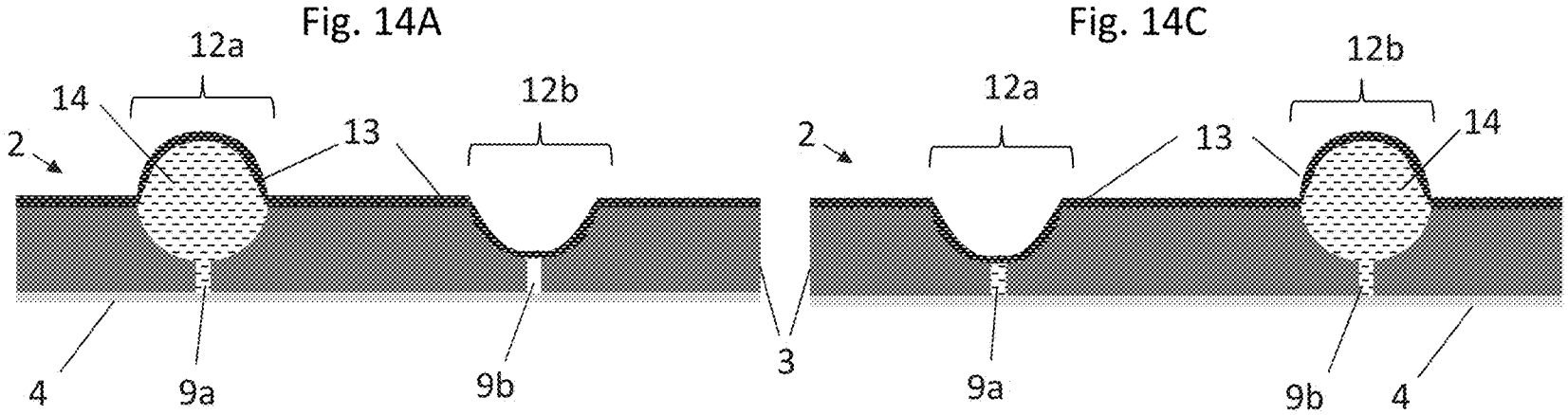
Fig. 14A
Fig. 14C
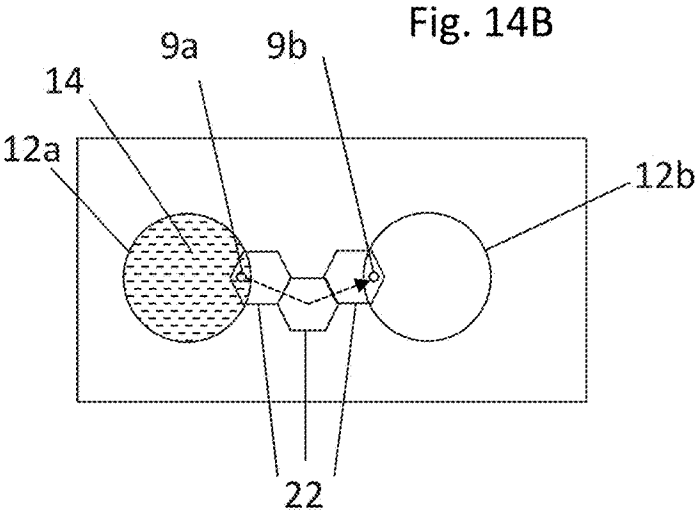
Fig. 14B
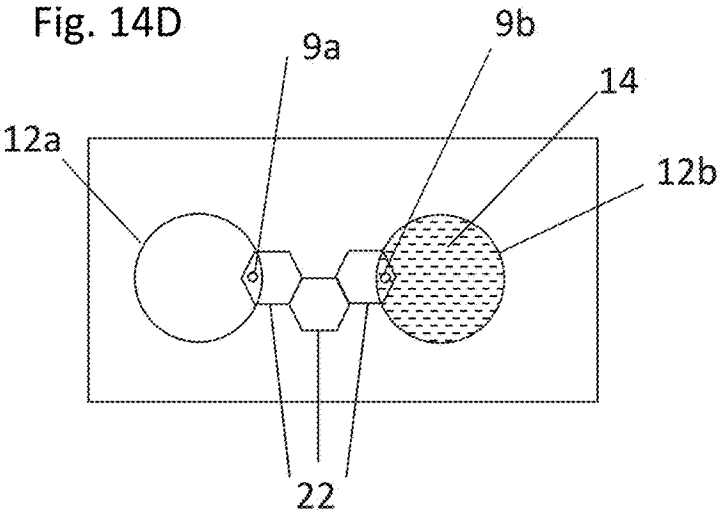
Fig. 14D 15
12b
12a
12
16
14
9a
9b
13
3
4
22

On-CARD Purification of Blood and Buccal Swab

CHANNEL-LESS PUMP, METHODS, AND APPLICATIONS THEREOF

RELATED APPLICATION DATA

The instant application claims priority to U.S. provisional Application No. 61/907,623 filed Nov. 22, 2013, U.S. provisional Application No. 61/941,118 filed Feb. 18, 2014, and U.S. provisional Application No. 61/919,115 filed Dec. 20, 2013, the subject matter of which are incorporated by reference in their entireties.

GOVERNMENT FUNDING

None.

FIELD OF THE INVENTION

Embodiments of the invention generally pertain to the field of microfluidics; more particularly to microfluidic apparatus/systems, methods of use and fabrication thereof, and applications thereof; most particularly to a microfluidic pump having no integral microfluidic transport channels (i.e., a channel-less microfluidic pump), a method for transporting a fluid using the channel-less microfluidic pump, methods for fabricating the channel-less microfluidic pump, and application thereof.

BACKGROUND

The history and progress of microfluidics has centered on the formation of small (i.e., microfluidic), dedicated channels in various materials constructed in various ways and assembled in various configurations (i.e., microfluidic devices) in order to manipulate and modulate the movement of fluids through the channels. Challenges and associated problems with such microfluidic devices lie with the difficulty in forming the channels themselves, controllably directing the fluids through the channels and the interaction between the channels and the fluids directed through such channels. Of further significance is the difficulty in producing microfluidic systems with moving parts where such moving parts are used as valves or pumps required in modulating the movement of fluids within and among the channels or that are used to actually pump the fluids along the length of a channel, or pump fluids from one channel into another channel. Creating such devices has historically required furrowing materials and then assembling layers of furrowed materials to enclose channels. In the case of systems configured with valves or pumps, the particular elements used in valves or pumps are assembled within the layers requiring difficult assembly methods and many discrete parts to complete a useful system. In certain cases channels have been reduced to channel segments mediated by diaphragms. The diaphragms are then modulated through a manifold and the channel segments working in concert with the modulated diaphragms produce systems that pump fluids and modulate the direction of the pumped fluids. Unfortunately such devices still require difficult manufacturing methods to produce the channel segments and such systems are subject to a fairly large dead volume when configured as pumps since there are multiple channel segments incorporated into each pump. Each channel segment retains some of the pumped fluid when the pump is not operating, leaving some of the fluids stranded in the pump itself. The reasons underlying these challenges and problems are very well known in the art.

The inventors have recognized the advantages and benefits of providing a solution to the aforementioned challenges and problems in the form of devices and systems that neither include nor require any (or at most, a greatly reduced number of) dedicated microfluidic transport channels, and the use of such "channel-less" microfluidic devices to transport (i.e. pump) fluids in microfluidic devices and/or systems. Such solutions result in simplified microfluidic devices/systems, improved microfluidic devices/systems (e.g., pumps with extremely low or even zero dead volume, which are useful in moving small volumes of liquids but that are also expandable to be useful in pumping large volumes easily), simplified manufacturing of microfluidic devices/systems, reduced costs for making and using microfluidic devices/systems, and improved performance of microfluidic devices/systems, including, e.g., the ability to manipulate a wide range of fluid volumes. The embodied solutions provide a channel-less microfluidic pump apparatus/system, methods for making and using the channel-less microfluidic pump apparatus/system for transporting one or more fluids, and applications enabled by the embodied solutions.

The history and promise of microfluidics has often included the development of systems that include cartridges that store and make available for delivery all, most or some of the reagents required to complete assays. The difficulty in delivering on the promise often centers on the difficulty of keeping the reagents separated from each other during shipment and storage of the cartridges prior to their use. Traditional microfluidic systems require channels formed in the cartridge to transport the reagents from where they are stored to where they are used. The channels of traditional systems therefore employ various valve systems to keep the reagents from traveling along the preformed channels prior to use. In certain other cases the reagent reservoirs do not employ valves between the reservoir and the channel but the reservoirs themselves are entirely sealed and are punctured or crushed until they burst and release their contents, which are then directed through channels to where they are used. Furthermore, the reagents often are expensive or need to be used in specific amounts. Traditional channeled systems are burdened by a dead volume of material that remains in the channel through which the material was delivered and at the same time are difficult to meter when their use is required in precise amounts.

The inventors have recognized the advantages and benefits of providing a solution to the aforementioned challenges and problems in the form of devices and systems that do not have channels that directly connect, are valve mediated, or in any manner allow materials stored in reservoirs to travel through channels prior to use by providing channel-less pumping systems between reservoirs. Such solutions result in simplified microfluidic devices/systems, improved microfluidic devices/systems (e.g., microfluidic systems incorporating reagents readily stored in the cartridge and accessible for easy use), simplified manufacturing of microfluidic devices/systems, reduced costs for making and using microfluidic devices/systems, and improved performance of microfluidic devices/systems, including, e.g., the ability to store reagents on the cartridge, use greater amounts of the stored reagents though a reduced dead volume given the reduction in channels and more precisely meter the reagents for improved performance. The embodied solutions provide a channel-less microfluidic apparatus/system, methods for using the channel-less microfluidic apparatus/system for transporting one or more fluids, and applications enabled by the embodied solutions.

The history and promise of microfluidics has often included the development of systems that perform useful processes including complete biochemical assays in a simple cartridge with all or some of the required chemical reagents available and various mechanical, optical, electrical, magnetic and thermal capabilities easily engaged with the cartridge. The difficulty in delivering on the promise often centers on the difficulty of keeping the reagents separated from each other during shipment and storage of the cartridges prior to their use and implementing the various procedures required for the reagents to mix and act upon a sample and the various fractions of a sample as it is processed. Traditional microfluidic systems require channels formed in the cartridge that transport the reagents from where they are stored to where they are used, and since the channels are pre-formed in the cartridge and therefore require bulky substrates, complex valve systems and/or elements such as sharp points or crushing mechanisms to access the reagents, the cartridges are difficult to produce and the instruments in which the cartridges are used become very complex, further limiting their utility. The cartridges are also cumbersome and prone to failure in respect to the storage or extraction of reagents from reservoirs and their use in the cartridge. Further, the easy manipulation of the sample and the reagents is limited by the bulkiness and complexity of the cartridges.

The inventors have recognized the advantages and benefits of providing a solution to the aforementioned challenges and problems in the form of microfluidic devices and systems that do not have channels that directly connect, are valve mediated, or in any manner allow materials stored in reservoirs to travel through channels prior to use by providing channel-less pumping systems between reservoirs. Such solutions result in less bulky, simplified microfluidic devices/systems, improved microfluidic devices/systems (e.g., microfluidic systems incorporating reagents readily stored in the cartridge and accessible for easy use and simplified interaction of the cartridge with its host instrument which supplies various mechanical, optical, electrical, magnetic and thermal inputs to the cartridge), simplified manufacturing of microfluidic devices/systems, reduced costs for making and using microfluidic devices/systems, and improved performance of microfluidic devices/systems, including, e.g., the ability to store reagents on the cartridge and supply various mechanical, optical, electrical, magnetic and thermal inputs to the cartridge. The embodied solutions provide a channel-less microfluidic apparatus/system, methods for using the channel-less microfluidic apparatus/system for transporting one or more fluids, and applications enabled by the embodied solutions.

SUMMARY

An aspect of the invention is a channel-less microfluidic pump. In an exemplary embodiment, the channel-less microfluidic pump includes a cartridge including a substrate having opposing external surfaces and an actuable film layer disposed on an external surface of the substrate; and a manifold comprising: at least three separate, actuable cavities forming at least in part, a top surface of the manifold, wherein each actuable cavity includes an actuation mechanism, further wherein in operation, the pump is characterized by one of an unactuated state wherein the actuable film layer is disposed immediately adjacent the surface of the substrate and an actuated state wherein at least a portion of the actuable film layer is deflected into a corresponding cavity thus forming a fluidic volume between the deflected portion of the actuable film layer and the surface of the substrate, further wherein, in the actuated state, the pump is further characterized by a fluidic gap between immediately adjacent cavities and the top surface of the manifold intermediate the immediately adjacent cavities. Various embodiments of the channel-less microfluidic pump may include, alone or in combination, the following addition features, limitations, characteristics:

- wherein the at least three cavities each have at least two wall sections;
- further comprising at least one reservoir disposed in/on the substrate and at least one via in fluidic connection with the reservoir and the film layer;
- further comprising at least one via in the substrate in fluidic connection with the film layer and an external fluid source;
- wherein the actuation mechanism comprises a pneumatic or a hydraulic actuator;
- further comprising an actuable flexible layer disposed on the top surface of the manifold and disposable in an interfacing relationship with the actuable film layer;
  - wherein the actuation mechanism comprises a pneumatic, hydraulic, electromagnetic or a mechanical actuator;
  - wherein the actuable flexible layer has at least one magnetic region;
  - wherein the at least three cavities each have at least two wall sections;
  - further comprising at least one reservoir disposed in/on the substrate and at least one via in fluidic connection with the reservoir and the film layer;
  - further comprising at least one via in the substrate in fluidic connection with the film layer and an external fluid source;
- wherein the cavities comprise an actuable foam material;
- wherein the substrate includes at least one pocket in fluidic contact with at least a portion of the blister material and the via;
- wherein the substrate is a film layer including a via, the cartridge further comprising a fixture having one or more pockets formed therein, at least one vacuum port in the fixture, and a blister material disposed on an external surface of the fixture intermediate the fixture surface and the substrate film layer so as to form a blister reservoir, wherein the actuable film layer is disposed so as to seal the blister reservoir;
  - further comprising a protective cover disposed on the surface of the blister material opposite the side of the blister material to which the substrate is disposed.

An aspect of the invention is a method for transporting a fluid in a microfluidic device. In an exemplary embodiment, the method includes providing a channel-less microfluidic pump as set forth above; actuating a first one of the cavities; providing a source of the fluid through the fluidic gap of the first actuated cavity so as to dispose a quantity of the fluid in the fluidic volume of the first actuated cavity; actuating a second one of the cavities immediately adjacent the first cavity thus forming the fluidic volume of the second actuated cavity and creating the fluidic gap between the first and the second cavities; de-actuating the first cavity and actuating a third one of the cavities immediately adjacent the second cavity thus forming the fluidic volume of the third actuated cavity and creating the fluidic gap between the second and the third cavities such that the fluid is transported from the first to the second and from the second to the third of the at least three cavities.

BRIEF DESCRIPTION OF THE DRAWINGS

FIG. 4A is a side cross-sectional view of a channel-less pump including at least one reservoir (two are illustrated) disposed in/on the substrate and at least one via communicating between the reservoir and the actuable film layer, according to an exemplary embodiment of the invention.

FIG. 4B is a top plan view of the channel-less pump shown in FIG. 4A including a third reservoir and associated via, according to an exemplary aspect of the invention.

FIG. 4C is a side cross-sectional view of a channel-less pump including at least one via (two are illustrated) disposed in the substrate and in fluidic communication with the actuable film layer and an associated external reservoir through a fluidic supply channel connecting the external reservoir and the via, according to an exemplary embodiment of the invention.

FIG. 4D is a top plan view of the channel-less pump shown in FIG. 4C including a third external reservoir and associated fluidic supply channel, according to an exemplary embodiment of the invention.

FIG. 14A and FIG. 14C are cross-sectional views illustrative of an alternative construction and method for using a cartridge component according to an exemplary embodiment of the invention.

FIG. 14B and FIG. 14D are the plan views of the alternate constructions of FIGS. 14A and 14C, respectively.

FIGS. 18A-26B are illustrative of the steps included in the initial sample purification and capture of nucleic acid molecules from the biological sample, according to an exemplary embodiment of the invention.

DETAILED DESCRIPTION OF EXEMPLARY EMBODIMENTS OF THE INVENTION

Figures 1, 2A, 2B:
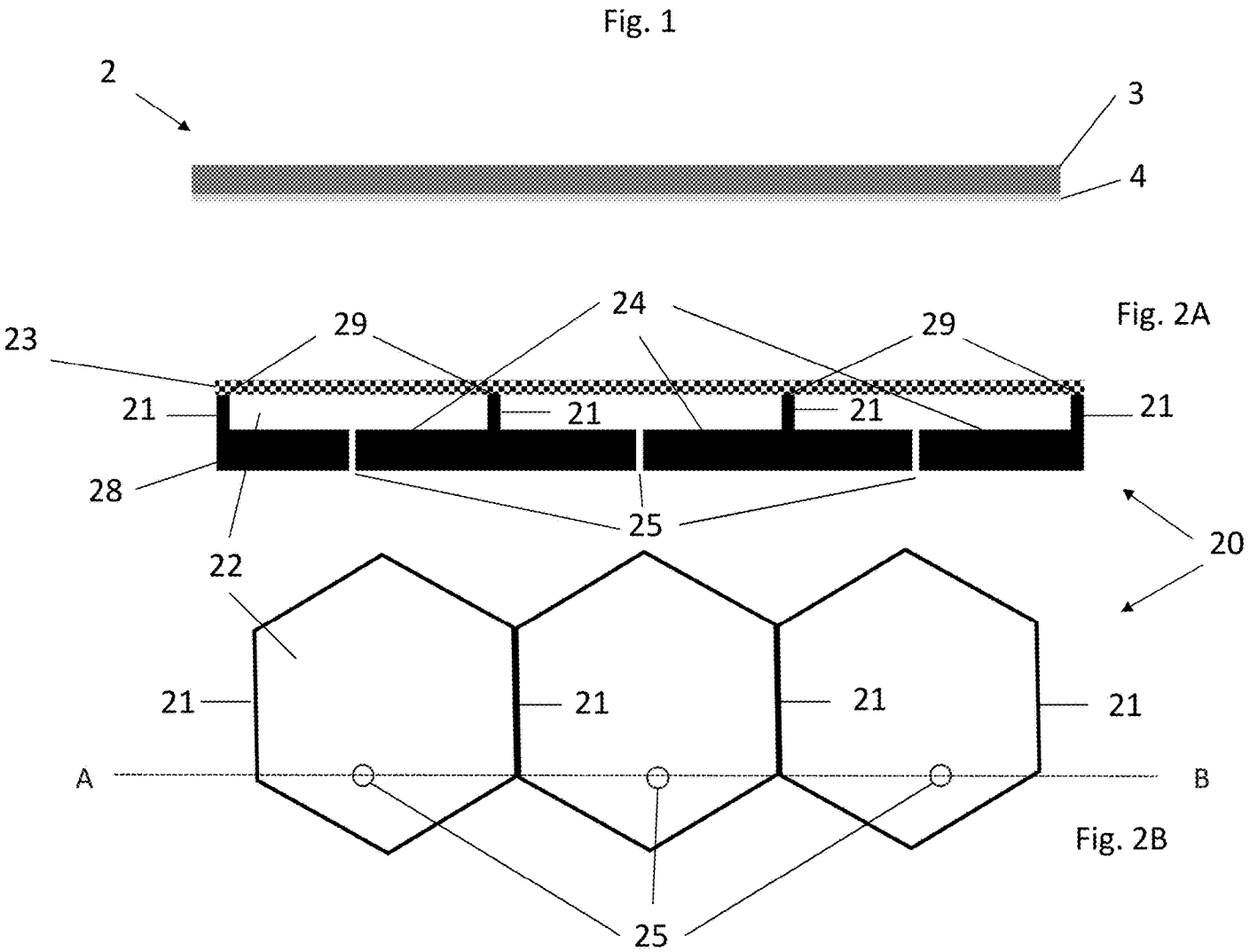
FIG. 1 is a cross-sectional view of a cartridge component of a channel-less microfluidic pump, according to an exemplary embodiment of the invention.
FIG. 2A is a cross-sectional view of a manifold component of a channel-less microfluidic pump, according to an exemplary embodiment of the invention.
FIG. 2B is a top plan view of three cavities in the manifold of FIG. 2A, according to an exemplary aspect of the invention.
Figures 3A, 3B, 3C:
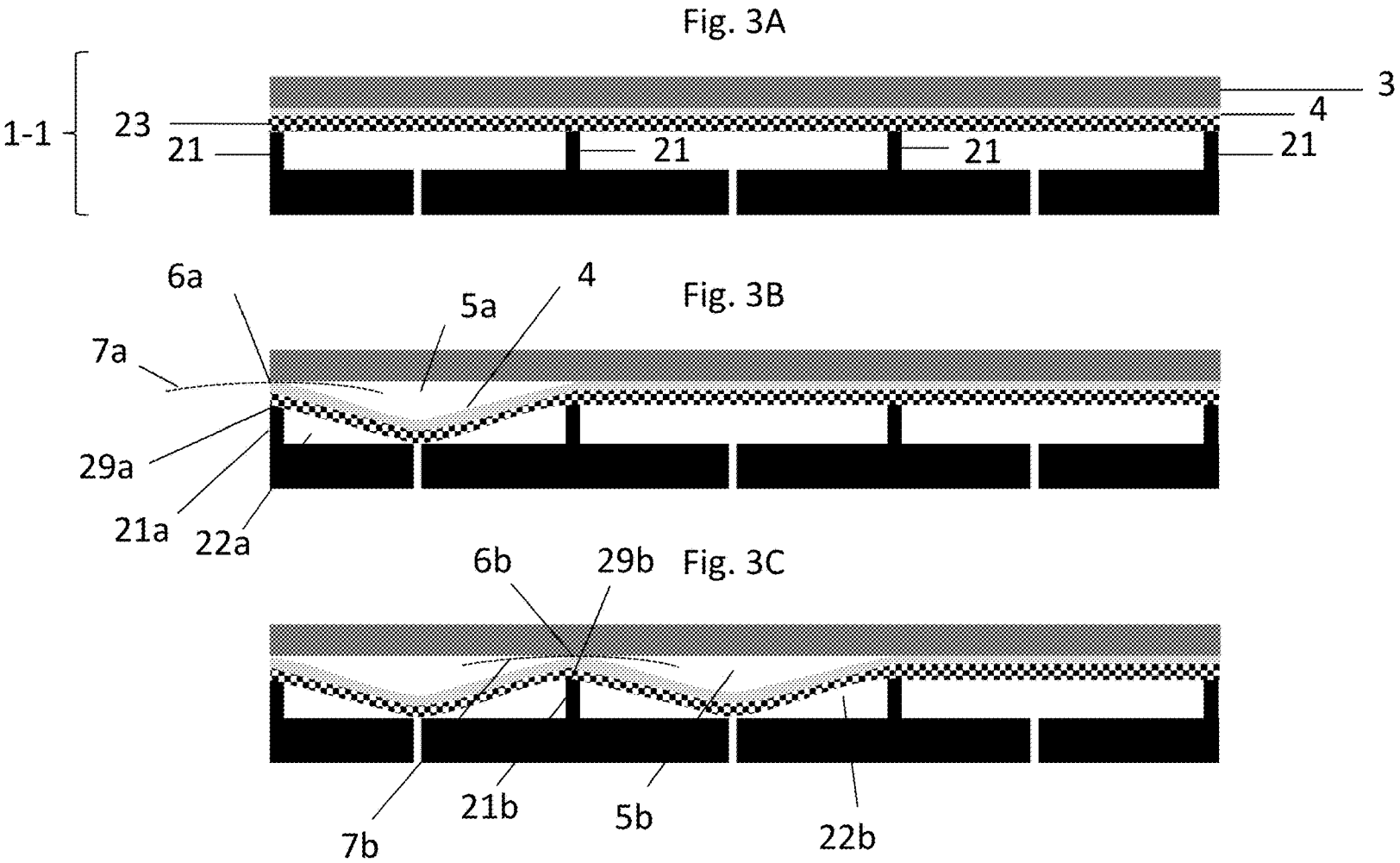
FIG. 3A-FIG. 3F each sequentially illustrate the operation of a channel-less pump to transport fluid there through, according to an illustrative embodiment of the invention.
Figure 5C:
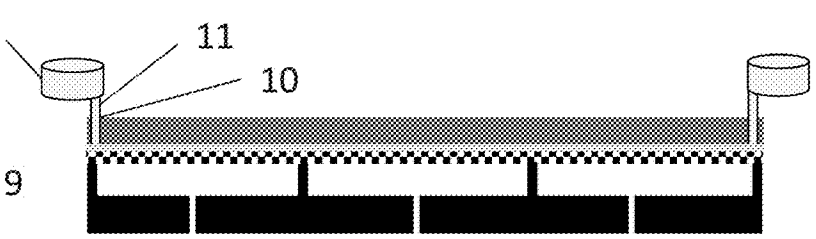
FIG. 5A, FIG. 5B, FIG. 5C, FIG. 5D, respectively, are views of a channel-less pump similar to the channel-less pump shown in FIGS. 4A-D, respectively, except that in FIGS. 5(A-D), the number of reservoirs/vias/supply channels and the number and geometry of the cavities is different, according to an illustrative aspect of the invention.
Figure 5A:
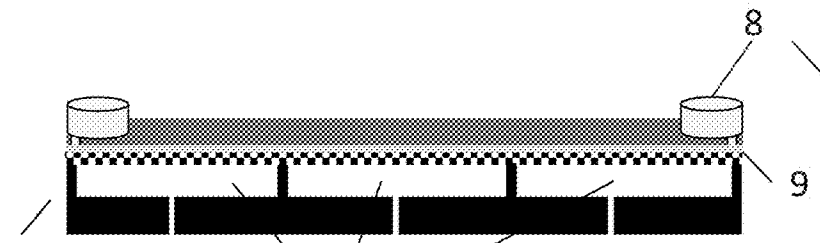
Figures 6A, 6B, 6C:
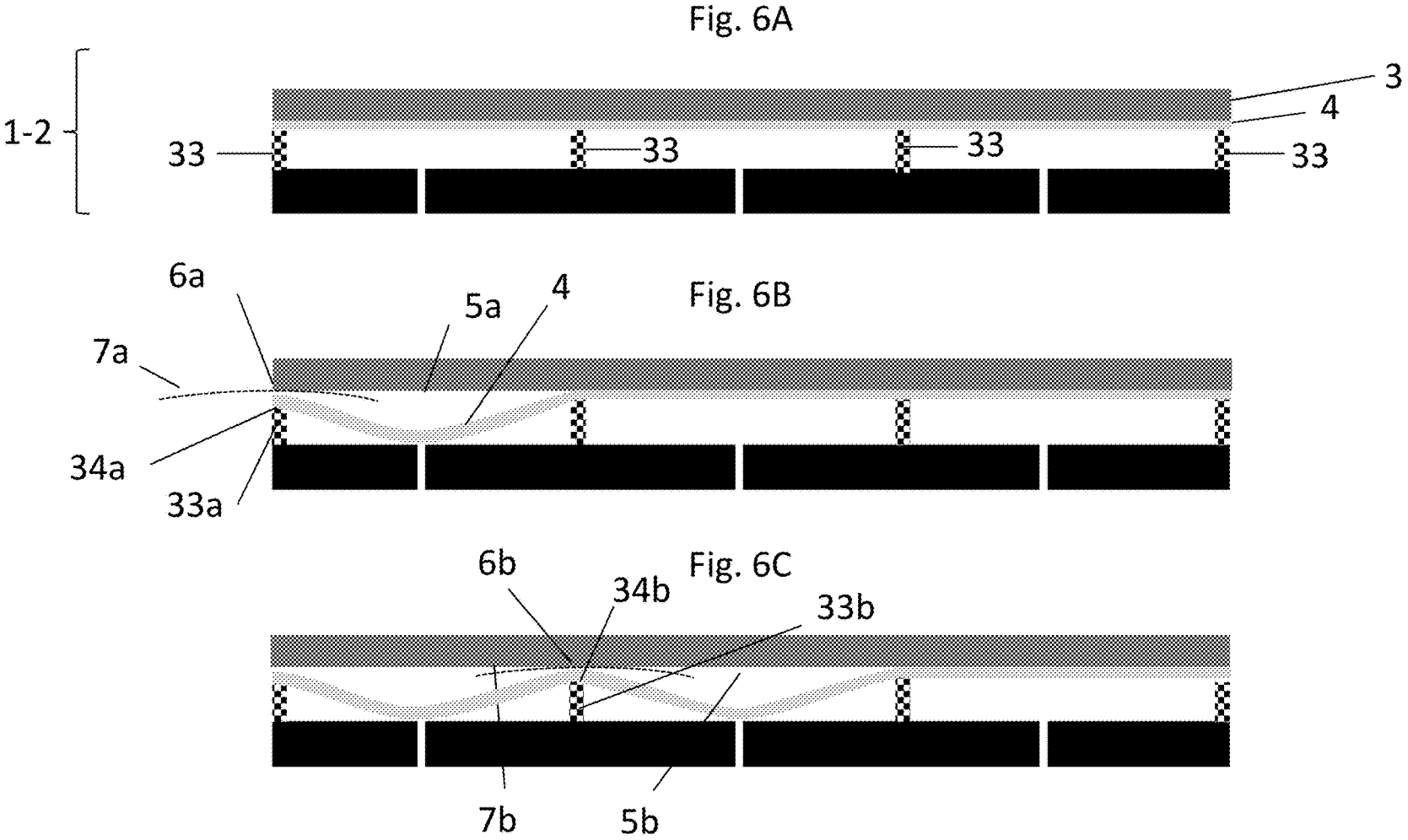
FIG. 6A, FIG. 6B, FIG. 6C, FIG. 6D, FIG. 6E, and FIG. 6F sequentially illustrate the operation of an alternative construction of the channel-less pump to transport fluid there through, according to an illustrative embodiment of the invention.
Figures 6D, 6E, 6F:
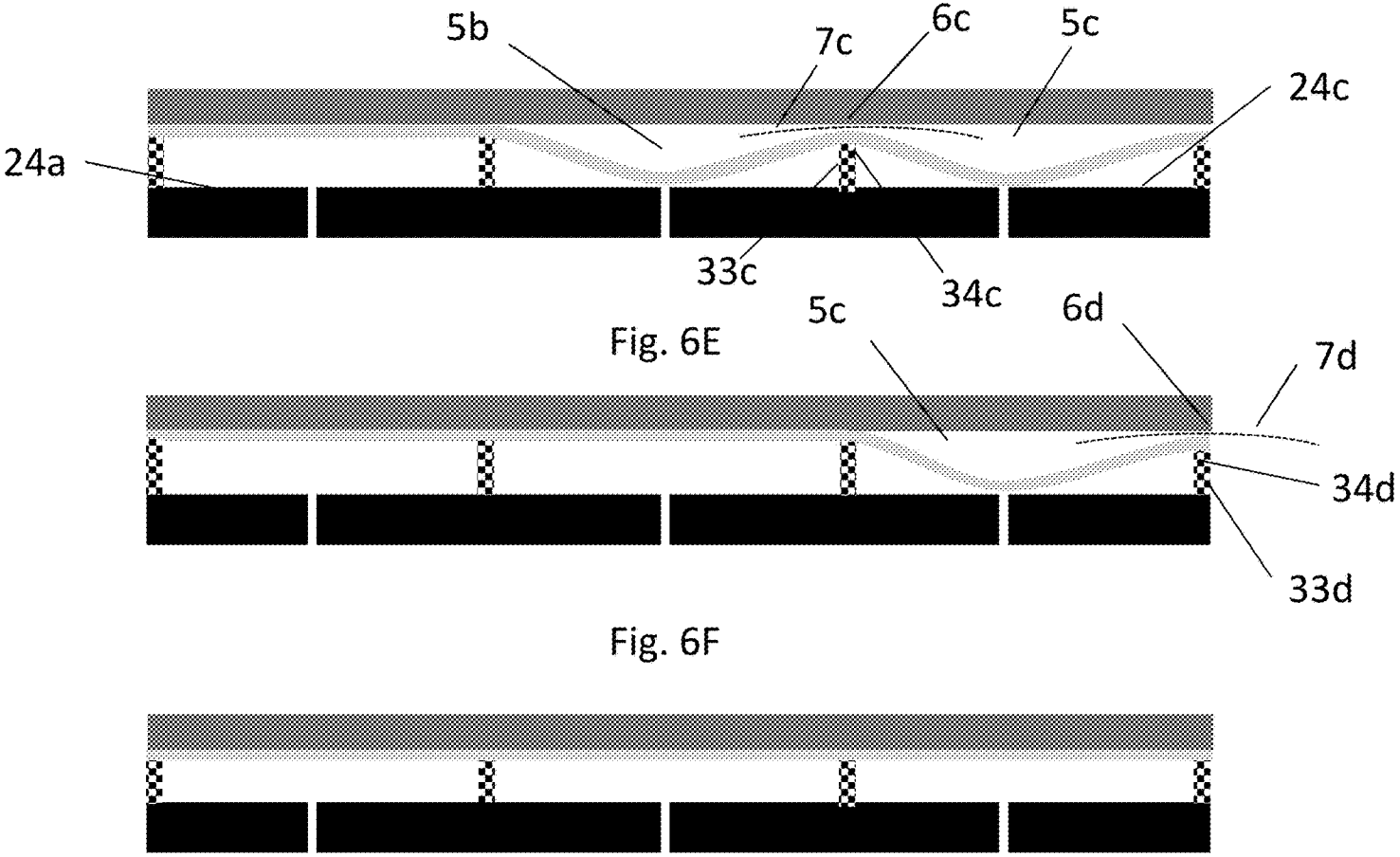

FIG. 1 illustrates a basic cartridge component (2) of an embodied channel-less microfluidic pump (1-1 and 1-2) as illustrated in FIGS. 3A and 6A, respectively. The cartridge component (2) includes a substrate (3) (that can be of any useful thickness ranging from the thickness of a film (i.e., less than or equal to a millimeter) (See FIGS. 15A-E, 16A-D, 17A-D and 18A-28), to greater than or equal to a millimeter to several centimeters (See FIGS. 1, 3A-F, 4A, 4C, 5A, 5C, 6A-F, 13A-C, 14A and 14C)) and an actuable film layer (4) that is disposed on a surface (bottom as shown) of the substrate (3), in which selected portions of the actuable film layer (4) can be actuated and drawn away from the surface of substrate (3) (e.g., FIGS. 3B and 6B) and de-actuated and deflected back towards the surface of substrate (3) (e.g., FIGS. 3D and 6D), as will be further explained below.

Figure 11:
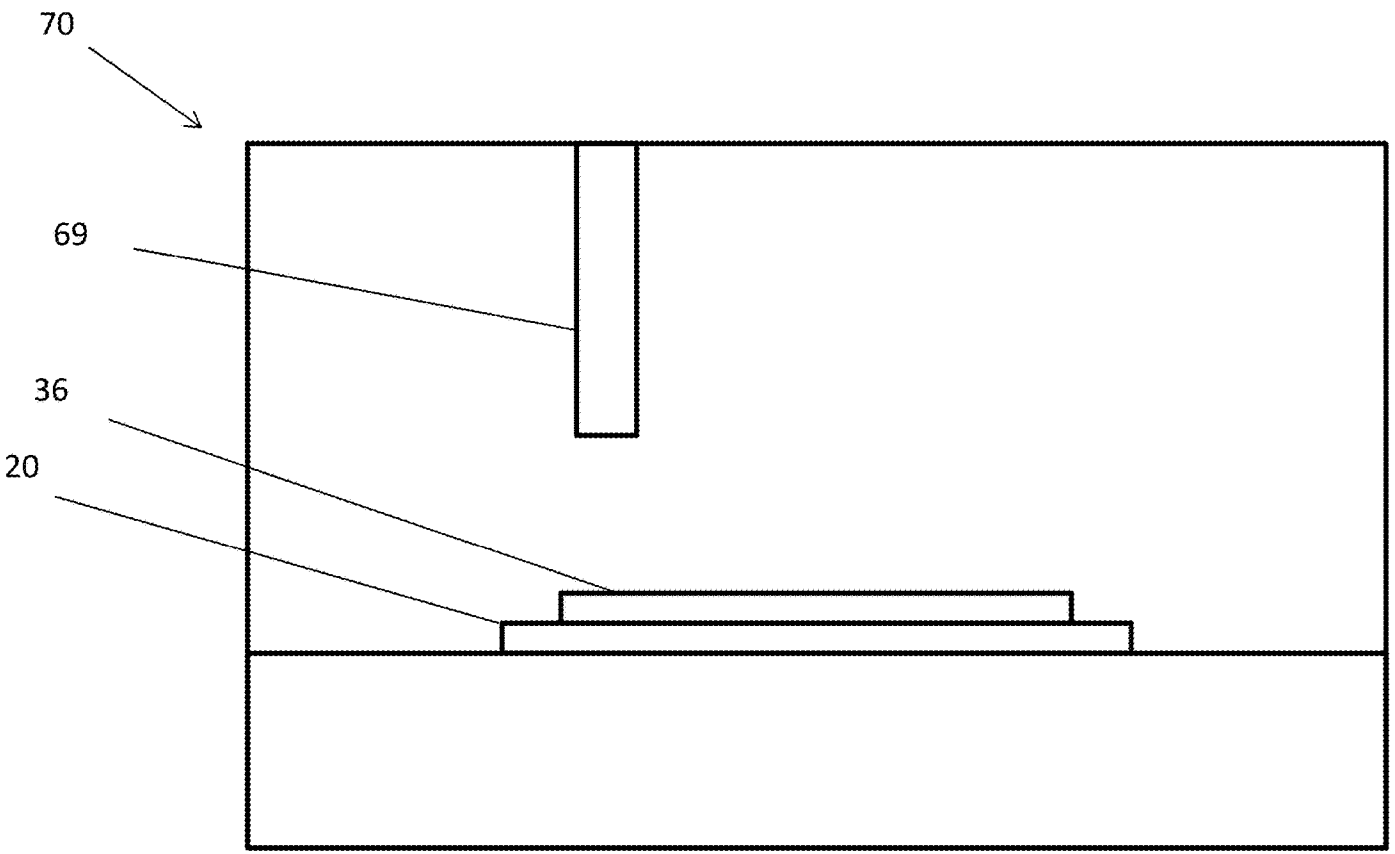
FIG. 11 is an instrument containing a horizontally mounted manifold component, an optional clamping component, and an optional optical system, according to an exemplary embodiment of the invention.
Figure 12:
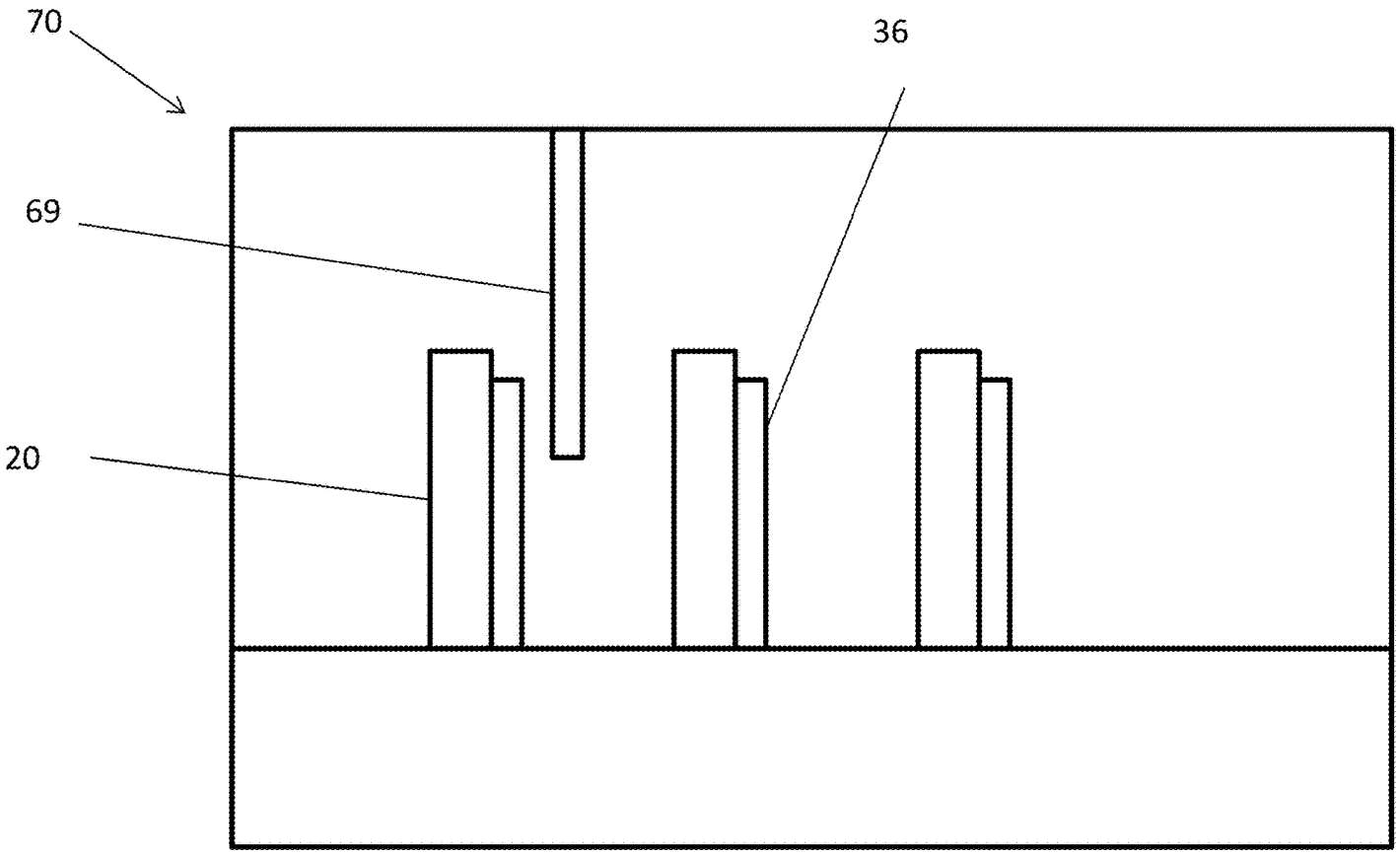
FIG. 12 is an alternative configuration of an instrument with a vertically mounted manifold component, an optional clamping component, and an optional optical system, according to an exemplary embodiment of the invention.

Other features, including but not limited to reservoirs, vias, and supply channels, may be included in or on the substrate (3) or operatively connected to the substrate (3) to enable various functions and/or other devices. FIGS. 4A-D and 5A-D illustrate different aspects of the channel-less microfluidic pump (1-1 or 1-2) including additional features such as internal and external reservoirs (8), connecting fluidic supply channels (10), and vias (9). Notably, however, the cartridge component (2) (and as will be further explained below, the manifold component (20), which will typically be housed in an instrument (70) as illustrated in FIG. 11 and FIG. 12) does not include any 'dedicated' fluidic (micro, nano, or otherwise) transport channels for modulating the movement of fluid between the substrate (3) and the actuable film layer (4). (As used herein, a 'dedicated' fluidic transport channel refers to a conventional, e.g., microfluidic transport channel as is well understood in the art that has been permanently formed or created as a feature of the microfluidic device that contains it, and which is used as the conduit to transport a fluid from one location to another in the microfluidic device- but not merely as a supply line from a reservoir). Optional via(s) (9) or fluid supply channel(s) (10) may be formed in the substrate (3) for supplying fluid from a fluid source (e.g., reservoir(s)) to the areas of cartridge component (2) configured to modulate the movement of fluid between the substrate (3) and the actuable film layer (4). The actuable film layer (4) is either sandwiched between the substrate (3) and the top surface of the manifold component (20) using mechanical or pneumatic forces, or the actuable film layer (4) may be bonded/connected/attached to substrate (3) (using means known in the art) to selective areas of the surface of the substrate (3). In the case where the actuable film layer (4) is bonded to selective regions of substrate (3), it may be selectively bonded by any manner known in the art such as, e.g., ultrasonic bonding, RF bonding, laser welding, thermal bonding, adhesive lamination, solvent bonding, or the methods described in U.S. patent application Ser. Nos. 10/964,216 and 11/242,694. The actuable film layer (4) and the substrate (3) may be of the same or different materials. Certain materials such as glass, quartz, ceramics, silicon, metals (e.g., aluminum, stainless steel), polymers (e.g., COC, polyethylene, polycarbonate, acrylic, ABS, PVC, polystyrene, acetal (Delrin), polyolefin copolymer (POC), polypropylene, nylon), silicone, or PDMS, and other similar materials may be used in combination or the same material may be used for the substrate (3) and the actuable film layer (4) as long as it functions as herein described. Importantly, however, and as further explained below, the actuable film layer (4), while disposed on the surface of the substrate (3) as illustrated in FIG. 1 allows no fluid transport between the actuable film layer (4) and the surface of substrate (3) against which the film layer lies (i.e., de-actuated state); the actuable film layer (4) can be actuated so that one or more selective region of the actuable film layer (4) can be drawn away from the surface of substrate (3) forming a fluidic volume (5, 5*n*) (see FIGS. 3B, 6B) (where n represents a variable location of a fluidic volume formed through the actuation herein described) between the surface of the substrate (3) and the deflected (actuated) portion of the actuable film layer (4).

FIG. 2A shows a side cross section (cut across line AB in FIG. 2B) of a portion of a basic manifold component (20) that can be operatively interfaced with the cartridge component (2). The manifold component (20) may contain optical, magnetic, electrical and mechanical components used to perform certain functions described herein. The optical, magnetic, electrical and mechanical components are each well-known and understood so they are not specifically detailed in respect to describing the inventive nature of the channel-less microfluidic pump (1-1 or 1-2). The manifold component (20) may be constructed from metallic, glass, ceramic, PDMS, silicone rubbers or polymeric materials such as but not limited to acrylic or polycarbonate, and in some areas, but not over the entire surface, manifold component (20) includes cavities (22) of various geometries formed by thin, walls (21) that separate indentations machined, cast, recessed or otherwise formed in the bulk material of the manifold component (20), each an individual cavity (22). The top surfaces (29) of the walls (21) form partitions of the top surface of portions of manifold component (20) and isolate each cavity (22) from each other cavity (22). Thus adjacent cavities (22) are separated by thin, walls (21). Although hexagonal shapes for the cavities (22) are illustrated in FIG. 2B, other geometries such as triangles, squares, pentagons, segmented circles, etc. and combinations of different geometries would be suitable and capable of performing the same function. All or part of the top surface of manifold component (20) may be covered by a flexible actuable layer (23). In the case where the flexible actuable layer (23) covers all or a portion of the top surface of manifold component (20) with formed cavities (22), flexible actuable layer (23) isolates each cavity (22) from each other cavity (22) covered by the flexible actuable layer (23). Each of the cavities (22) includes either an actuation channel (25) through which hydraulic or pneumatic forces may be applied to the interior of the cavity (22) or through which a mechanical actuator (26) (See FIG. 8) can move to apply forces to actuate the flexible actuable layer (23). Alternatively, the cavity (22) may not contain an actuation channel but it may contain one or more electronic actuator(s) such as one or more electromagnet(s) (27) (See FIG. 7), which is used to attract (actuate) or repel (de-actuate) the flexible actuable layer (23) covering the opening of the cavity (22), which may contain one or more magnet(s) (30) or one or more magnetically attractive material(s) (31).

The top surface of the manifold component (20) is formed by the top surfaces (29) of the thin walls (21) and the remainder of the manifold material (28) without formed cavities (22) or other components such as heaters (see FIG. 29) or optical systems (see FIG. 34) and it may be entirely or partially covered by a flexible, actuable layer of material (23) that encloses the open ends of the cavities (22). In operation, as will be further described below, one or more region(s) of the flexible actuable layer (23) associated with respective cavities (22) will be deflected, in an actuated state, into the cavity (22) (e.g., FIG. 3B) and returned to its undeflected state when de-actuated (e.g., FIG. 3D). The flexible actuable layer (23) may be composed of materials such as silicone, elastomeric rubber, or other similar materials, but in all cases the material choice for the flexible layer (23) will advantageously have an appropriate softness or durometer rating allowing it to be reversibly recovered to its non-deflected state after deflection/deformation upon actuation. Such material would also have a Poisson's ratio ≥0.3 so that during actuation it allows a large enough change in the thickness of the flexible actuable layer (23) (at a point of contact with the top surface (29) of a thin wall (21) between cavities (22)) to form the transient fluidic gap(s) (6) (see FIG. 3A-3F) of the channel-less microfluidic pump (1-1) (see FIG. 3A).

FIG. 2B shows a top plan view of a portion of a manifold component (20) having a hexagonal geometry for the cavities (22), and the relationship of the thin walls (21) separating the cavities (22), along with the actuation channels (25) addressing each respective cavity (22). Note that the actuation channels, depending on the mode of actuation, may be generally located anywhere in the bottom surface (24) of a cavity (22).

Figures 3D, 3E, 3F:
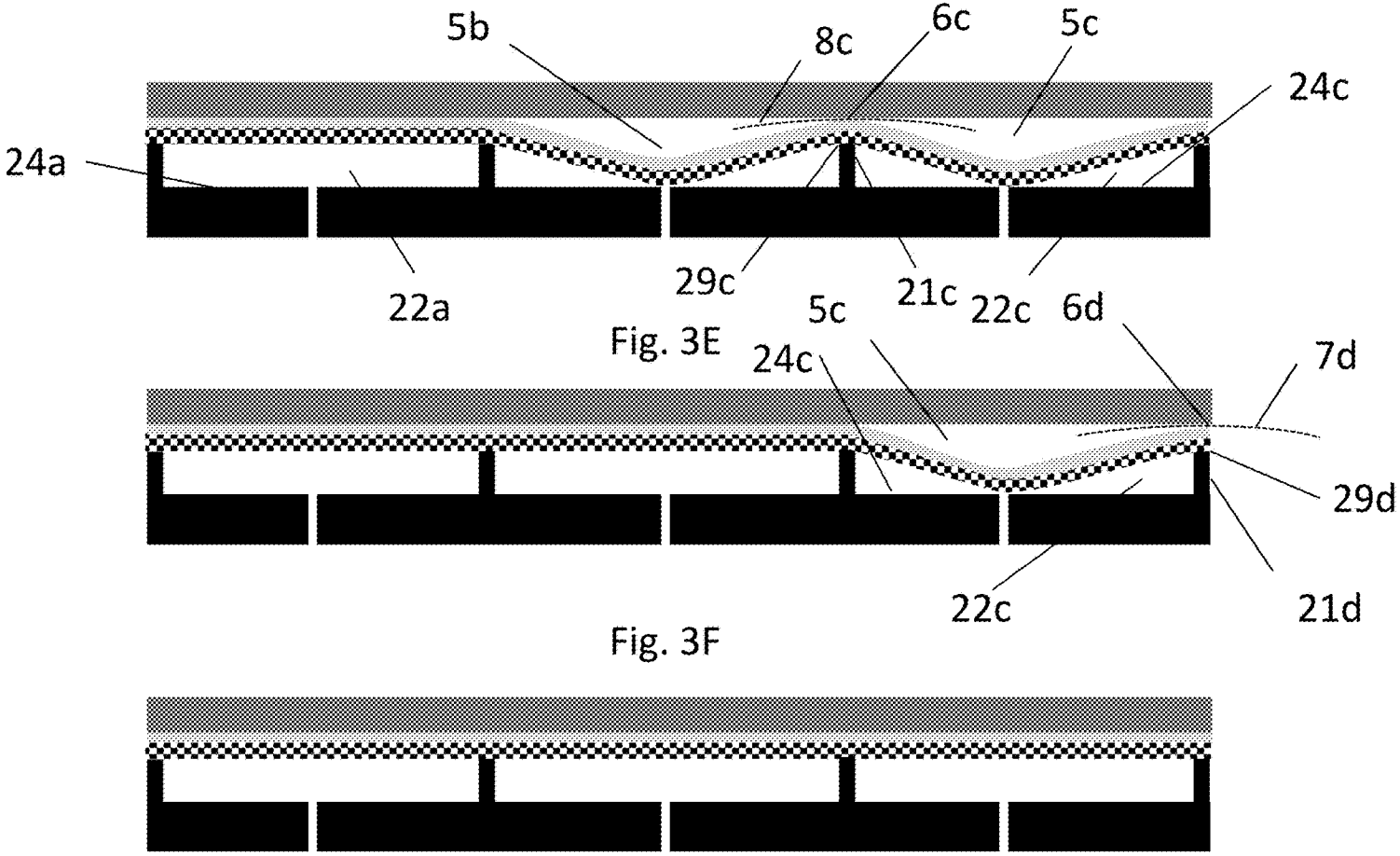

FIG. 3A shows a side cross sectional view of a channel-less microfluidic pump (1-1) comprising a basic cartridge component (2) (See FIG. 1) and a three cavity (22) portion of a basic manifold component (20) in operative connection in an unactuated state. FIGS. 3B-3F sequentially illustrate the operation of the channel-less microfluidic pump (1-1) to modulate the movement of a fluid (liquid, gas, or slurry) through cartridge component (2) by controllably forming fluidic gaps ($\mathbf{6}_n$) (where n represents a variable location of a fluidic gap formed through the actuation herein described) by controllably actuating the flexible actuable layer (23). In operation, the actuable film layer (4) is non-permanently interfaced with the flexible actuable layer (23) (FIG. 3A). Thereafter, when hydraulic or pneumatic pressures are transferred into and out of cavities (22) through actuation channels (25), or mechanical forces are applied to flexible actuable layer (23) using one or more mechanical actuator(s) (26) (See FIG. 8), or magnetic forces are applied to flexible actuable layer (23) using one or more electromagnet(s) (27) (See FIG. 7), the flexible actuable layer (23) associated with a particular cavity (22) thus actuated is either drawn towards (actuated) the bottom surface (24) of the cavity (22) or forced away from (de-actuated) the bottom surface (24) of the cavity (22). As the flexible actuable layer (23) is sequentially deflected (i.e., modulated) within the cavity (22), the actuable film layer (4) is likewise deflected away from or towards the associated surface of the substrate (3) along with the movement of the flexible actuable layer (23). The flexible actuable layer (23) primarily encloses the cavity to isolate actuation therein to a particular cavity (22) and it may be selected to also naturally attract the actuable film layer (4) of the cartridge component (2) even though without natural attraction the deflection of the flexible actuable layer (23) deflects the actuable film layer (4), since the deflection of the flexible actuable layer (23) forms a vacuum between the flexible actuable layer (23) and the actuable film layer (4). As shown in FIG. 3B, when the actuable film layer (4) is drawn away from the surface of substrate (3) (i.e., actuated) in cavity (22*a*), a fluidic volume (5*a*) is formed between that region of the actuable film layer (4) and the surface of substrate (3), which fluidic volume (5*a*) can hold an amount of fluid. The fluid entering fluidic volume (5*a*), shown as fluidic flow (7*a*) from a neighboring fluidic volume (not shown for clarity), enters through fluidic gap (6*a*) formed by the stretching and thinning of the material of the flexible actuable layer (23) over the top surface (29*a*) of thin wall (21*a*), which draws actuable film layer (4) away from the surface of substrate (3). As then shown in FIG. 3C, when the flexible actuable layer (23) is drawn towards the bottom of an adjacent cavity (22*b*) (i.e., in an actuated state), the portion of the flexible actuable layer (23) that intersects with the top surface (29*b*) of the thin wall (21*b*) thins as it is stretched from deflection, drawing the actuable film layer (4) away from the surface of substrate (3) forming fluidic gap (6*b*) providing for fluidic flow (7*b*) from fluidic volume (5*a*) to fluidic volume (5*b*). As shown in FIG. 3D, by de-actuating the flexible actuable layer (23) in the first cavity (22*a*) away from the bottom surface (24*a*) of the first cavity (22*a*) and actuating/deflecting the flexible actuable layer (23) towards the bottom surface (24*c*) of the third cavity (22*c*), stretching flexible actuable layer (23) over the top surface (29*c*) of thin wall (21*c*), subsequent fluid volume (5*c*) is formed as is subsequent fluidic gap (6*c*) such that fluid is transferred through the transient fluid gap (8*b*) into the second fluid volume (5*b*) (FIG. 3D) and into third fluid volume (5*c*) through the transient fluid gap (6*c*) communicating between the second cavity (22*b*) and third cavity (22*c*). Finally, as shown in FIGS. 3E and 3F, by de-actuating the flexible actuable layer (23) away from the bottom surface (24*c*) of the third cavity (22*c*), the fluid transferred is shown as fluidic flow (7*d*) out of the third fluid volume (5*c*) through the transient fluidic gap (6*d*) at the top surface (29*d*) of thin wall (21*d*) into an adjacent fluidic volume (not shown for clarity) and the portion of the cartridge component (2) shown is returned to its original unactuated state shown in FIG. 3F. The steps described above are shown as sequential actuation steps, but the actuation steps may be concurrent in practice.

As shown in FIGS. 4A-4D, the channel-less microfluidic pump (1-1 or 1-2) may be configured to include a portion of a manifold component (20) having multiple cavities (22) shown as hexagons and further including fluid sources in the form of one or more reservoirs (8) either formed in (the thicker versions of substrate (3) (FIGS. 4A, 5A, 13A-C, 14A and 14C) or on the thinner versions of substrate (3) (FIGS. 15A-E, 16A-B, 17A-B, 18A-28) and/or located external to the substrate (3) and connected thereto by external (e.g., tubular) connections (11) (FIGS. 4C-D). As shown in FIGS. 4 A-D, vias (9) or supply channels (10) are formed in substrate (3) to provide a fluidic connection between the fluid source (e.g., reservoir (8) or external connection (11) and the interface between the actuable film layer (4) and the surface of the substrate (3). An advantage of a configuration such as that shown in FIGS. 4B and 4D is the multiple pathways available to transport fluids within the channel-less pump (1-1 or 1-2) based on the increased number of cavities available to form fluidic gaps to increase pumping capacity. When more than one pathway is used to pump materials through the channel-less pump greater volumes can be transported thus increasing the capacity of the pump.

FIG. 4A shows a side cross sectional view of an exemplary configuration of the invention (cut along the dashed line AB in FIG. 4B). FIG. 4B is a top plan view of an exemplary configuration of the invention showing reservoirs (8) that are formed in the substrate (3) or attached to the surface of the substrate (3) on the side opposite the surface against which the actuable film layer (4) lies. In either case, reservoir (8) communicates through via (9) or a supply channel (10) either formed into the substrate (3) or in the surface of the substrate (3) covered with actuable film layer (4). As shown in FIG. 4A, a reservoir (8) may be located proximate to a cavity (22) in the manifold component (20) with a corresponding via (9) for transporting fluid from reservoir (8) into a fluidic volume (5) when the channel-less microfluidic pump (1-1 or 1-2) is in an actuated state. Alternatively, as shown in FIGS. 4C and 4D, a reservoir (8) may be located remotely from a cavity (22) either elsewhere in the substrate (3) and connected by a supply channel (10) or external from the cartridge component (2) and connected to substrate (3) by an external connection (11). In the configuration shown, fluid can be transported between various reservoirs (8) using the principles described in FIGS. 3A-3F (or FIGS. 6A-6F when flexible actuable layer (23) is not used). Any number of cavities (22) greater than three can be provided in manifold component (20) to successfully modulate the transfer of fluid between the actuable film layer (4) and the substrate (3) of the cartridge component (2). The greater the number of cavities (22), the greater the number of transient fluidic gaps (6) will be available for the transfer/transport of fluid.

Figure 5D:
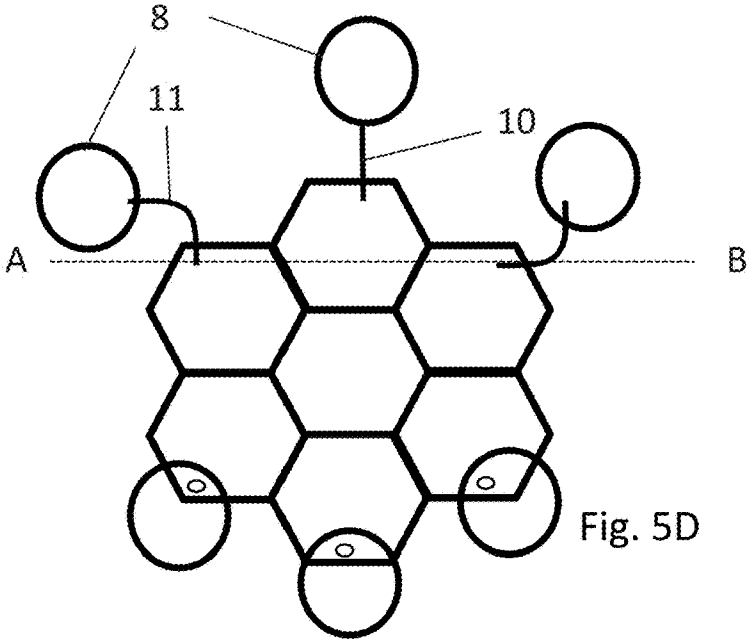
Figure 5B:
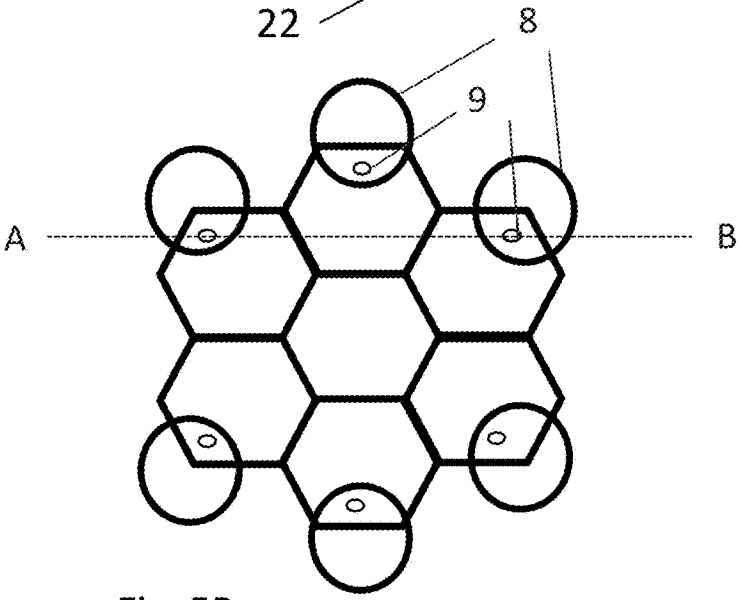

As shown in FIGS. 5A-5D, the channel-less microfluidic pump (1-1 or 1-2) may be configured to include a portion of a manifold component (20) having multiple cavities (22) shown as hexagons and further including multiple fluid sources in the form of one or more reservoirs (8) either formed in (the thicker versions of substrate (3) (FIGS. 4A, 5A, 13A-C, 14A and 14C) or on the thinner versions of substrate (3) (FIGS. 15A-E, 16A-B, 17A-B, 18A-28) and/or located external to the substrate (3) and attached to substrate (3) either directly through a supply channel (10) formed in substrate (3) or connected thereto by external (e.g., tubular) connections (11); or as shown in FIG. 5D, any combination of configurations of reservoirs (8) vias (9), supply channels (10) and external connections (11). An advantage of a configuration such as that shown in FIGS. 5B and 5D is the multiple pathways available to transport fluids within the channel-less pump (1-1 or 1-2) based in the increased number of cavities available to form fluidic gaps to increase pumping capacity. When more than one pathway is used to pump materials through the channel-less pump greater volumes can be transported thus increasing the capacity of the pump.

FIG. 5A shows a side cross sectional view of an exemplary configuration of the invention (cut along the dashed line AB in FIG. 5B). FIG. 5B is a top plan view of an exemplary configuration of the channel-less pump (1-1 or 1-2) showing reservoirs (8) that are formed in the substrate (3) or attached to the surface of the substrate (3) on the side opposite the surface against which the actuable film layer (4) lies. In either case, reservoir (8) communicates through via (9) or a supply channel (10) with the surface of the substrate (3) disposed with actuable film layer (4). As shown in FIG. 5A, a reservoir (8) may be located proximate to a cavity (22) in the manifold component (20) with a correspondingly via (9) for transporting fluid from reservoir (8) into a fluidic volume (5) when the channel-less microfluidic pump (1-1 or 1-2) is in an actuated state. Alternatively, as shown in FIGS. 5C and 5D, a reservoir (8) may be located remotely from a cavity (22) either elsewhere in the substrate (3) and connected by a supply channel (10) or separate from the substrate (3) and connected to the substrate by an external supply connection (11); or as shown in FIG. 5D, any combination of configurations of reservoirs (8), vias (9), supply channels (10) and external connections (11). In the configuration shown, fluid can be transferred/transported between various reservoirs (8) using the principles described in FIGS. 3A-3F (or FIGS. 6A-6F when flexible actuable layer (23) is not used). Any number of cavities (22) greater than three can be formed in manifold component (20) to successfully modulate the transfer of fluid between the film layer (4) and the substrate (3) of the cartridge component (2). The greater the number of cavities (22), the greater the number of available transient fluidic gaps (6) will available for the transfer of fluid.

FIG. 6A shows a side cross sectional view of an alternative channel-less microfluidic pump (1-2) comprising a basic cartridge component (2) as described above and an alternative configuration of a three cavity (22) portion of manifold component (20), in which a flexible actuable layer (23) is absent and the thin walls (21) forming the cavities (22) are replaced with deformable material wall sections (33), such that the deformable material wall sections (33) themselves compress or deflect from the force of the actuation of the actuable film layer (4). The deformable material wall sections (33) may be composed of materials such as silicone, elastomeric rubber, or other similar materials, but in all cases the material choice for the deformable material wall sections (33) will advantageously have an appropriate softness or durometer rating allowing it to be reversibly recovered to its non-deflected or non-compressed status after deflection/deformation upon actuation. Such material would also have a Poisson's ratio ≥0.3 so that during actuation it allows a large enough change in the thickness of the deformable material wall sections (33) or sufficient deflection from vertical to form the transient fluidic gap(s) ($6_n$) (see FIG. 6B-6E) of the channel-less microfluidic pump (1-2). FIGS. 6B-6F sequentially illustrate the operation of the channel-less microfluidic pump (1-2) to modulate the movement of a fluid (liquid, gas, or slurry) through cartridge component (2) by controllably forming fluidic gaps ($6_n$) (where n represents a variable location of a fluidic gap formed through the actuation herein described) by controllably actuating the actuable film layer (4). In operation, the actuable film layer (4) is interfaced with the fabricated deformable wall sections (33) (FIG. 6A). Thereafter, when hydraulic or pneumatic pressures are transferred into and out of cavities (22) through actuation channels (25), the actuable film layer (4) is thus actuated and drawn towards the bottom surface (24) of the cavity (22) or de-actuated and forced away from the bottom surface (24) of the cavity (22). As the actuable film layer (4) is deflected towards the bottom surface (24) of the cavity (22), the fabricated deformable wall section (33) at the point of contact with the actuable film layer (4) is either compressed or deflected, thus forming a fluidic gap (6). When the actuable film layer (4) is deflected (de-actuated) towards the surface of the substrate (3) the deformed fabricated deformable wall section (33) recovers and the fluidic gap (6) is sealed. The transport of fluid through the cartridge component (2) using the principles described in FIG. 6A-6F are then substantially the same as the process of moving fluid as described in FIG. 3A-3F.

Figure 7:
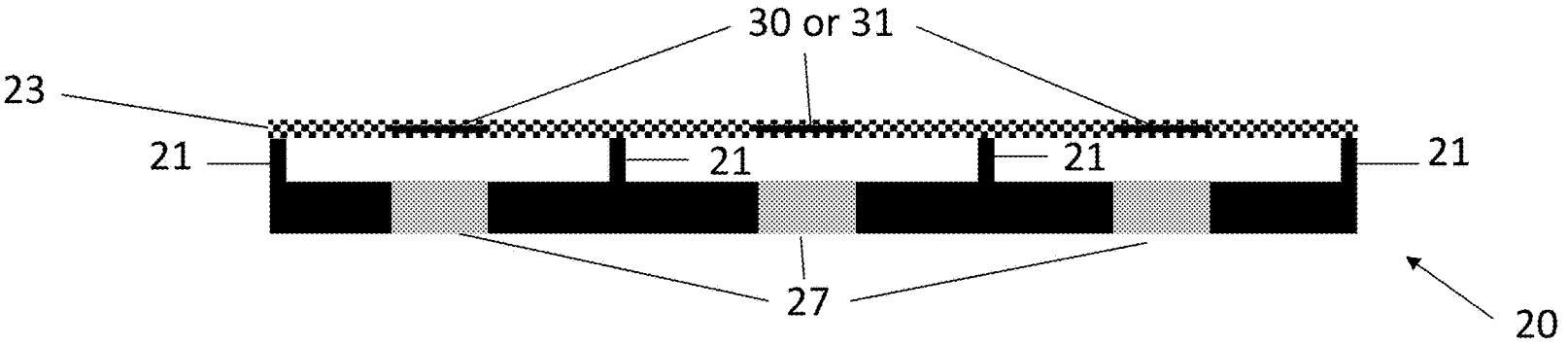
FIG. 7 is a cross-sectional view of an alternative manifold component of a channel-less microfluidic pump using electronic actuation, according to an exemplary embodiment of the invention.

FIG. 7 shows a side cross section of an alternative configuration of a portion of manifold component (20) as described with reference to FIG. 2, where adjacent cavities (22) are separated by the thin walls (21). In this embodiment, each of the cavities (22) includes one or more electronic actuator(s) such as one or more electromagnet(s) (27) which is used to attract or repel one or more magnet(s) (30) or one or more magnetically attractive material(s) (31) embedded in flexible actuable layer (23) or, which may be attached to the bottom of flexible actuable layer (23) covering the opening of the cavities (22). The function of the manifold remains as described earlier in FIGS. 3A-3F.

Figure 8:
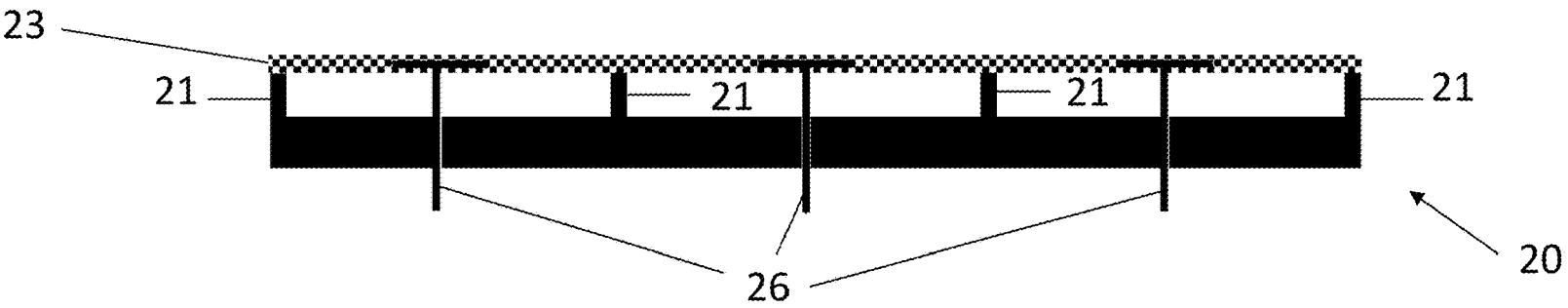
FIG. 8 is a cross-sectional view of an alternative manifold component of a channel-less microfluidic pump using mechanical actuation, according to an exemplary embodiment of the invention.

FIG. 8 shows a side cross section of an alternative configuration of a portion of a manifold component (20) as described with reference to FIG. 2, where adjacent cavities are separated by the thin walls (21). In this embodiment, each of the cavities (22) includes a mechanical actuator (26) such as a connecting rod, which is attached to the bottom of flexible actuable layer (23) or which has a portion embedded in the flexible actuable layer (23) covering the opening of the cavities (22). The connecting rod may be attached to various known mechanical or electrical devices capable of controllably moving the mechanical actuator (26). The function of the manifold remains as described earlier in FIGS. 3A-3F.

Figure 9A:
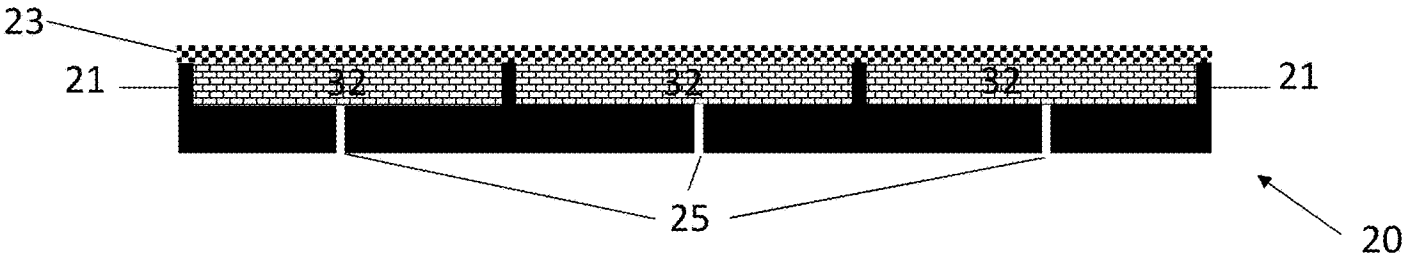
FIG. 9A, FIG. 9B, and FIG. 9C, respectively, are cross-sectional views of three variations of an alternative manifold component of a channel-less microfluidic pump using collapsible structural foam in place of open void space, according to an exemplary embodiment of the invention.
Figure 9B:
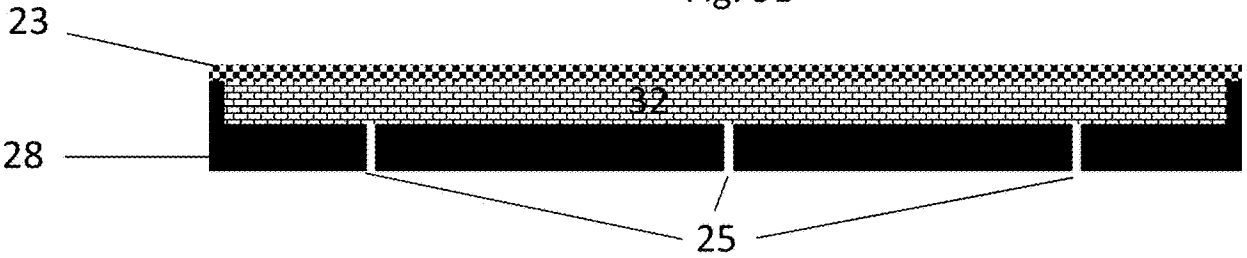
Figure 9C:
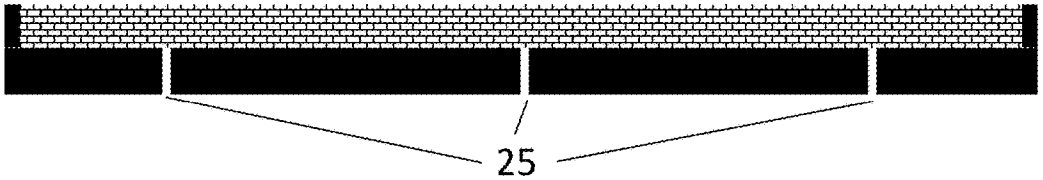

FIG. 9A shows a side cross section of a portion of a manifold component (20) that can be operatively interfaced with the cartridge component (2) as described with reference to FIG. 2, where adjacent cavities are separated by the thin walls (21). In this embodiment, each of the cavities (22) is filled with a foam material (32) that can recoverably collapse. Alternatively, as illustrated in FIG. 9B, the manifold may contain a single, large cavity (22). In each case, the cavity/cavities is/are filled with a foam material (32) that contains pores that can recoverably collapse either in the entirety of the bulk of the foam material (32) or regionally/locally. The top surface of the foam material (32) may or may not be covered by flexible actuable material (23). The foam material (32) is actuated by collapsing the pores in the foam material (32) and re-inflating the pores in the foam material (32) through the actuation channels (25). In the case where the foam material (32) is actuated regionally as shown in FIGS. 9B and 9C, there is no requirement for the thin walls (21) separating individual cavities (22). The function of the manifold remains as described earlier in FIGS. 3A-3F and for FIG. 9C the operation is described in FIGS. 6A-6F.

Figure 10:
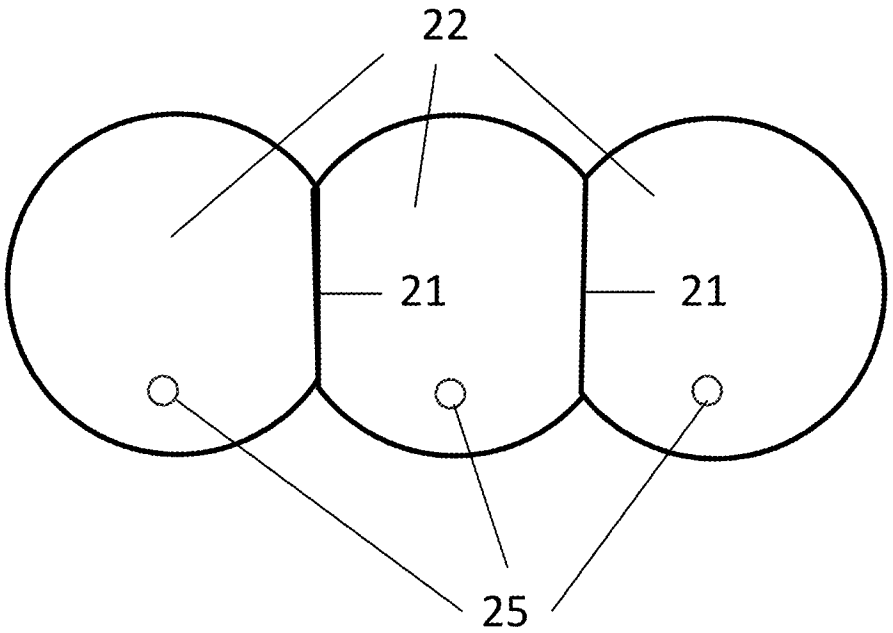
FIG. 10 is a top plan view of an alternative geometric shape (segmented circles) used to form three cavities in a manifold, according to an exemplary aspect of the invention.

FIG. 10 shows a top plan view of an alternative configuration of a portion of a manifold component (20) having a segmented circle geometry for the cavities (22), and the relationship of the thin walls (21) separating the cavities (22), along with the actuation channels (25) addressing each respective cavity (22). Note that the actuation channels (25) depending on the mode of actuation may be generally located anywhere in the bottom surface (24) of a cavity (22).

FIG. 11 shows a block representation of a representative instrument (70) housing at least one manifold component (20). Instrument (70) contains all or some of the components required to controllably operate manifold component (20) so that when manifold component (20) is interfaced with cartridge component (2) (not shown) cartridge component (2) functions. FIG. 11 shows the manifold component (20) mounted horizontally on instrument (70). Optionally, instrument (70) may include a clamping component (36) to aid in holding the cartridge component (2) in place on manifold component (20). Further, optionally, instrument (70) may include optical system (69) either integrated into or underneath manifold component (20) or mounted or integrated into another part of instrument (70), which mounting may be stationary or movable. Optical system (69) may be used to view particular identifying features of cartridge component (2) for any purpose, or may be used to view particular areas of cartridge component (2) for any purpose during the operation of cartridge component (2). Instrument (70) may contain one or more optical systems (69) mounted in either or both configurations described above. Instrument (70) may also include a digital processing unit (not shown for clarity) or instrument (70) may be connected to an external processing device. In either case, the digital processing device will include a user interface so that a user can interact with instrument (70) and instrument (70) can properly control the functions of manifold component (20) to controllably operate cartridge component (2) and any other features of instrument (70) such as optical component (69).

FIG. 12 shows a block representation of a representative instrument (70) housing at least one manifold component (20). Instrument (70) contains all or some of the components required to controllably operate manifold component (20) so that when manifold component (20) is interfaced with cartridge component (2), cartridge component (2) functions. FIG. 12 shows the manifold component (20) mounted vertically on instrument (70). Optionally, instrument (70) may include a clamping component (36) to aid in holding the cartridge component (2) in place on manifold component (20). Further, optionally, instrument (70) may include optical system (69) either integrated into or underneath manifold component (20) or mounted or integrated into another part of instrument (70) which mounting may be stationary or movable. Optical system (69) may be used to view particular identifying features of cartridge component (2) for any purpose, or may be used to view particular areas of cartridge component (2) for any purpose during the operation of cartridge component (2). Instrument (70) may contain one or more optical systems (69) mounted in either or both configurations described above. Instrument (70) may also include a digital processing device (not shown for clarity) or instrument (70) may be connected to an external digital processing device. In either case the digital processing device will include a user interface so that a user can interact with instrument (70) and instrument (70) can properly control the functions of manifold component (20) to controllably operate cartridge component (2) and any other features of instrument (70) such as optical component (69).

FIG. 13 A-C show a variation of cartridge component (2) that includes blister reservoir (12) and a method of filling blister reservoir (12). Blister reservoir (12) is comprised of blister material (13) which covers all or part of substrate (3) opposite the side of substrate (3) where the actuable film layer (4) is located. In the case where substrate (3) is thicker than a film, substrate (3) may or may not have pre-formed pockets where the blister reservoir (12) is formed. Blister reservoir (12) forms a pouch between the substrate (3) and blister material (13).

Figure 13B:
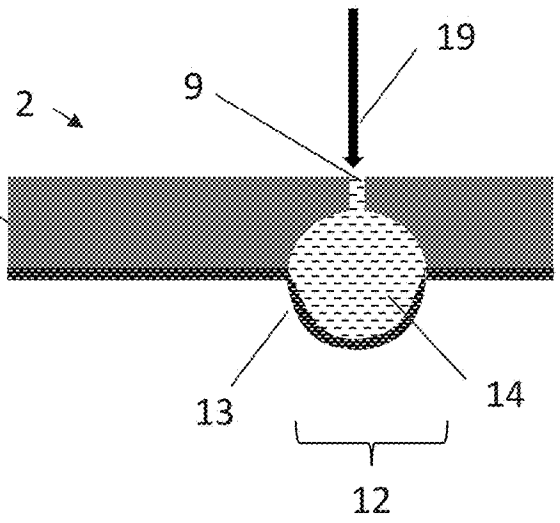
FIG. 13A-FIG. 13C each show a cross-sectional view of an alternative construction of a cartridge component providing for the storage of reagents on the cartridge component in the form of pouches or blisters, according to an exemplary embodiment of the invention.
Figure 13A:
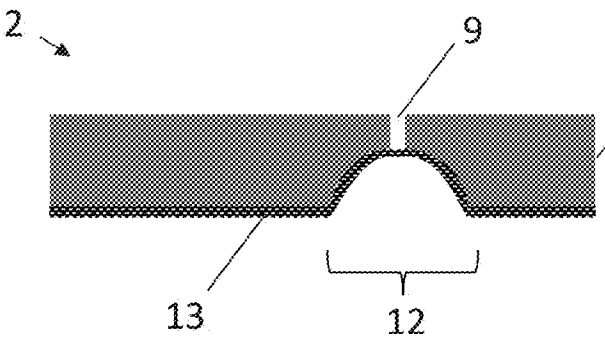

FIGS. 13A and 13B show how a blister reservoir (12) is filled with a reagent material (14) that is either a fluid, gas, slurry or powder through via (9) in substrate (3) using a pipette, capillary or other known material delivery system (19). The blister reservoir (12) may either be expanded by the pressure of the delivered reagent material (14) expelled by the material delivery system (19) or negative pressure may be applied to the side of the blister material (13) opposite via (9) to deflect or expand blister material (13) prior to delivery of reagent material (14) through via (9) using material delivery system (9) (See FIG. 15A-C).

Figure 13C:
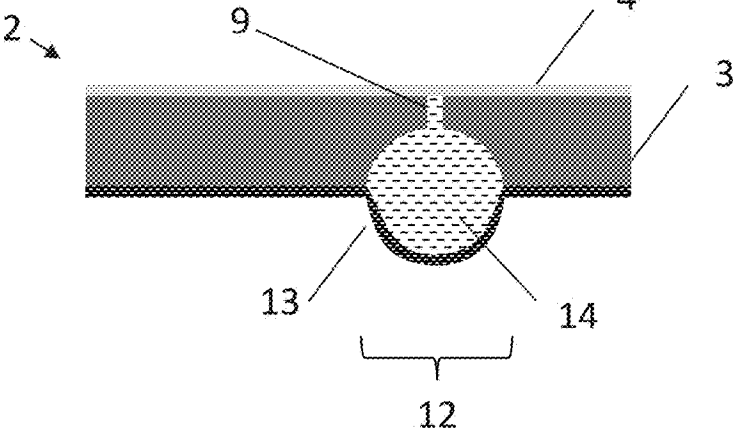

FIG. 13C shows that upon filing the blister reservoir (12) the actuable film layer (4) is applied to the surface of substrate (3) containing via (9) and opposite the side of substrate (3) with blister material (13) to seal the blister reservoir (12). In the case of using a blister reservoir (12) the actuable film layer (4) may be selected from a particularly hydrophobic material or coated with a hydrophobic material (i.e., wax) on the side of the actuable film layer (4) facing the via (9). When the actuable film layer (4) is coated or inherently hydrophobic, via (9) is more completely sealed when the actuable film layer (4) is in the de-actuated state. The actuable film layer (4) may or may not be selectively bonded to the surface of the substrate (3). In the case where the actuable film layer (4) is selectively bonded to regions of substrate (3), it may be selectively bonded by any manner known in the art such as, e.g., ultrasonic bonding, RF bonding, laser welding, thermal bonding, adhesive lamination, solvent bonding or the methods described in U.S. patent application Ser. Nos. 10/964,216 and 11/242,694. The actuable film layer (4) and the substrate (3) may be of the same or different materials. Certain materials such as glass, quartz, ceramics, silicon, metals (e.g. aluminum, stainless steel), polymers (e.g. COC, polyethylene, polycarbonate, acrylic, ABS, PVC, polystyrene, acetal (Delrin), polyolefin copolymer (POC), polypropylene, nylon), silicone, or PDMS, and other similar materials may be used in combination or the same material may be used for the substrate (3) and the actuable film layer (4) Importantly, however, and as further explained below, the actuable film layer (4), while disposed on the surface of the substrate (3) as illustrated in FIGS. 1, 6A, 13C and 15C-15E allows no fluid transport between the actuable film layer (4) and the surface of substrate (3) (i.e., de-actuated state); the actuable film layer (4) can be actuated so that selective regions of the actuable film layer (4) can be drawn away from the surface of substrate (3) forming a fluidic volume (5) (see FIG. 3B or FIG. 6B) between the surface of substrate (3) and the deflected (actuated) portion of the actuable film layer (4). Therefore as shown in FIG. 13A-13C, a cartridge component (2) can be populated with one or more blister reservoirs (12) either filled with one or more reagents (14) or which are unfilled but both of which are sealed and separated from other blister reservoirs (12) so that reagent material (14) can be stored on the cartridge component (2) prior to using cartridge component (2).

FIG. 14 A-D shows the operation of cartridge component (2) comprising the substrate (3), actuable film layer (4) and incorporating a pair of blister reservoirs (12) one of which is filled with reagent material (14) and the other of which is not filled prior to use; each now denoted blister reservoir (12*a*) and (12*b*) for purposes of explanation below.

FIG. 14A shows a side cross section of cartridge component (2) with filled blister reservoir (12*a*) with via (9*a*) and empty blister reservoir (12*b*) with via (9*b*).

FIG. 14C shows a full blister reservoir (12*b*) with via (9*b*) and a now empty blister reservoir (12*a*) with via (9*a*). The movement of fluid between blister reservoir (12*a*) and blister reservoir (12*b*) is accomplished through repeated modulation of actuable film layer (4) as in FIG. 3A-F or FIG. 6A-F.

FIG. 14B shows a top plan view of a representative portion of a channel-less microfluidic pump (1-1 or 1-2) introduced in previous figures. FIG. 14B shows a full blister reservoir (12*a*) with via (9*a*) and empty blister reservoir (12*b*) with via (9*b*).

FIG. 14D shows a full blister reservoir (12*b*) with via (9*b*) and a now empty blister reservoir (12*a*) with via (9*a*). The movement of fluid between blister reservoir (12*a*) and blister reservoir (12*b*) is accomplished through repeated modulation of actuable film layer (4) as in FIG. 3A-F or FIG. 6A-F. The geometry of the cavities (22) depicted in FIGS. 14B and 14D are hexagonal but other geometries such as segmented circles, triangles, squares, pentagons, etc. are capable of performing the same function. In operation, the pumping system withdraws reagent material (14) from blister reservoir (12*a*) which thereby collapses, deflates or shrinks back onto the surface of substrate (3) and pumps reagent material (14) to unfilled blister reservoir (12*b*) which deflects, lifts or expands as reagent material (14) enters blister reservoir (12*b*) through via (9*b*). Since the container (in this case a blister reservoir (12)) deforms in such manner the blister reservoir (12*b*) does not need to be vented in order for the fluid to be removed from the blister reservoir (12*a*) and delivered to blister reservoir (12*b*). Such a system requires neither external force applied directly to the blister reservoir (12) nor venting systems in order extract the reagent material (14) from inside the blister reservoir (12*a*) or to deliver the reagent material (14) to blister reservoir (12*b*). Furthermore, the configuration of the channel-less microfluidic pump (1-1 or 1-2) provides for a very low dead volume since in the unactuated state there are no channels to trap fluids, the only place where fluids may reside in the unactuated state is in the via (9) or the supply channel feeding fluids, gasses or slurries to the pump.

FIGS. 15A-E show an alternative construction, operation and method of preparing a cartridge component (2) where substrate (3) is a film itself or proportionally thinner than depicted in previous figures and where substrate (3) does not include pockets for reservoirs.

Figure 15B:
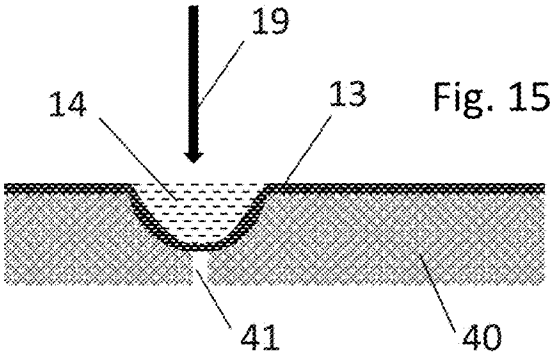
FIG. 15A-FIG. 15E are each cross-sectional views illustrative of an alternative method of constructing a cartridge component including a very thinner substrate and providing an optional protective cover, according to an exemplary embodiment of the invention.
Figure 15A:
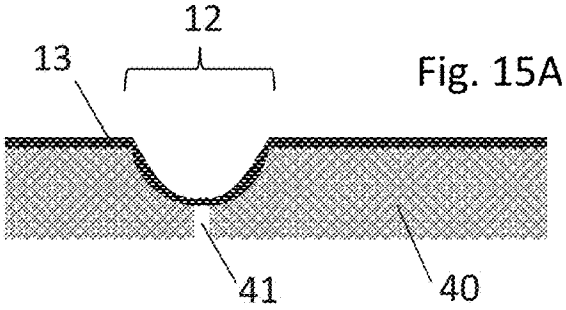

FIG. 15A shows a fixture (40) with a vacuum channel (41) covered by blister material (13), which has been drawn into a hollow formed in fixture (40) upon application of a vacuum through vacuum channel (41).

FIG. 15B shows material delivery system (19) delivering reagent material (14) directly to the deformed portion of blister material (13). Alternatively, substrate (3) including via (9) may be first applied to blister material (13) and material delivery system (19) may deliver reagent (14) through via (9) as in FIG. 13B. Actuatable film layer (4) is then applied to substrate (3) to seal the blister reservoir (12).

Figure 15D:
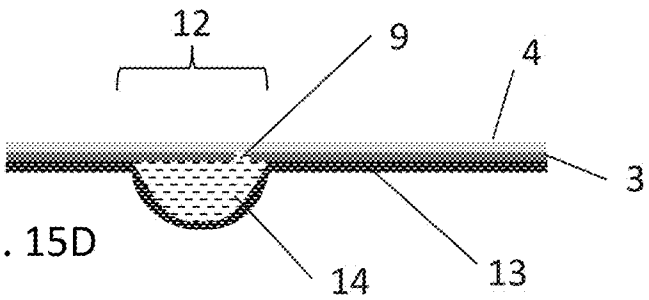
Figure 15C:
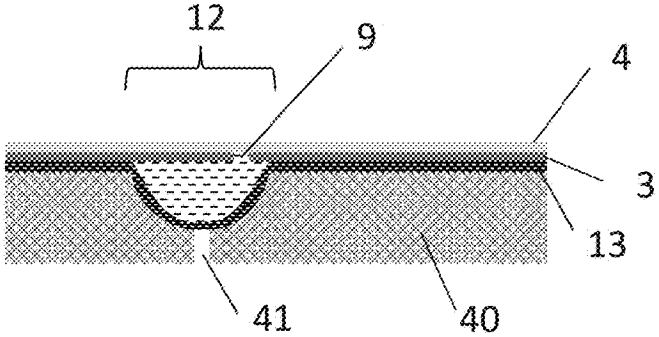

FIG. 15C shows cartridge component (2) comprising a blister reservoir (12) a substrate (3) applied to blister material (13) and actuable film layer (4) applied to substrate (3) to seal blister reservoir (12). Substrate (3) is formed with via (9) interfacing with blister reservoir (12) in order to facilitate withdrawal of reagent material (14) from blister reservoir (12). Substrate (3) is applied to the surface of blister material (13) so that the blister reservoir (12) is only accessible through via (9). Substrate (3) may be adhered to blister material (13) with any permanent system such as ultrasonic bonding, RF bonding, laser welding, thermal bonding, adhesive lamination, solvent bonding. Actuatable film layer (4) is then applied to the surface of substrate (3) to seal via (9). Alternatively, substrate (3) may be applied to blister material (13) prior to filling blister reservoir (12) which is then filled through via (9) (See FIGS. 13A-C). as long as there is either no permanent bonding between the actuable film layer (4) and substrate (3) or selective bonding as is described above is used so that actuable film layer (4) can modulate the opening and closing of via (9) and function as described in FIG. 3A-f or 6A-F. Actuatable film layer (4) may be provided with a hydrophobic coating such as wax or other similar material in order to more completely, though temporarily, seal via (9). As in earlier figures actuable film layer (4) may or not be selectively bonded to substrate (3).

FIG. 15D shows the completed cartridge component (2) upon removal from fixture (40).

Figure 15E:
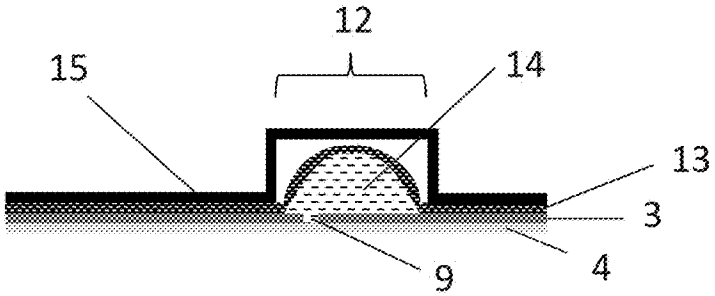

FIG. 15E shows an alternative configuration of cartridge component (2) shown in FIG. 15D with an optional protective cover (15) applied to the surface of blister material (13) opposite the side of blister material (13) to which substrate (3) is applied.

FIG. 16 A-D shows the operation of alternative construction of cartridge component (2) comprising the substrate (3), actuable film layer (4) and incorporating a pair of blister reservoirs (12) one of which is filled with reagent material (14) and the other of which is not filled prior to use; each now denoted blister reservoir (12*a*) and (12*b*) for purposes of explanation below and further incorporating optional protective cover (15). The protective cover (15) provides protection of the blister reservoirs (12) following manufacturing, during shipping, handling and may also provide protection to the cartridge component (2) when interfaced with the manifold component (20). Protective cover (15) may be vented to facilitate the filling and emptying of blister reservoirs (12) within the protective cover (15).

Figures 16A, 16B, 16C, 16D, 17A, 17B, 17C, 17D:
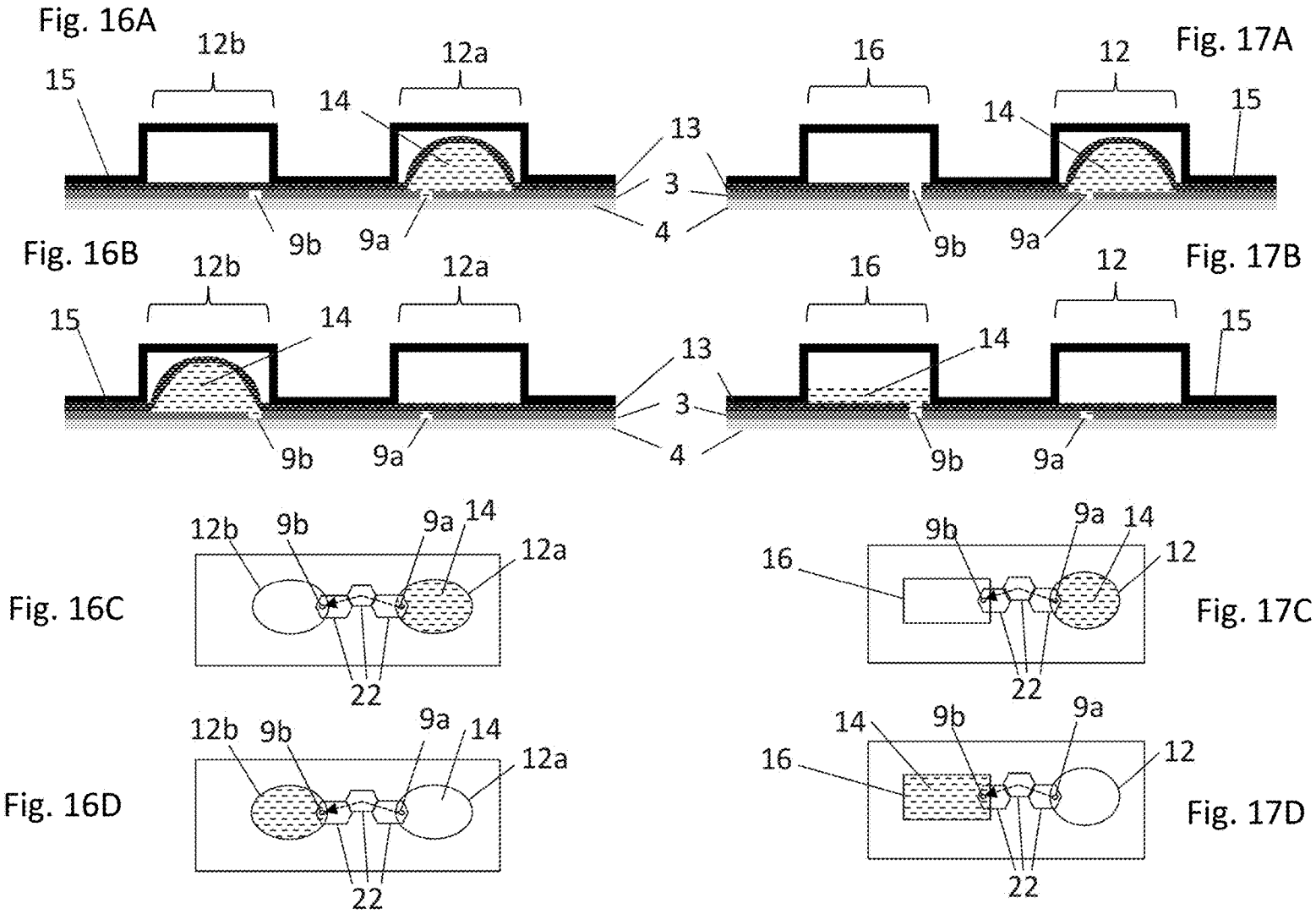
FIG. 16A-FIG. 16B are each cross-sectional views illustrative of using the alternative construction of a cartridge component introduced in FIG. 15A-E using the channel-less pumping depicted in FIGS. 3A-F and 6A-F, according to an exemplary embodiment of the invention.
FIGS. 16C-FIG. 16D are top plan views of the alternate constructions of FIG. 16A and FIG. 16B, respectively.
FIG. 17A-FIG. 17B are cross-sectional views illustrative of using an further alternative construction of a cartridge component introduced in FIG. 15A-E and again in FIG. 16A-C, where the protective cover is used as an alternative chamber for receiving or storing a fluid, gas or slurry, and using the channel-less pumping depicted in FIGS. 3A F and 6A-F, according to an exemplary embodiment of the invention.
FIG. 17C-FIG. 17D are top plan views of the alternate constructions of FIG. 17A and FIG. 17B, respectively.

FIG. 16A shows a side cross section of cartridge component (2) with protective cover (15) with filled blister reservoir (12*a*) with via (9*a*) and empty blister reservoir (12*b*) with via (9*b*).

FIG. 16B shows a side cross section of cartridge component (2) with a protective cover (15) with a full blister reservoir (12*b*) with via (9*b*) and a now empty blister reservoir (12*a*) with via (9*a*). The movement of fluid between blister reservoir (12*a*) and blister reservoir (12*b*) is accomplished through repeated modulation of actuable film layer (4) as in FIG. 3A-F or FIG. 6A-F.

FIG. 16C shows a top plan view of a representative portion of a channel-less microfluidic pump (1-1 or 1-2) introduced in previous figures. FIG. 16C shows a full blister reservoir (12*a*) with via (9*a*) and empty blister reservoir (12*b*) with via (9*b*).

FIG. 16D shows a full blister reservoir (12*b*) with via (9*b*) and a now empty blister reservoir (12*a*) with via (9*a*). The movement of fluid between blister reservoir (12*a*) and blister reservoir (12*b*) is accomplished through repeated modulation of actuable film layer (4) as in FIG. 3A-F or FIG. 6A-F. The geometry of the cavities (22) depicted in FIGS. 16C and 16D are hexagonal but other geometries such as segmented circles, triangles, squares, pentagons, etc. are capable of performing the same function. In operation, the pumping system withdraws reagent material (14) from blister reservoir (12*a*) which thereby collapses, deflates or shrinks back onto the surface of substrate (3) and pumps reagent material (14) to unfilled blister reservoir (12*b*) which deflects, lifts or expands as reagent material (14) enters blister reservoir (12*b*) through via (9*b*). Since the container (in this case a blister reservoir (12)) deforms in such manner the blister reservoir (12*b*) does not need to be vented in order for the fluid to be removed from the blister reservoir (12*a*) and delivered to blister reservoir (12*b*) but optional protective cover (15) may be vented to allow for the filling of blister reservoir (12*b*) or emptying of blister reservoir (12*a*) within protective cover (15). Such a system requires neither external force applied directly to the blister nor venting systems in the blister material (13) order extract the material from inside the blister reservoir (12*a*). Furthermore, the configuration of the channel-less microfluidic pump (1-1 or 1-2) provides for a very low dead volume since in the unactuated state there are no channels to trap fluids; the only place where fluids may reside in the unactuated state is in the via (9) or the supply channel feeding fluids, gasses or slurries to the pump.

FIG. 17 A-D shows the operation of a further alternative construction of cartridge component (2) comprising the substrate (3), actuable film layer (4) and incorporating a blister reservoir (12) which is filled with reagent material (14) and a chamber reservoir (16) formed between the protective cover (15) and the surface of blister material (13) opposite the side of the blister material (13) interfacing the surface of substrate (3). The protective cover (15) therein provides protection of the blister reservoirs (12) following manufacturing, during shipping, handling and may also provide protection to the cartridge component (2) when interfaced with the manifold component (20) and provides a receptacle for fluids, gasses or slurries delivered from other areas of the cartridge component (2). Protective cover (15) may be vented to facilitate its filling and emptying.

FIG. 17A shows a side cross section of cartridge component (2) with protective cover (15) with filled blister reservoir (12) with via (9*a*) and empty chamber reservoir (16) with via (9*b*).

FIG. 17B shows a side cross section of cartridge component (2) with a protective cover (15) with reagent material (14) partially filling chamber reservoir (16) with via (9*b*) and a now empty blister reservoir (12) with via (9*a*). The movement of fluid between blister reservoir (12) and chamber reservoir (16) is accomplished through repeated modulation of actuable film layer (4) as in FIG. 3A-F or FIG. 6A-F.

FIG. 17C shows a top plan view of a representative portion of a channel-less microfluidic pump (1-1 or 1-2)

introduced in previous figures. FIG. 17C shows a full blister reservoir (12) with via (9*a*) and empty chamber reservoir (16) with via (9*b*).

FIG. 17D shows a partially full chamber reservoir (16) with via (9*b*) and a now empty blister reservoir (12) with via (9*a*). The movement of fluid between blister reservoir (12) and chamber reservoir (16) is accomplished through repeated modulation of actuable film layer (4) as in FIG. 3A-F or FIG. 6A-F. The geometry of the cavities (22) depicted in FIGS. 17C and 17D are hexagonal but other geometries such as segmented circles, triangles, squares, pentagons, etc. are capable of performing the same function. In operation, the pumping system withdraws reagent material (14) from blister reservoir (12) which thereby collapses, deflates or shrinks back onto the surface of substrate (3) and pumps reagent material (14) to unfilled chamber reservoir (16) which deflects, lifts or expands as reagent material (14) enters chamber reservoir (16) through via (9*b*). Since the container (in this case a blister reservoir (12)) deforms in such manner the blister reservoir (12) does not need to be vented in order for the fluid to be removed from the blister reservoir (12) and delivered to chamber reservoir (16) but protective cover (15) may be vented to allow for the filling of chamber reservoir (16) or emptying of blister reservoir (12) within protective cover (15). Such a system requires neither external force applied directly to the blister nor venting systems in the blister material (13) in order extract the material from inside the blister reservoir (12). Furthermore, the configuration of the channel-less microfluidic pump (1-1 or 1-2) provides for a very low dead volume since in the unactuated state there are no channels to trap fluids, the only place where fluids may reside in the unactuated state is in the via (9) or the supply channel feeding fluids, gasses or slurries to the pump.

Figure 18B:
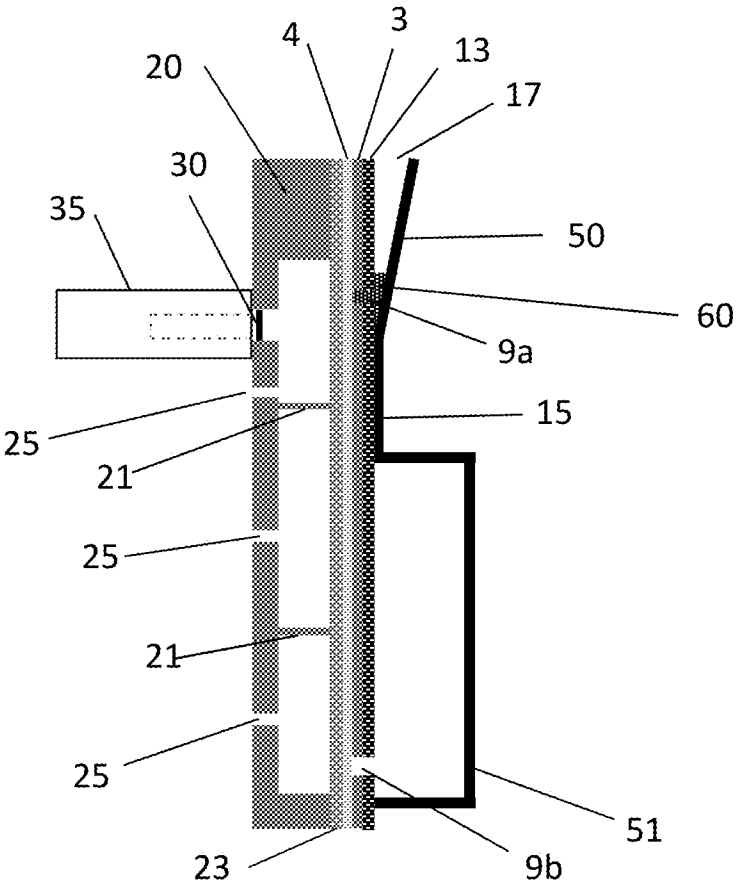
FIG. 18A-FIG. 18B are top plan and corresponding cross-sectional views of a portion of a cartridge component configured to process a biological sample in order to perform a nucleic acid analysis.
Figure 18A:
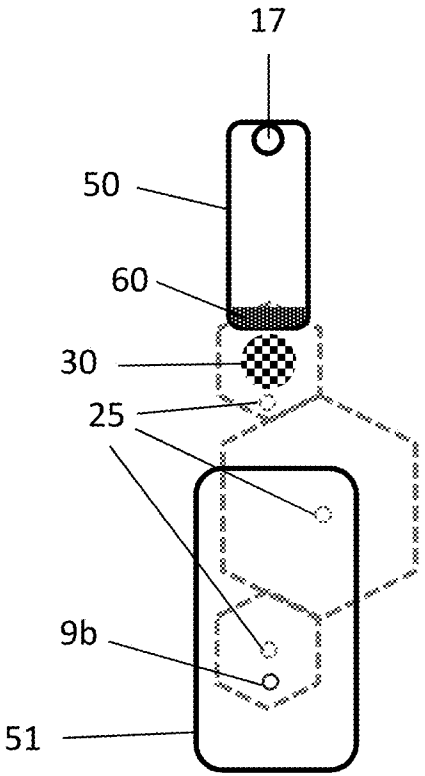

FIG. 18A shows a plan view of a portion of a cartridge component (2) that receives a sample (60) input from the user or a robotic delivery system into sample port (17) of sample reservoir (50). Sample (60) may or may not contain magnetic beads, paramagnetic beads, or similar magnetically attractive beads when input by the user or a robotic delivery system. In the case where the sample (60) does not contain magnetic beads, paramagnetic beads, or similar magnetically attractive beads the beads may be delivered from a reagent storage reservoir elsewhere on cartridge component (2) (see FIGS. 29-32 for details).

FIG. 18B shows a side cross section view of a portion of a cartridge component (2) shown in FIG. 18A that receives a sample (60) input from the user or a robotic delivery system into sample port (17) of sample reservoir (50). Sample (60) may or may not contain magnetic beads, paramagnetic beads, or similar magnetically attractive beads when input by the user or a robotic delivery system. In the case where the sample (60) does not contain magnetic beads, paramagnetic beads, or similar magnetically attractive beads, the beads may be delivered from a reagent storage reservoir elsewhere on cartridge component (2) (see FIGS. 29-32 for details). FIG. 18B includes an optional protective cover (15) composed of a rigid material that is disposed over optional blister material (13) to maintain the integrity of components formed in optional blister material (13). Protective cover (15) may be extended over the entire surface of the cartridge component (2) or only a portion of the surface of cartridge component (2). The protective cover (15) may be further interfaced with a clamping component (36) (see FIGS. 11 & 12) on the instrument (70) (see FIGS. 11 & 12) or the manifold component (20) in order to hold cartridge component (2) in place on manifold component (20) and further protective cover (15) may also be useful in guiding or indexing optical system (69) (see FIGS. 11 & 12) housed in instrument (70).

Figure 19B:
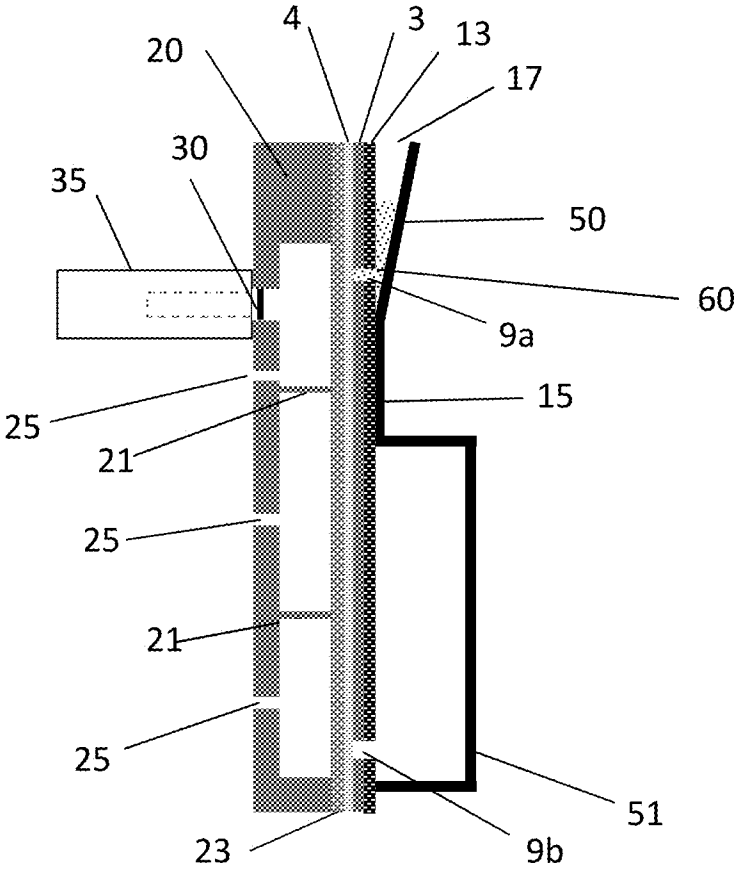
FIG. 19A-FIG. 19B are top plan and corresponding cross-sectional views of a portion of a cartridge component configured to process a biological sample in order to perform a nucleic acid analysis.
Figure 19A:
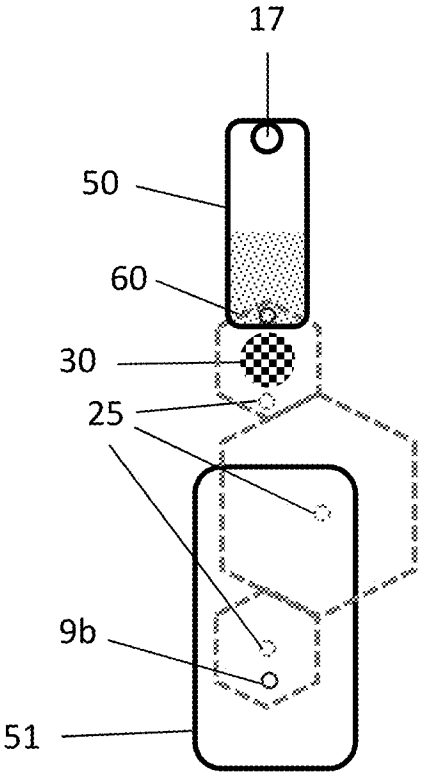

FIG. 19A shows a plan view of a portion of a cartridge component (2) with sample (60) in sample reservoir (50) mixed with a lysing reagent provided either by the user, a robotic delivery system or pumped into sample reservoir (50) from another reservoir located on cartridge component (2) (see FIGS. 29-32 for details). Sample (60) now contains magnetic beads, paramagnetic beads, or similar magnetically attractive beads. The sample (60) with the lysing reagent and the magnetic beads, paramagnetic beads, or similar magnetically attractive beads is pumped at least once through via (9*a*) into fluidic volume 5*a* (see FIG. 20B) and back again through via (9*a*) into sample reservoir (50) to fully lyse and mix the sample with the reagents (multiple repetitions may be desired in practice depending upon the sample). Fluidic volume (5*a*) or sample reservoir (50) may be heated using a heater (not shown for clarity) in order to facilitate the processing of the sample. Further fluidic volume (5*a*) or sample reservoir (50) may be subjected to sonication (see FIG. 34) in order to facilitate processing of the sample.

FIG. 19B shows a side cross section view of a portion of a cartridge component (2) shown in FIG. 19A (not showing heating or sonication for clarity).

Figure 20B:
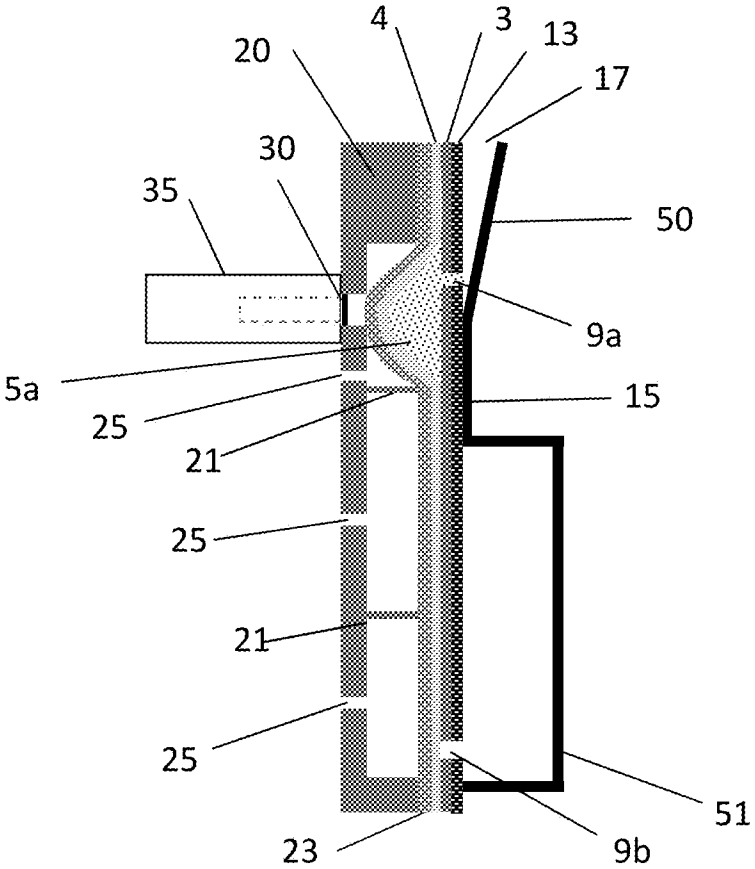
FIG. 20A-FIG. 20B are top plan and corresponding cross-sectional views of a portion of a cartridge component configured to process a biological sample in order to perform a nucleic acid analysis.
Figure 20A:
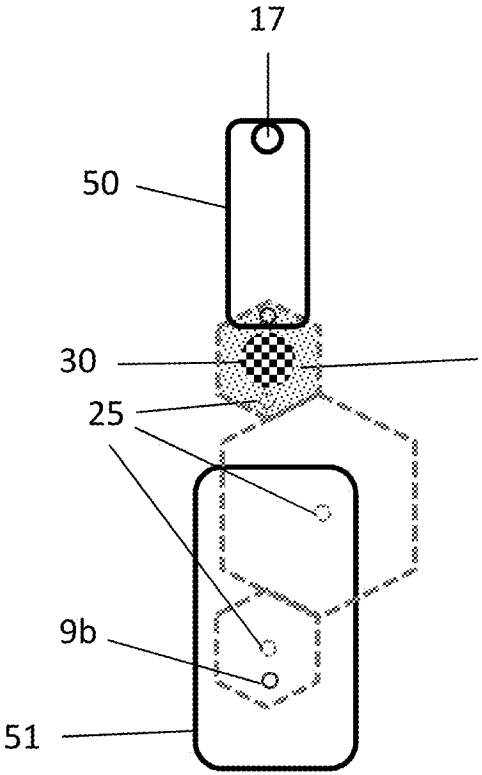

FIG. 20A shows a plan view of a portion of a cartridge component (2) that has withdrawn mixed and lysed sample (60) from sample reservoir (50) through via (9*a*) into fluidic volume (5*a*) which is addressed by one or more magnet(s) (30) (which may be a permanent or an electromagnet). One or more magnet(s) (30) is at a position away from fluidic volume (5*a*) (or not engaged in the case of an electromagnet) so that its magnetic field has no effect on sample (60) contained in fluidic volume (5*a*).

FIG. 20B shows a side view of a portion of a cartridge component (2) shown in FIG. 20A.

Figure 21B:
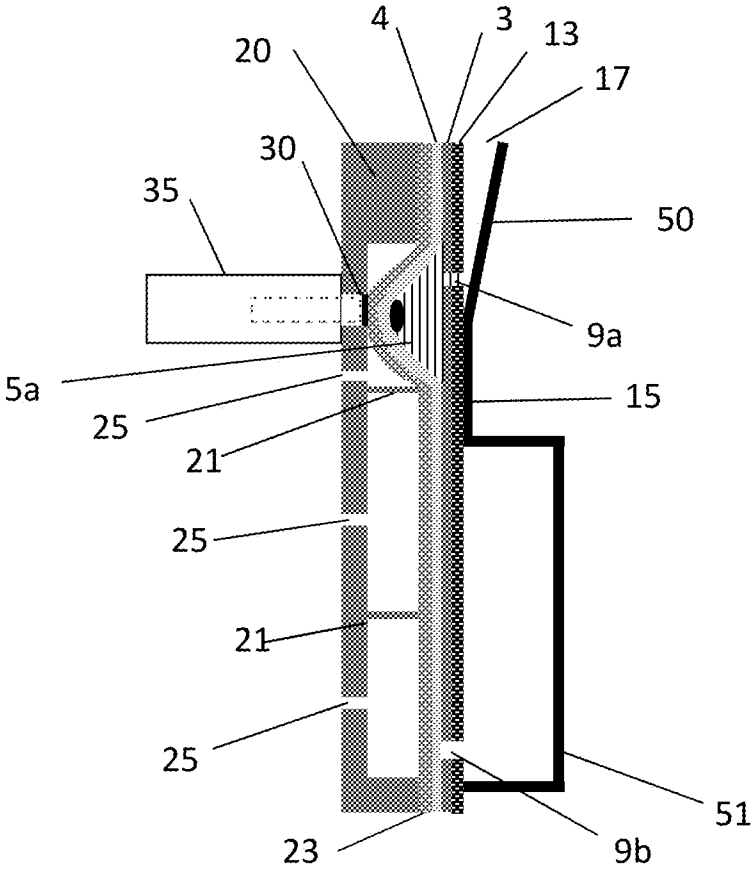
FIG. 21A-FIG. 21B are top plan and corresponding cross-sectional views of a portion of a cartridge component configured to process a biological sample in order to perform a nucleic acid analysis.
Figure 21A:
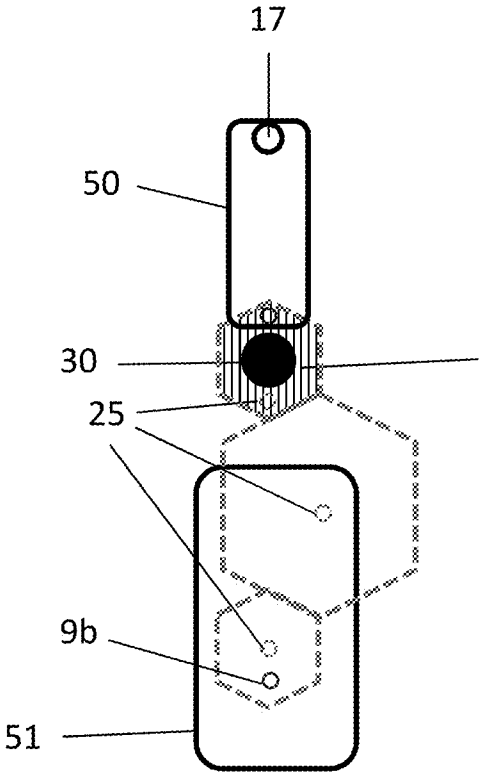

FIG. 21A shows a plan view of a portion of a cartridge component (2) that has withdrawn sample (60) from sample reservoir (50) through via (9*a*) into fluidic volume (5*a*) which is addressed by one or more magnet(s) (30). One or more magnet(s) (30) is engaged or at a position proximate to the fluidic volume (5*a*) such that the magnetic field attracts the magnetic particles, paramagnetic particles, or similar magnetically attractive particles in sample (60) thereby separating the magnetic particles, paramagnetic particles, or similar magnetically attractive particles and whatever material is bound to the magnetic particles, paramagnetic particles, or similar magnetically attractive particles from the bulk of the fluid in fluidic volume (5*a*).

FIG. 21B shows a side view of a portion of a cartridge component (2) shown in FIG. 21A.

Figure 22B:
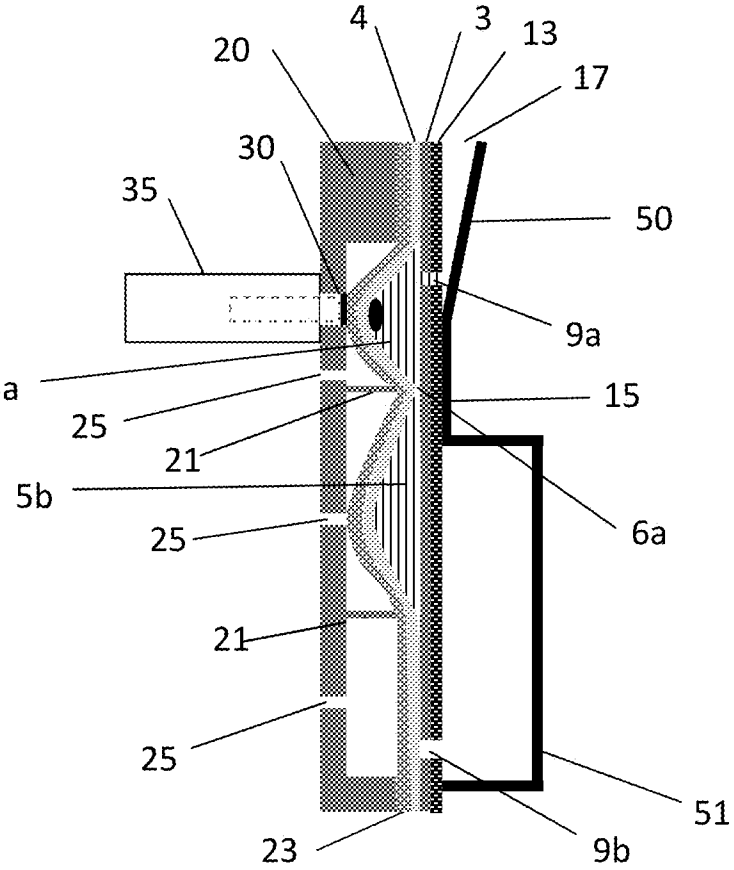
FIG. 22A-FIG. 22B are top plan and corresponding cross-sectional views of a portion of a cartridge component configured to process a biological sample in order to perform a nucleic acid analysis.
Figure 22A:
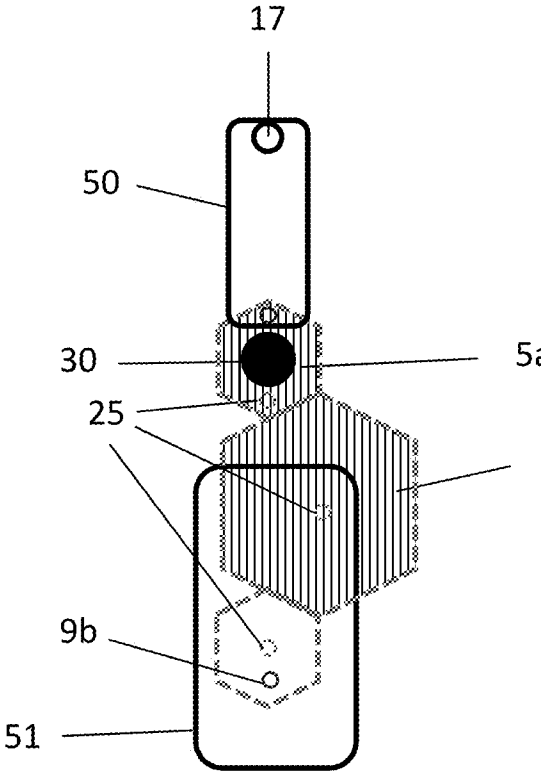

FIG. 22A shows a plan view of a portion of a cartridge component (2) with one or more magnet(s) (30) engaged or in a position proximate to fluidic volume (5*a*) such that the magnetic field attracts the magnetic particles, paramagnetic particles, or similar magnetically attractive particles in the sample thereby separating the magnetic particles, paramagnetic particles, or similar magnetically attractive particles and whatever material is bound to the magnetic particles, paramagnetic particles, or similar magnetically attractive particles from the bulk of the fluid in fluidic volume (5*a*). FIG. 22A further shows the formation of adjacent fluidic volume (5*b*) causing the formation of fluidic gap (6*a*) such that a portion of fluid from fluidic volume (5*a*) flows into fluidic volume (5*b*) through fluidic gap (6*a*).

FIG. 22B shows a side view of a portion of a cartridge component (2) shown in FIG. 22A.

Figure 23B:
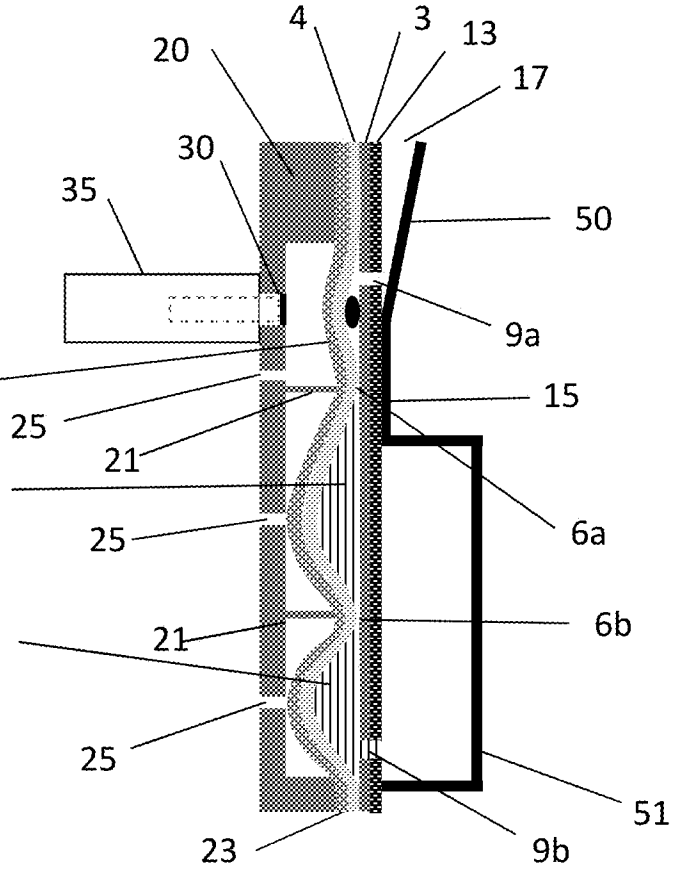
FIG. 23A-FIG. 23B are top plan and corresponding cross-sectional views of a portion of a cartridge component configured to process a biological sample in order to perform a nucleic acid analysis.
Figure 23A:
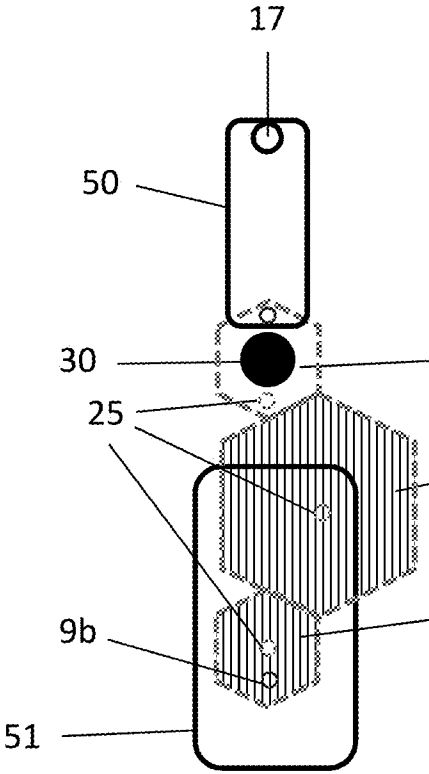

FIG. 23A shows a plan view of a portion of cartridge component (2) with a pellet of magnetic particles, paramagnetic particles, or similar magnetically attractive particles in compressed fluidic volume (5*a*). FIG. 23A further shows the formation of fluidic volume (5*c*) and the formation of fluidic gap (6*b*). The compression of fluidic volume (5*a*) and the opening of fluidic volume (5*c*) provides a pathway for fluid transfer through via (9*b*) into waste reservoir (51) such that the remaining fluid from fluidic volume (5*a*) flows into fluidic volume (5*b*) through fluidic gap (6*a*) and further into fluidic volume (5*c*) through fluidic gap (6*b*).

FIG. 23B shows a side view of a portion of a cartridge component (2) shown in FIG. 23A.

Figure 24B:
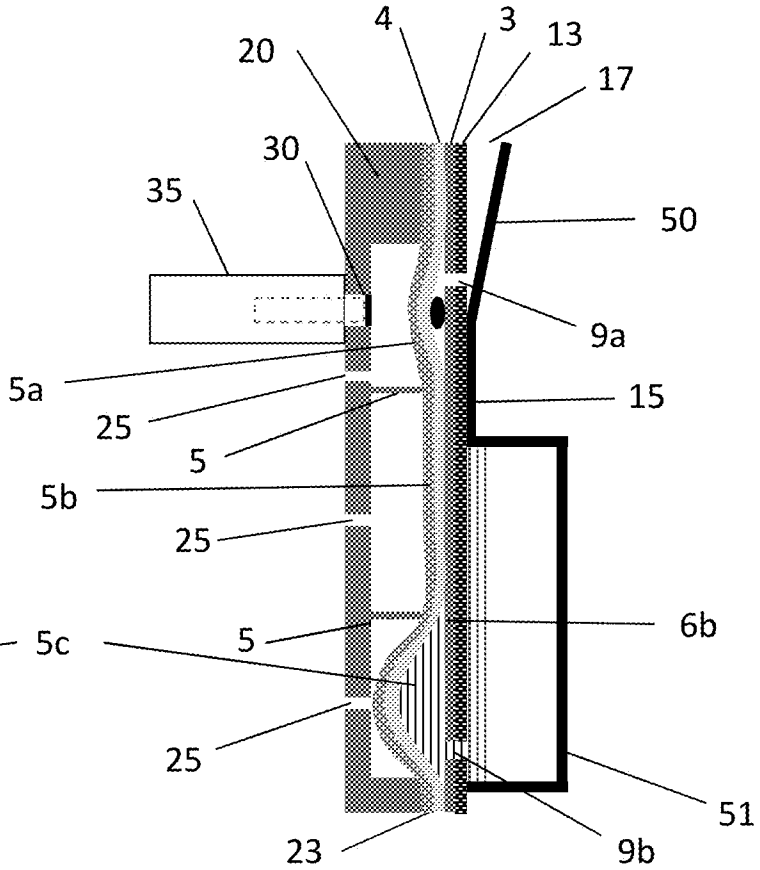
FIG. 24A-FIG. 24B are top plan and corresponding cross-sectional views of a portion of a cartridge component configured to process a biological sample in order to perform a nucleic acid analysis.
Figure 24A:
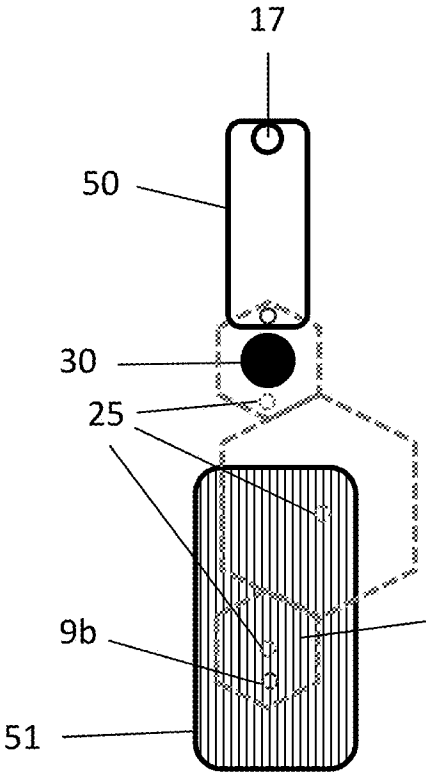

FIG. 24A shows a plan view of a portion of cartridge component (2) with a pellet of magnetic particles, paramagnetic particles, or similar magnetically attractive particles in compressed fluidic volume (5*a*). Further FIG. 24A shows the closing of fluidic volume (5*b*) forcing its fluid into fluidic volume (5*c*) through fluidic gap (6*b*) and into waste reservoir (51) through via (9*b*).

FIG. 24B shows a side view of a portion of a cartridge component (2) shown in FIG. 24A.

Figure 25B:
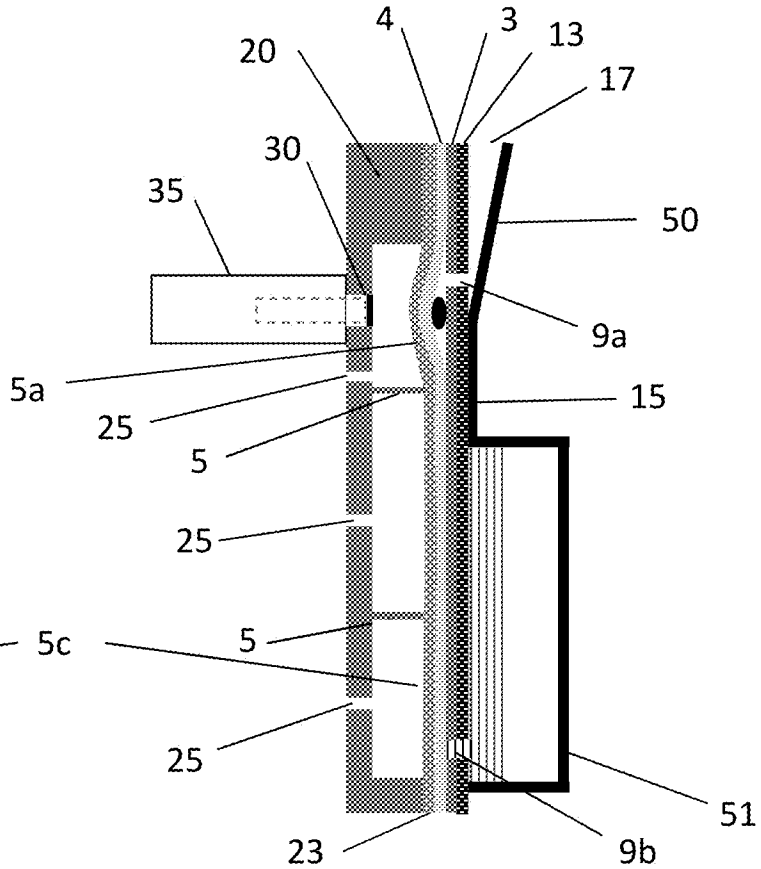
FIG. 25A-FIG. 25B are top plan and corresponding cross-sectional views of a portion of a cartridge component configured to process a biological sample in order to perform a nucleic acid analysis.
Figure 25A:
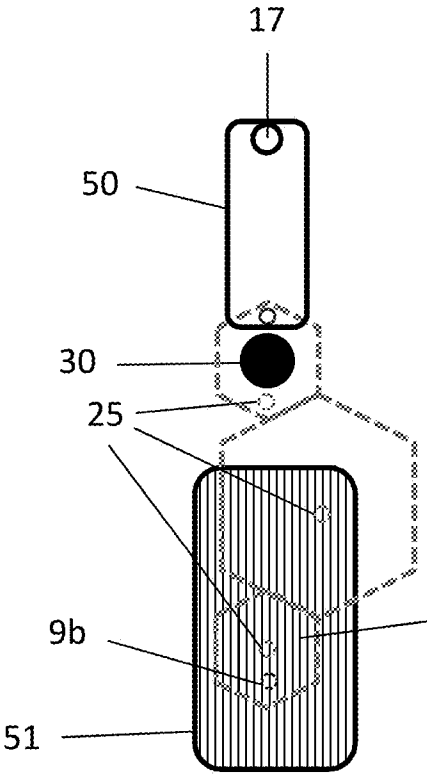

FIG. 25A shows a plan view of a portion of cartridge component (2) with a pellet of magnetic particles, paramagnetic particles, or similar magnetically attractive particles in compressed fluidic volume (5*a*). Further FIG. 25A shows the closing of fluidic volume (5*c*) forcing its fluid into waste reservoir (51) through via (9*b*).

FIG. 25B shows a side view of a portion of a cartridge component (2) shown in FIG. 25A.

Figure 26B:
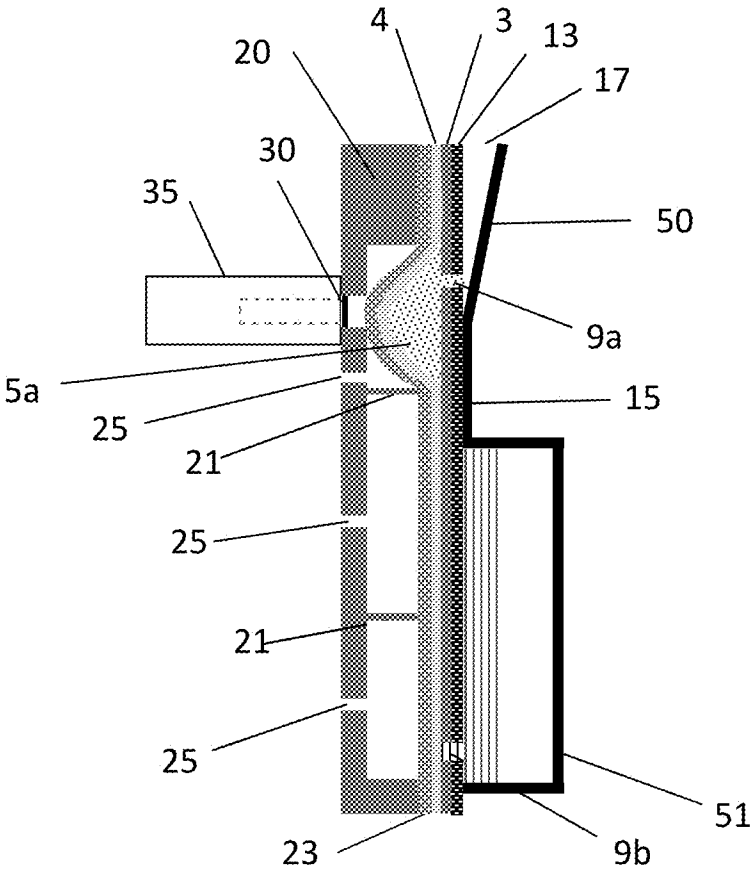
FIG. 26A-FIG. 26B are top plan and corresponding cross-sectional views of a portion of a cartridge component configured to process a biological sample in order to perform a nucleic acid analysis.
Figure 26A:
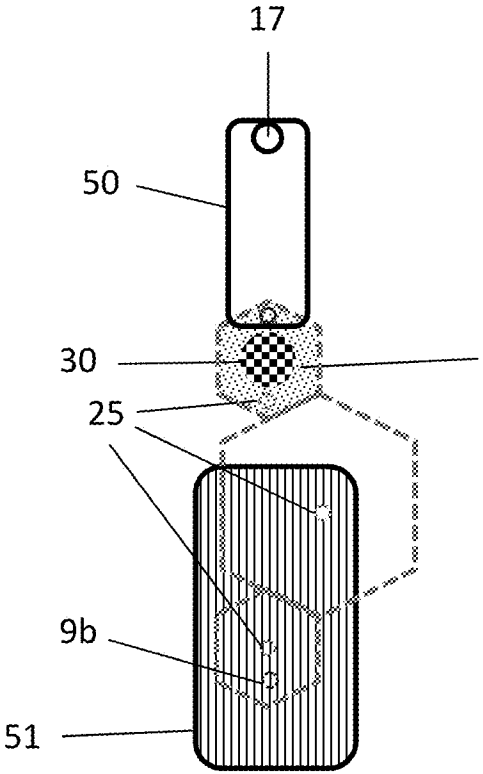

FIG. 26A shows a plan view of a portion of a cartridge component (2) that has disengaged or withdrawn one or more magnet(s) (30), re-actuated fluidic volume (5*a*) including the delivery of reagents from a user, robotic delivery system or pumped from elsewhere on cartridge component (2) (see FIGS. 29-32 for details) so that the magnetic particles, paramagnetic particles, or similar magnetically attractive particles are re-suspended in the fluid in the fluidic volume (5*a*). The fluid may be pumped at least once (or as many times as desired) back and forth through via (9*a*) into and out of sample reservoir (50) or at least once (or as many times as desired) back and forth into any another other fluidic volume in order to mix the magnetic beads, paramagnetic beads, or similar magnetically attractive beads with the newly introduced reagent. One or more magnet(s) (30) is disengaged or at a position away from fluidic volume (5*a*) so that its magnetic field has no effect on the magnetic particles, paramagnetic particles, or similar magnetically attractive particles in fluidic volume (5*a*). The process of re-suspending, washing and re-capturing the magnetic beads, paramagnetic beads, or similar magnetically attractive beads may be repeated as many times as desired are until the magnetic beads, paramagnetic beads or similar magnetically attractive beads are sufficiently cleaned of undesirable materials so that the desired materials captured by the beads is purified and ready for subsequent processing. The beads may also be washed during the engagement of one or more magnet(s) (30) depending on the requirements of the reagents and the materials captured on the magnetic beads, paramagnetic beads or similar magnetically attractive beads.

FIG. 26B shows a side view of a portion of a cartridge component (2) shown in FIG. 26A.

The procedures described in FIGS. 18A-26B may be repeated as necessary to prepare a sample of material for further analysis.

Figure 27A:
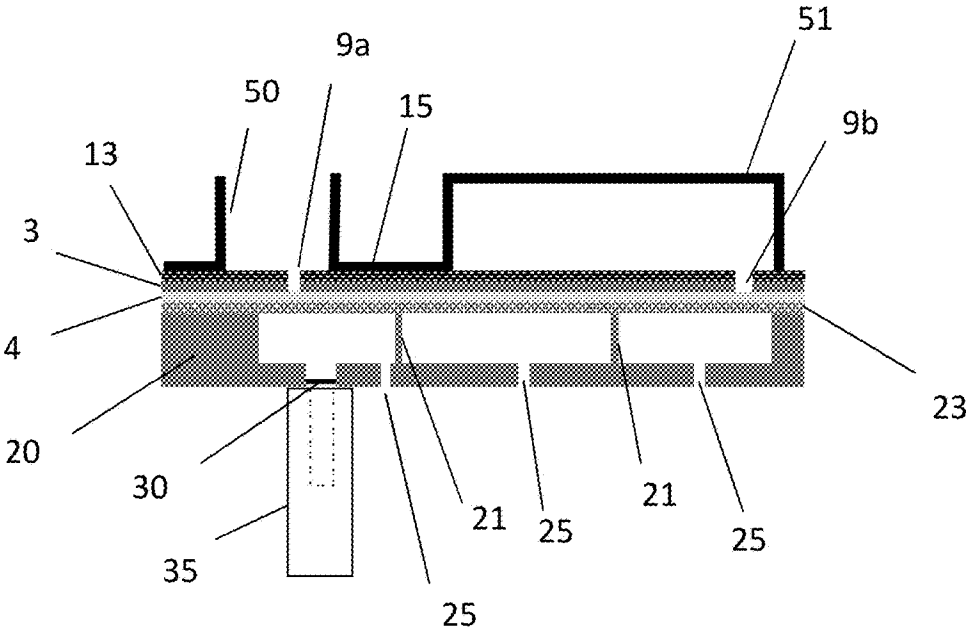
FIG. 27A and FIG. 27B are a cross sectional and top plan view of an alternative configuration of the device shown in FIGS. 18A-26B. The alternative shown is adapted for use in a horizontal position provided the depicted variation in the shape of the sample reservoir, according to an exemplary embodiment of the invention.

FIG. 27A shows a side view of an alternative arrangement of the cartridge component (2) shown in FIGS. 18A-26B using an alternative sample reservoir (50) for horizontal use (see FIG. 11) instead of the vertical configuration (see FIG. 12) shown in FIGS. 18A-26B. All of the functions performed in FIGS. 18A-26B are performed by the alternative arrangement shown in FIG. 27A.

Figure 27B:
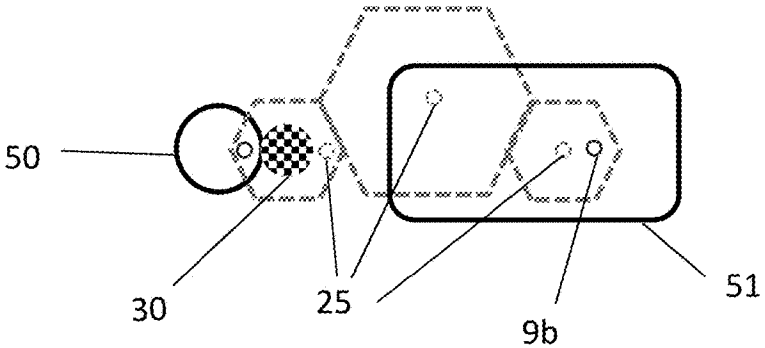

FIG. 27B shows a plan view of the alternative arrangement of the cartridge component (2) shown in FIGS. 18A-26B using an alternative sample reservoir (50) for horizontal use (see FIG. 11) instead of the vertical configuration (see FIG. 12) shown in FIGS. 18A-26B. All of the functions performed in FIGS. 18A-26B are performed by the alternative arrangement shown in FIG. 27B.

Figure 28:
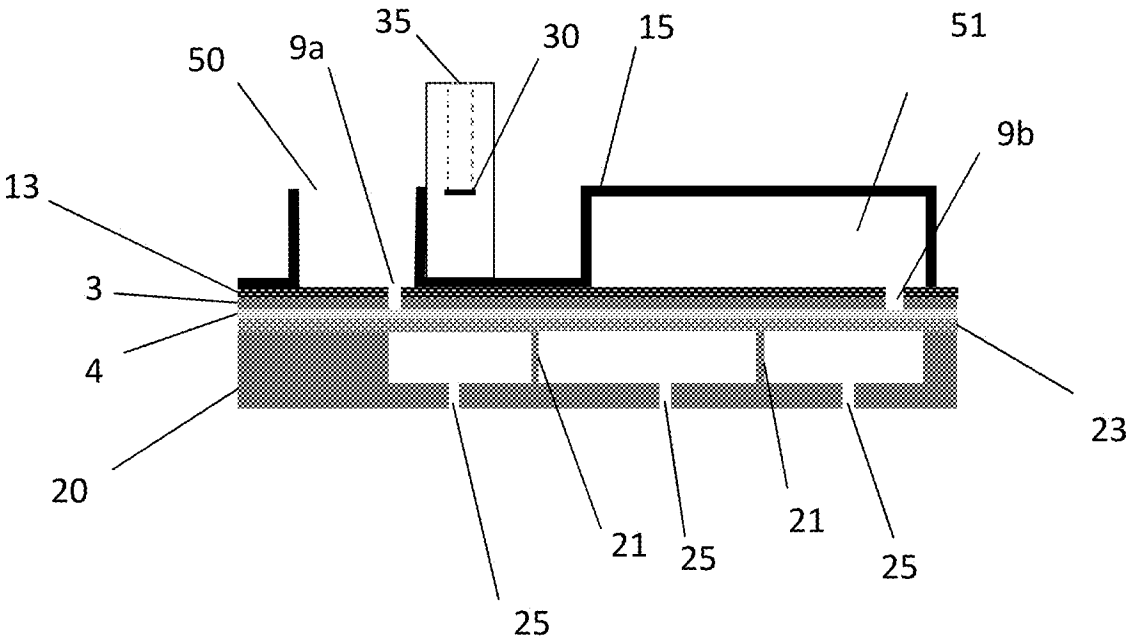
FIG. 28 is a cross section view of the device shown in FIG. 27A with an alternative placement of the one or more magnet assembly, according to an exemplary embodiment of the invention.

FIG. 28 shows a side view of an alternative arrangement of the cartridge component (2) and an alternative arrangement of the one or more magnet(s) (30) and the one or more magnetic actuator(s) (35). Alternatively, one or more magnet (s) (30) and one or more magnetic actuator(s) (35) may be replaced with one or more electromagnet(s). All of the functions performed in FIGS. 18A-26B are performed by the alternative arrangement shown in FIG. 28. Further, alternatively, the arrangement of the one or more magnet(s) (30) and one or more magnetic actuator(s) (35) of FIG. 28 and FIGS. 18A-26B can be combined.

Figure 29:
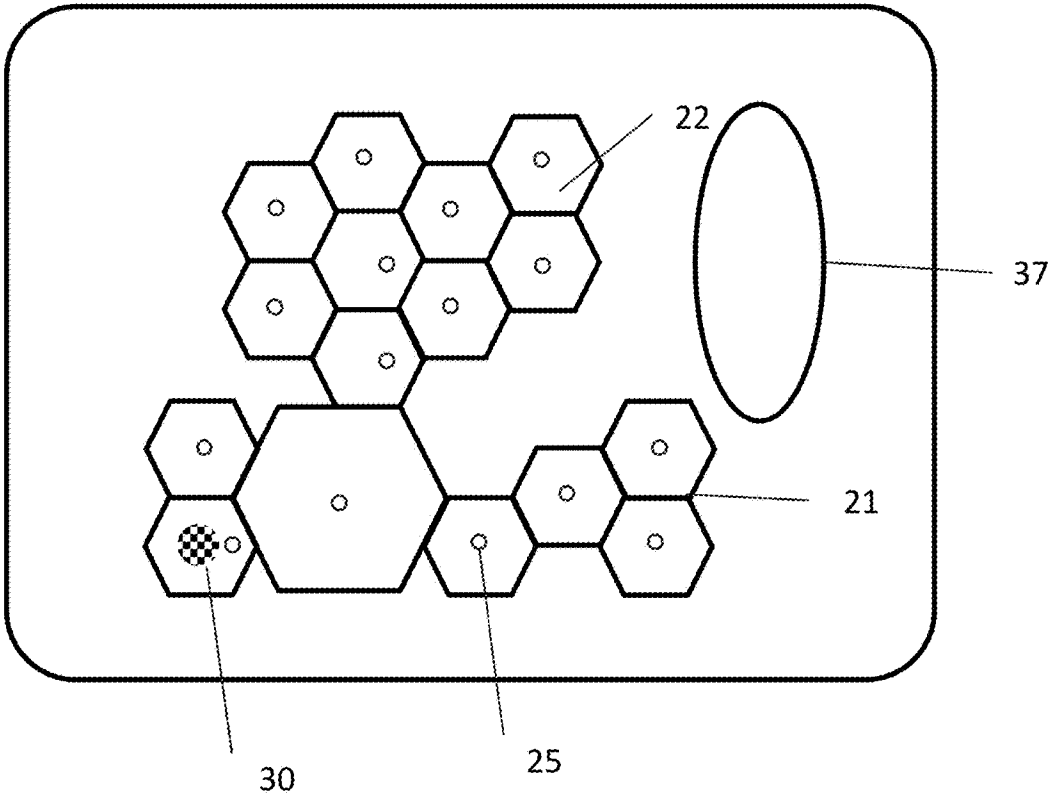
FIG. 29 is a top plan view of a manifold component configured to perform a nucleic acid assay, according to an exemplary embodiment of the invention.

FIG. 29 shows a top plan view of a manifold component (20) for use in a representative assay performing steps of a traditional nucleic acid assay. The elements introduced in FIGS. 18A-27B are shown among the three cavities containing the one or more magnet(s) (30) in FIG. 29. FIG. 29 includes a number of hexagonal cavities (22) each addressed by at least one actuation channel (25) (which may be substituted with previously described alternative mechanical or electronic actuators) with each cavity (22) separated from each other cavity (22) by thin vertical walls (21) (or the alternative configuration described in FIG. 6A-E). The manifold component (20) also includes one or more retractable magnet(s) (30) or one or more electromagnet(s) which can be actuated or moved into contact with the fluidic volume (5*a*) (shown in previous figures). Further FIG. 29 includes at least one heater (37) for modulating the temperature of the contents of a reservoir during the performance of the assay. Furthermore, any particular cavity (22) may be addressed by a heater (37) to facilitate particular aspects of an assay. The manifold component (20) would typically be housed in an instrument (70) (see FIGS. 11 & 12) that would include optical components (69) (see FIGS. 11 & 12) designed for operational purposes for communication with the instrument (70) or other control systems or analytical purposes employed at certain times during an assay to collect data as the assay proceeds or to read a final analytical endpoint such as a microarray (not shown for clarity). The instrument (70) may also include a clamping system (36) (see FIGS. 11 & 12) to hold the cartridge component (2) on the manifold component (20).

Figure 30:
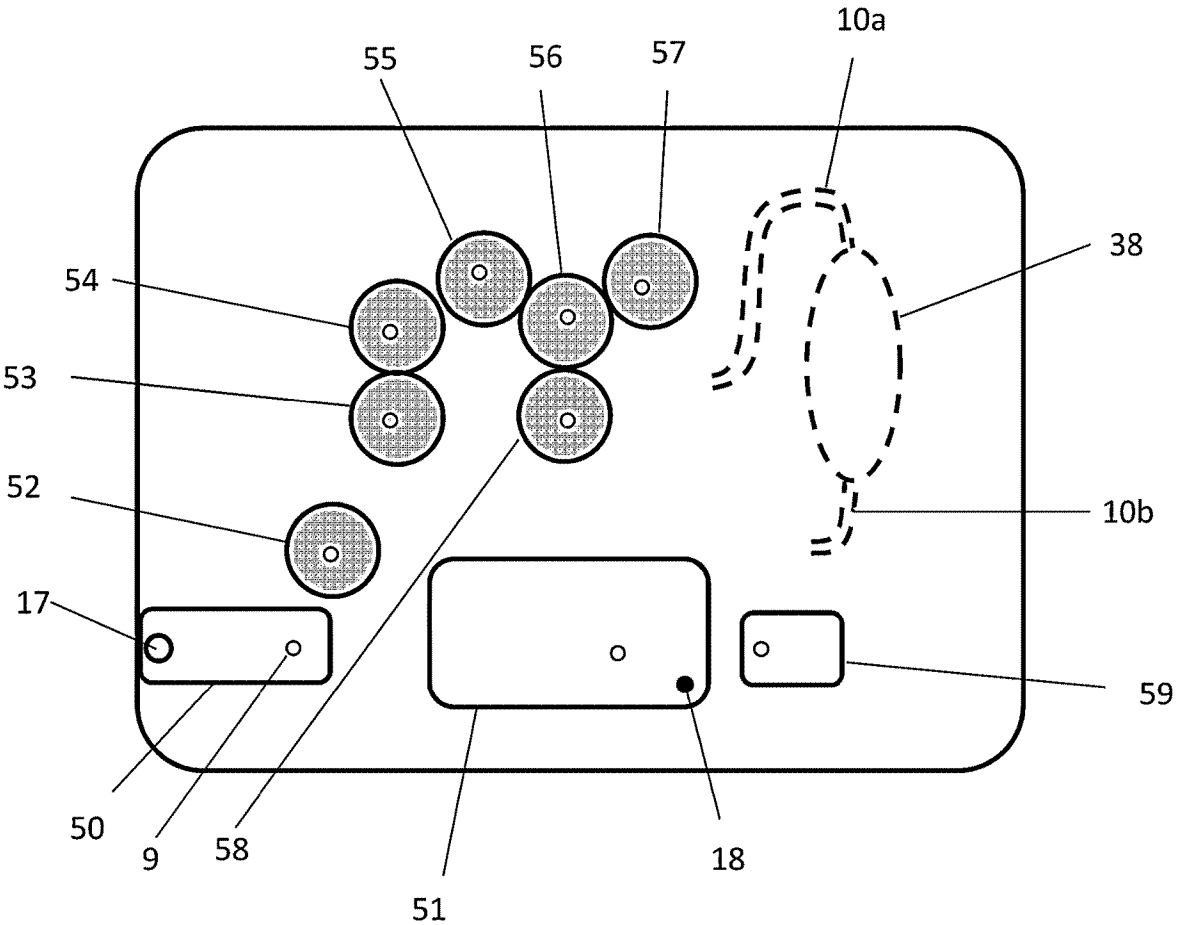
FIG. 30 is a top plan view of a cartridge component configured to interface with the manifold component of FIG. 29, according to an exemplary embodiment of the invention.
Figure 33:
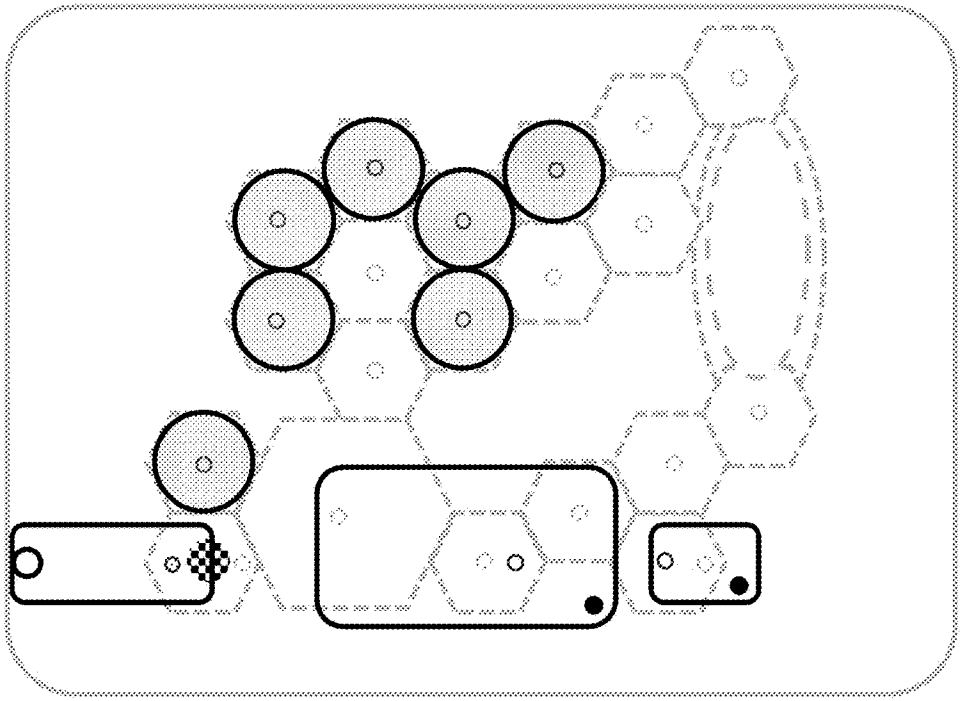
FIG. 33 shows a top plan view of an alternative configuration of a manifold component with additional cavities, according to an exemplary embodiment of the invention.

FIG. 30 shows a top plan view of a cartridge component (2) for use in a representative assay performing the steps of a traditional nucleic acid assay. FIG. 30 includes reservoirs of various types for storing, reacting, mixing or analyzing the components of an assay. The reservoirs may be either rigid reservoirs or blister type reservoirs or a combination thereof. The cartridge component (2) includes a reactor (38) (only one is shown for clarity though multiple reactors may be formed in the substrate (3) and interface with the manifold component (20)) formed in substrate (3) on the surface of substrate (3) facing the actuable film layer (4). The reactor is covered by the actuable film layer (4) forming a chamber accessed through a supply channel or directly through a fluidic gap as shown in FIG. 33. In alternative configurations various cavities may include heaters (37) functionalizing their particular fluidic volumes as individual reactors (38). The representative reservoirs shown in FIG. 30 may be configured in many ways to perform various assays. In order to describe a representative assay they are numbered as follows:

50=Sample Reservoir
51=Waste Reservoir
52=Magnetic Bead Reservoir
53=Lysis Reagent Reservoir
54=Binding Buffer Reservoir
55=Wash Buffer A Reservoir
56=Wash Buffer B Reservoir
57=Master Mix Reservoir
58=Elution Reservoir
59=Product Reservoir/Analysis Reservoir More or fewer reservoirs are equally serviceable depending on how any particular assay is configured or whether reagents are delivered either by the user or a robotic delivery system or loaded on the cartridge component (2) prior to use. The listing provided is simply to present a representative series of steps known in the art for performing a nucleic acid based assay. Any assay compatible with the materials, structures or reagents provided are equally capable of successful performance. The cartridge component (2) may also be provided with optional vents (18) depending on configuration and construction of the various reservoirs and reactors.

Figure 31:
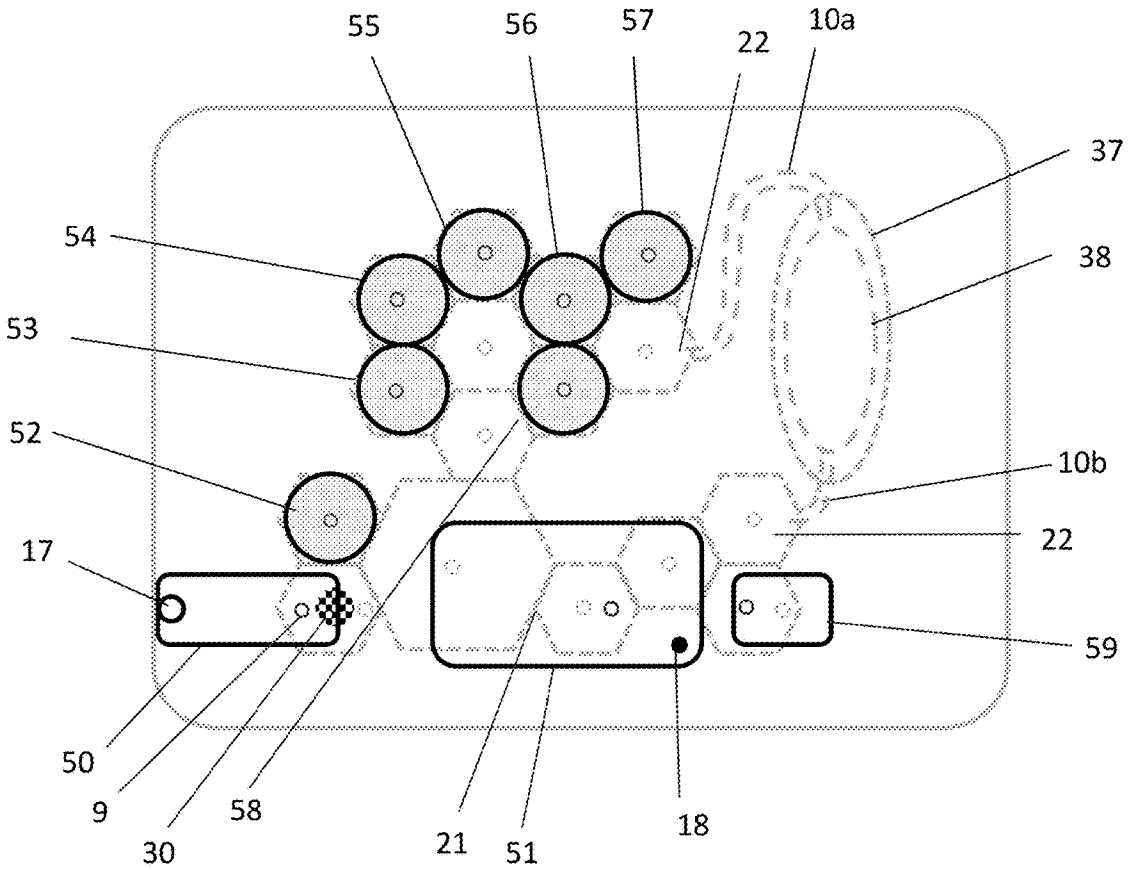
FIG. 31 is a top plan view of the cartridge component shown in FIG. 30 interfaced with the manifold component shown in FIG. 29, according to an exemplary embodiment of the invention.

FIG. 31 shows a top plan view of a cartridge component (2) interfaced with matching manifold component (20) for use in a representative assay performing the steps of a traditional nucleic acid assay. FIG. 31 shows how the elements such as reservoirs and reactors are configured to match the configuration of the manifold component (20) in order to controllably perform the required actions.

Figure 32A:
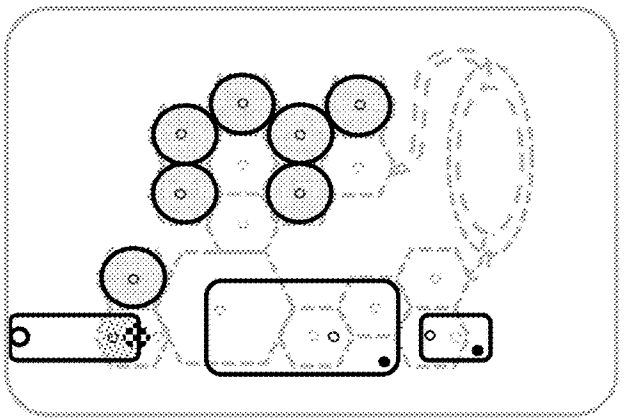
FIGS. 32A-FIG. 32T are illustrative sequential steps performed in a nucleic acid assay, according to an exemplary embodiment of the invention.
Figure 32B:
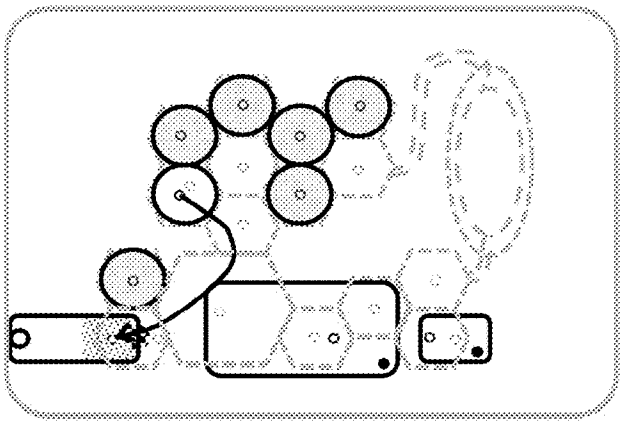
Figure 32C:
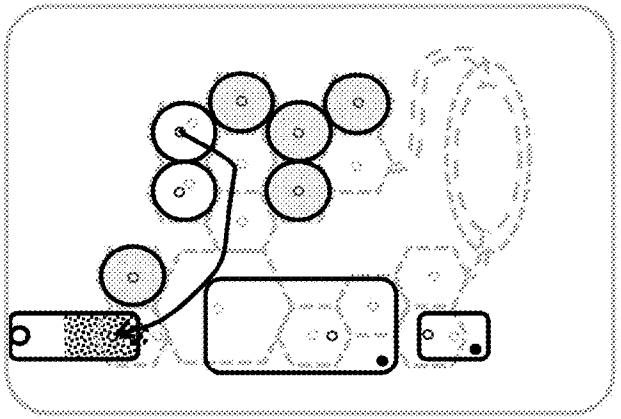
Figure 32D:
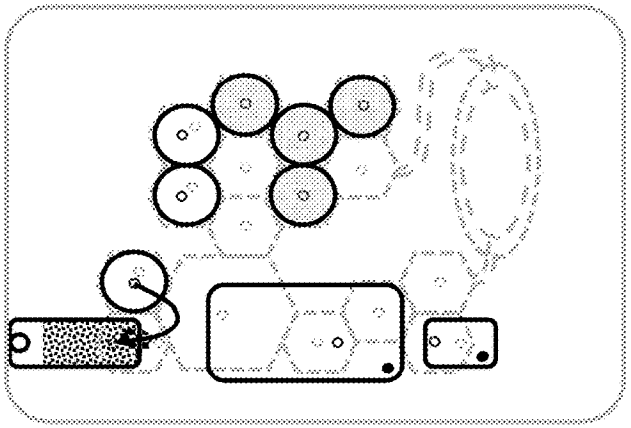
Figure 32F:
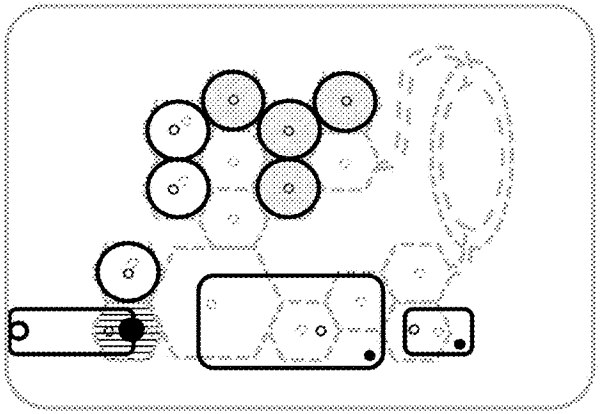
Figure 32H:
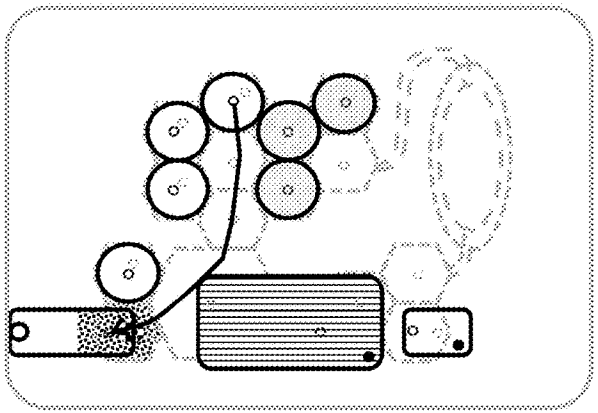
Figure 32E:
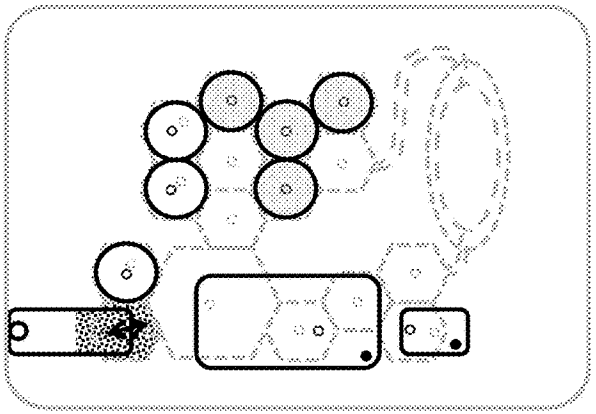
Figure 32G:
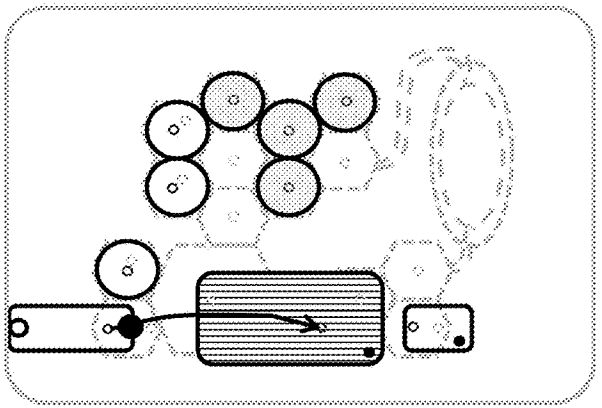
Figure 32J:
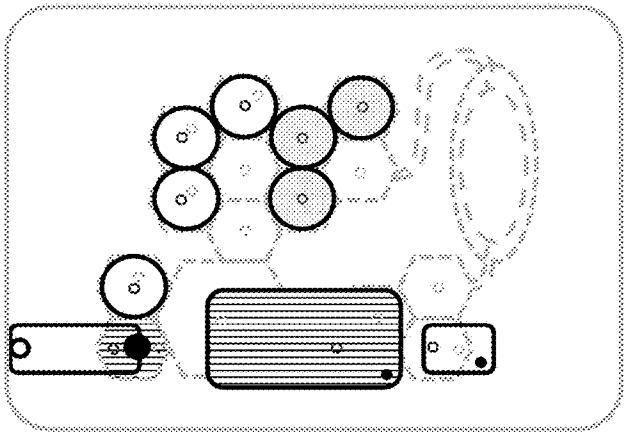
Figure 32L:
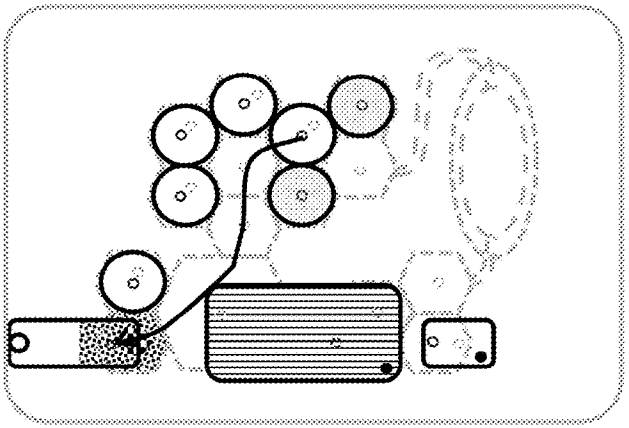
Figure 32I:
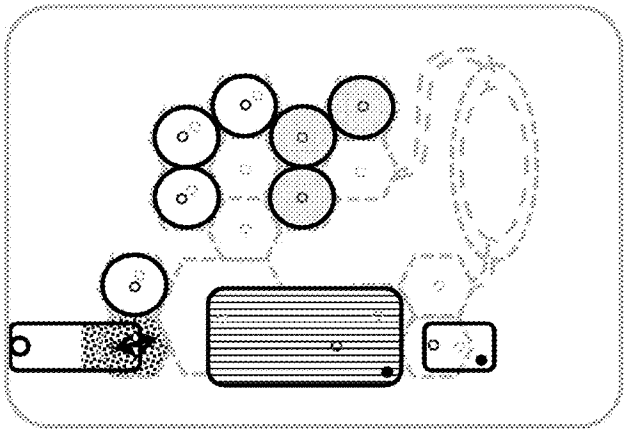
Figure 32K:
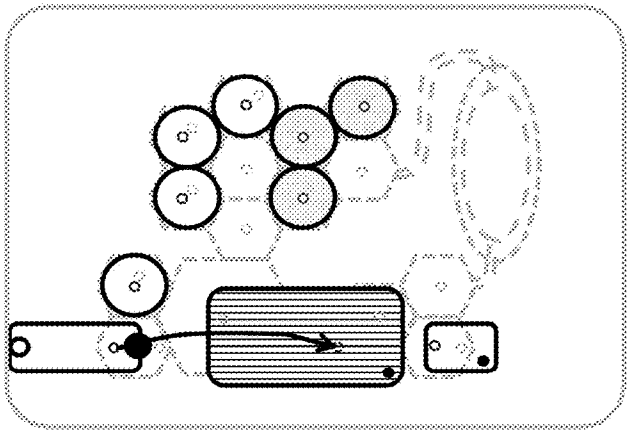
Figure 32N:
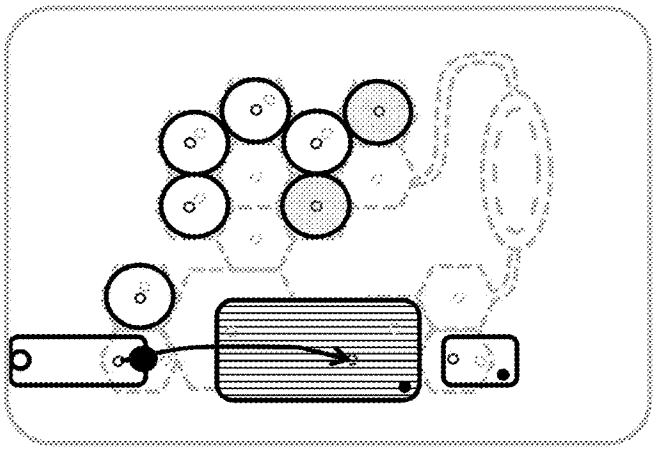
Figure 32P:
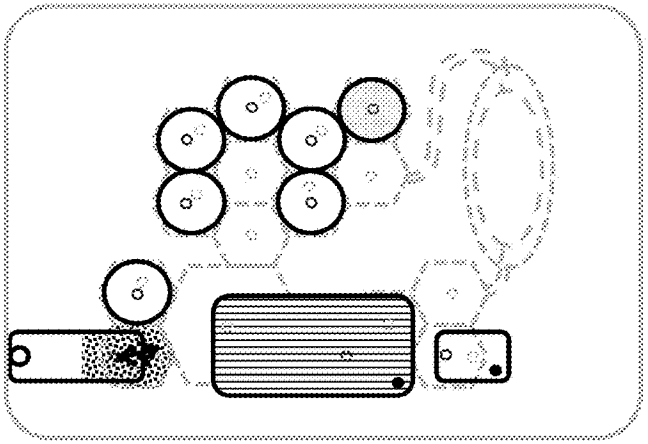
Figure 32M:
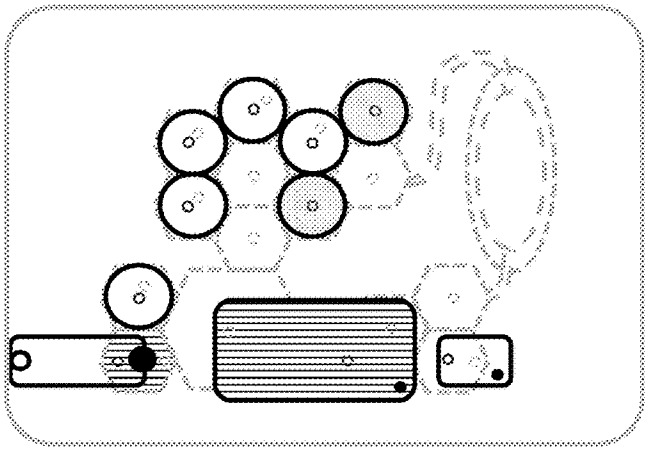
Figure 32O:
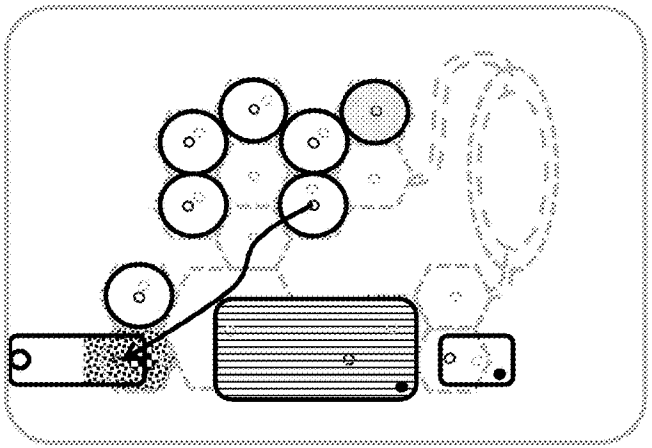
Figure 32R:
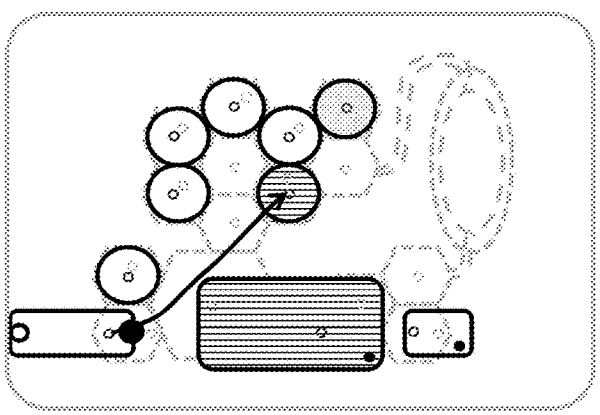
Figure 32Q:
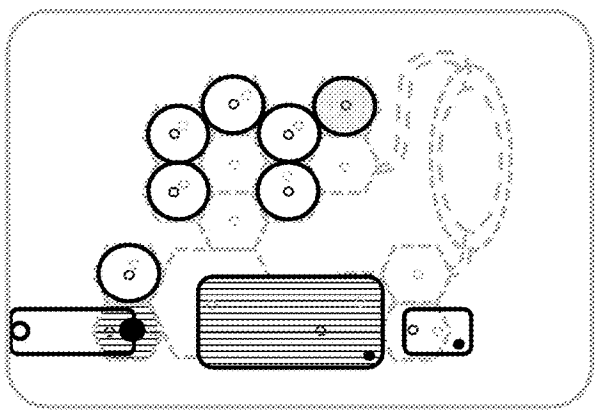
Figure 32T:
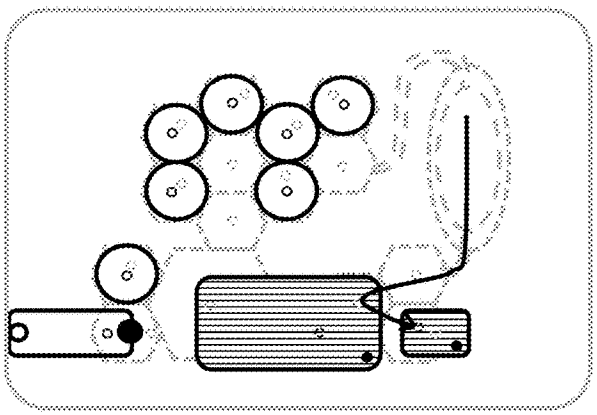

FIGS. 32A-T show sequential top plan views of a cartridge component (2) interfaced with manifold component (20) (See FIG. 31) for use in a representative assay performing the steps of a traditional nucleic acid assay. In each sequential step an arrow shows the modulated transfer of fluids across the cartridge component (2) in the manner described in FIGS. 3A-F, 6A-F and 18A-26B).

FIG. 32A shows a sample (60) inserted into sample reservoir (50) through sample port (17).

FIG. 32B shows lysing reagent pumped from lysing reagent reservoir (53) into sample reservoir (50). The mixture may be allowed to incubate in sample reservoir (50) which sample reservoir (50) may be heated (alternative heater not shown for clarity) or sonicated (See FIG. 34).

FIG. 32C shows binding reagent pumped from binding reagent reservoir (54) into sample reservoir (50).

FIG. 32D shows magnetic bead, paramagnetic bead or similar magnetically attractive bead reagent pumped from magnetic bead reagent reservoir (52) into sample reservoir (50). Steps 32B-32D may be practiced in any order.

FIG. 32E shows the reagent volume including the magnetic beads, paramagnetic beads or similar magnetically attractive beads, lysing reagent, binding reagent and the sample pumped one or more times between the sample reservoir (50) and the fluidic volume (5*a*) through via (9*a*) (see FIG. 18A-26B for detail) in order to thoroughly mix and agitate the mixture.

FIG. 32F shows one or more magnet(s) (30) engaged or moved into contact with fluidic volume (5*a*) such that the magnetic particles, paramagnetic particles or similar magnetically attractive particles in the fluid are captured by the magnetic field of one or more magnet(s) (30) and separated from the bulk fluid (see FIG. 18A-26B for detail).

FIG. 32G shows the magnetic particles, paramagnetic particles or similar magnetically attractive particles still captured by the magnetic field of one or more magnet(s) (30) and the bulk fluid transferred to waste reservoir (51) (see FIG. 18A-26B for detail).

FIG. 32H shows one or more magnet(s) (30) disengaged or withdrawn from the fluidic volume (5*a*) thereby releasing the magnetic beads, paramagnetic beads or similar magnetically attractive beads along with whatever material from the original mixture was still attached to the beads and pumping wash solution A from wash solution reservoir A (55) in order to begin purifying the nucleic acids attached to the magnetic beads, paramagnetic beads or similar magnetically attractive beads (see FIG. 18A-26B for detail).

FIG. 32I shows the reagent volume including the magnetic beads, paramagnetic beads or similar magnetically attractive beads and the wash reagent A pumped one or more times between the sample reservoir (50) and fluidic volume (5*a*) through via (9*a*) in order to thoroughly mix and agitate the mixture (see FIG. 18A-26B for detail).

FIG. 32J shows the one or more magnet(s) (30) engaged or moved into contact with fluidic volume (5*a*) such that the magnetic particles, paramagnetic particles or similar magnetically attractive particles in the fluid are captured by the magnetic field of one or more magnet(s) (30) and separated from the bulk fluid (see FIG. 18A-26B for detail).

FIG. 32K shows the magnetic particles, paramagnetic particles or similar magnetically attractive particles still captured by the magnetic field of one or more magnet(s) (30) and the bulk fluid transferred to waste reservoir (51) (see FIG. 18A-26B for detail).

FIG. 32L shows one or more magnet (30) disengaged or withdrawn from fluidic volume (5*a*) thereby releasing the magnetic beads, paramagnetic beads or similar magnetically attractive beads along with whatever material from the washed mixture was still attached to the beads and pumping wash solution B from wash solution reservoir B (56) in order to further purify the nucleic acids attached to the magnetic beads, paramagnetic beads or similar magnetically attractive beads (see FIG. 18A-26B for detail).

FIG. 32M shows the one or more magnet(s) (30) engaged or moved into contact with fluidic volume (5*a*) such that the magnetic particles, paramagnetic particles or similar magnetically attractive particles in the fluid are captured by the magnetic field of one or more magnet(s) (30) and separated from the bulk fluid (see FIG. 18A-26B for detail).

FIG. 32N shows the magnetic particles, paramagnetic particles or similar magnetically attractive particles still captured by the magnetic field of one or more magnet(s) (30) and the bulk fluid transferred to waste reservoir (51) (see FIG. 18A-26B for detail).

FIG. 32O shows one or more magnet(s) (30) disengaged or withdrawn from fluidic volume (5*a*) thereby releasing the magnetic beads, paramagnetic beads or similar magnetically attractive beads along with purified nucleic acids still attached to the beads and pumping elution solution from elution reservoir (58) in order to release the nucleic acids attached to the magnetic beads, paramagnetic beads or similar magnetically attractive beads (see FIG. 18A-26B for detail).

FIG. 32P shows the reagent volume including the magnetic beads, paramagnetic beads or similar magnetically attractive beads and the elution reagent pumped one or more times between the sample reservoir (50) and fluidic volume (5*a*) through via (9*a*) in order to thoroughly elute the nucleic acids from the magnetic beads, paramagnetic beads or similar magnetically attractive beads (see FIG. 18A-26B for detail).

FIG. 32Q shows the one or more magnet(s) (30) engaged or moved into contact with fluidic volume (5*a*) such that the magnetic particles, paramagnetic particles or similar magnetically attractive particles in the fluid are captured by the magnetic field of one or more magnet(s) (30) and separated from the bulk fluid containing the eluted nucleic acids (see FIG. 18A-26B for detail).

FIG. 32R shows the bulk fluid containing the nucleic acids pumped to the elution reagent reservoir (58).

Figure 32S:
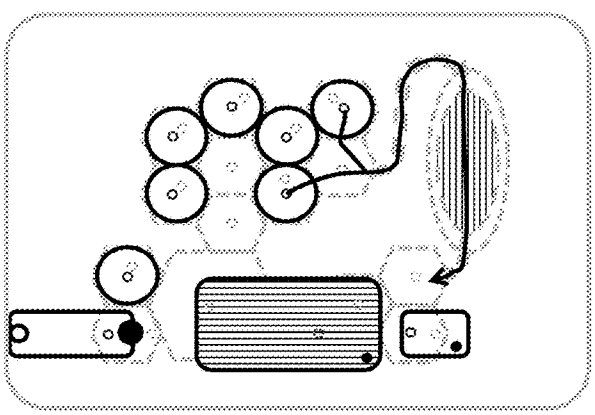

FIG. 32S shows the eluted nucleic acids mixed with the amplification master mix from one or more master mix reservoir(s) (57) and pumped into one or more reactor(s) (38) through supply channel (10*a*). In this manner controlled amounts of elution and master mix are combined and transferred into one or more reactor(s) (38). Alternatively the fluids can be transferred into one or more reactor(s) (38) by operating the downstream pumps on the side of one or more reactor(s) (38) leading to one or more product reservoir(s) (59) such that the combined solutions are drawn into one or more reactor(s) (38) instead of pushed into one or more reactor(s) (38). The process of drawing the solution into one or more reactor(s) (38) provides for fewer bubbles introduced into one or more reactor(s) (38). Once one or more reactor(s) (38) is filled with elution and master mix thermal conditions are provided by one or more heater(s) (37) in manifold component (20) to amplify the nucleic acids in accordance with the requirements of the assay in order to produce amplified products. The reaction may be monitored by one or more optical component(s) (69) located either in manifold component (20) or in the housing of the instrument (70) housing manifold component (20) in order to generate data representing the performance of the assay (See FIGS. 34-36).

FIG. 32T shows the amplified product transferred from one or more reactor(s) (38) into one or more product reservoir(s) (59) where the amplified product may be analyzed using a microarray, fluorescent probes, electrochemical interaction or other known methods of analyzing amplified nucleic acids (not shown for clarity). Alternatively, the amplified products may be removed from one or more product reservoir(s) (59) for storage or separate analysis.

FIG. 33 shows a plan view of a cartridge component (2) interfaced with manifold component (20) for use in a representative assay performing the steps of a traditional nucleic acid assay with an alternative design that does not require supply channels (10*a* and 10*b*) as described in FIGS. 32A-T. The manifold component (20) is modified to include more cavities (22), some of which interface with one or more reactor(s) (38) providing for the creation of fluidic gaps required to fill the one or more reactor(s) with eluted nucleic acids from elution reservoir (58) and master mix from one or more master mix reservoir(s) (57).

Figure 34:
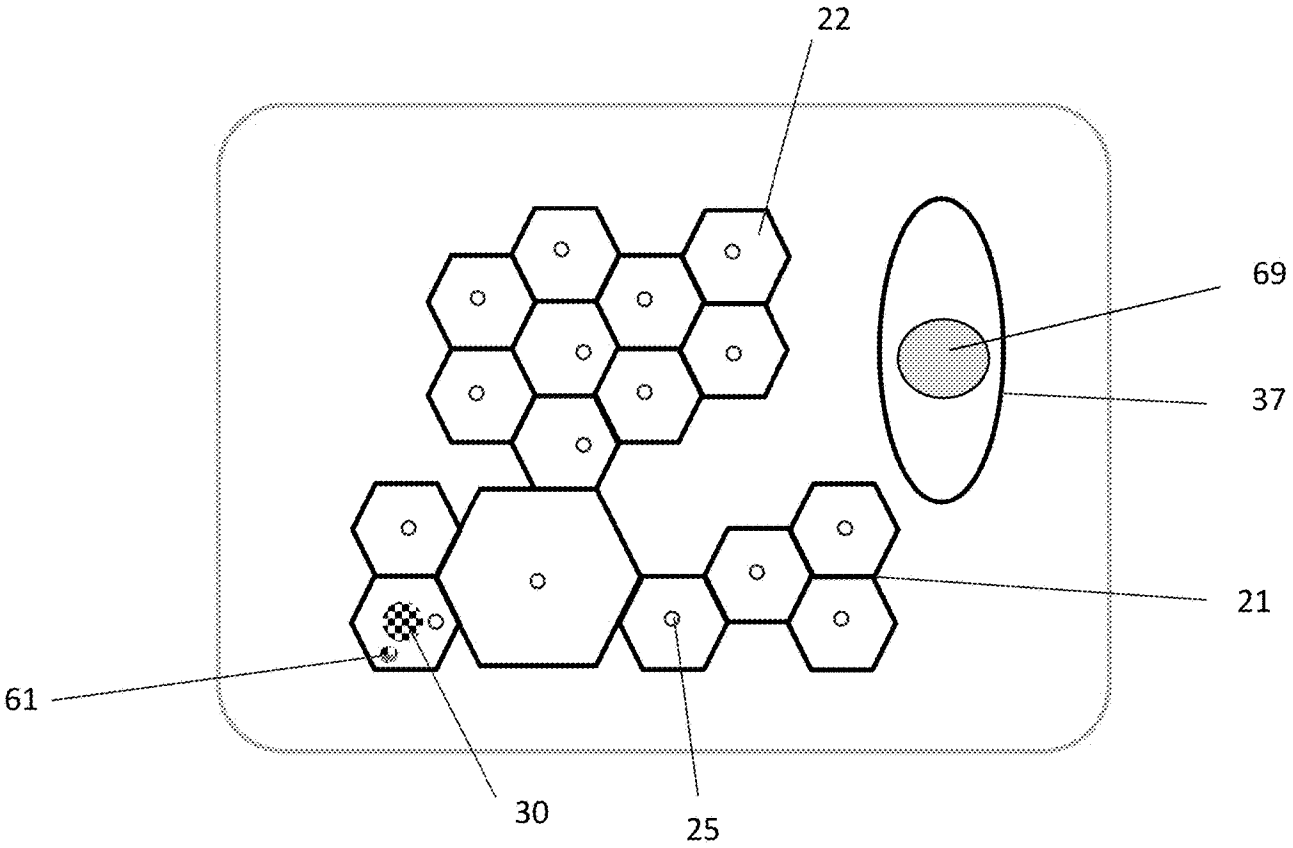
FIG. 34 shows a top plan view of a manifold component incorporating an optical system and a sonication system, according to an exemplary embodiment of the invention.

FIG. 34 shows a plan view of an alternative configuration of manifold component (20) for use in a representative assay performing steps of a traditional nucleic acid assay. FIG. 34 includes a number of hexagonal cavities (22) each addressed by at least one actuation channel (25) with each cavity (22) separated from each other cavity (22) by thin vertical walls (21). The manifold component (20) includes one or more electromagnet(s) or one or more retractable magnet(s) (30), which can be moved into contact with the fluidic volume (5*a*) (not shown for clarity). Further, FIG. 34 includes a one or more heater(s) (37) for modulating the temperature of the contents of a reservoir during the performance of the assay. Further still, manifold component (20) includes one or more sonication element(s) (61) interfacing sample port (50) for use in certain sample preparation steps where sonication is useful in lysing or agitating the contents of a sample. Even further still, the manifold incorporates one or more optical system(s) (69) for collecting data on the progress of an assay in the one or more reactor(s) (38). The manifold component (20) would typically be housed in an instrument (70) that would include one or more optical component(s) (69) designed for analytical purposes employed at certain times during an assay to collect data as the assay proceeds or to read a final analytical endpoint such as a microarray.

Figure 35:
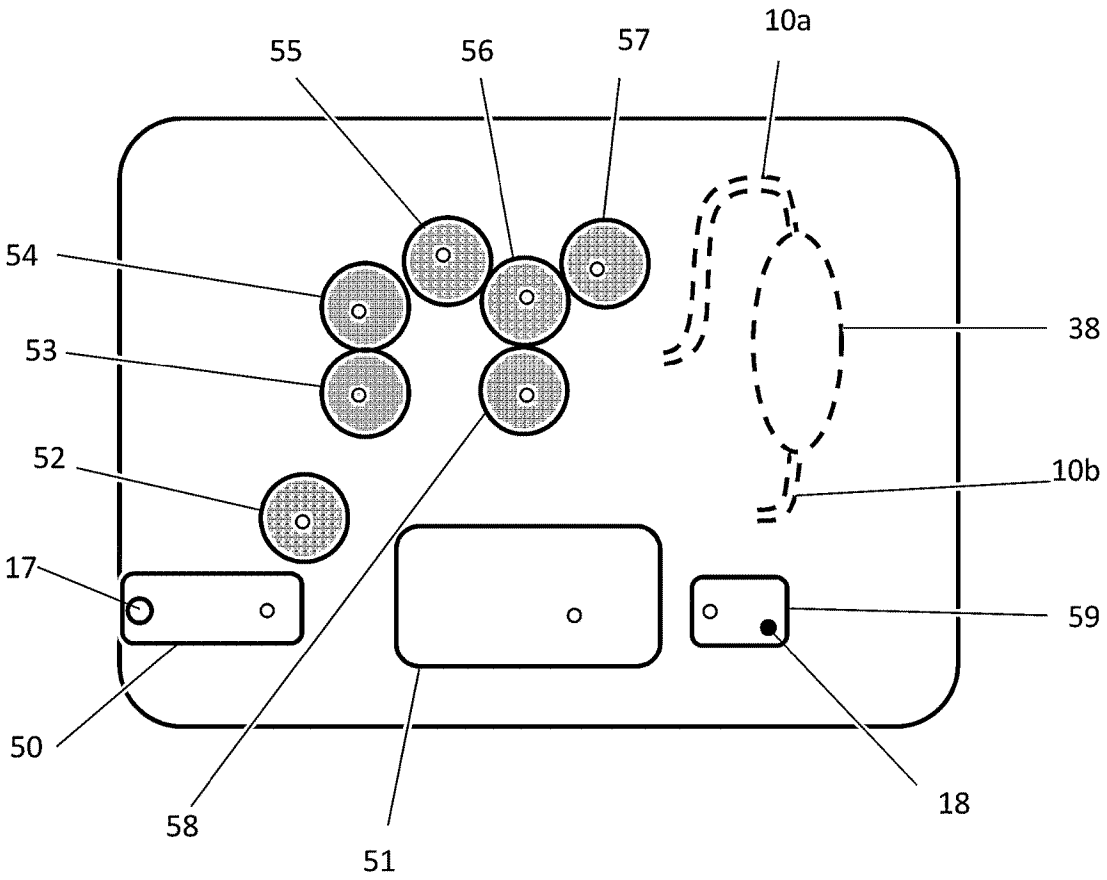
FIG. 35 shows a top plan view of a cartridge component configured to interface with the manifold component shown in FIG. 34, according to an exemplary embodiment of the invention.

FIG. 35 shows a top plan view of an alternative configuration of a cartridge component (2) for use in a representative assay performing the steps of a traditional nucleic acid assay. FIG. 35 includes reservoirs of various types for storing, reacting, mixing or analyzing the components of an assay. Reservoirs may be either rigid reservoirs or blister type reservoirs or a combination thereof. The cartridge component (2) includes one or more reactor(s) (38) fabricated in the substrate (3) on the surface of substrate (3) facing the actuable film layer (4). The one or more reactor(s) (38) is covered by the actuable film layer (4) forming a chamber accessed through supply channel (10*a*) or directly through interfacing with a fluidic gap as shown in FIG. 33.

Figure 36:
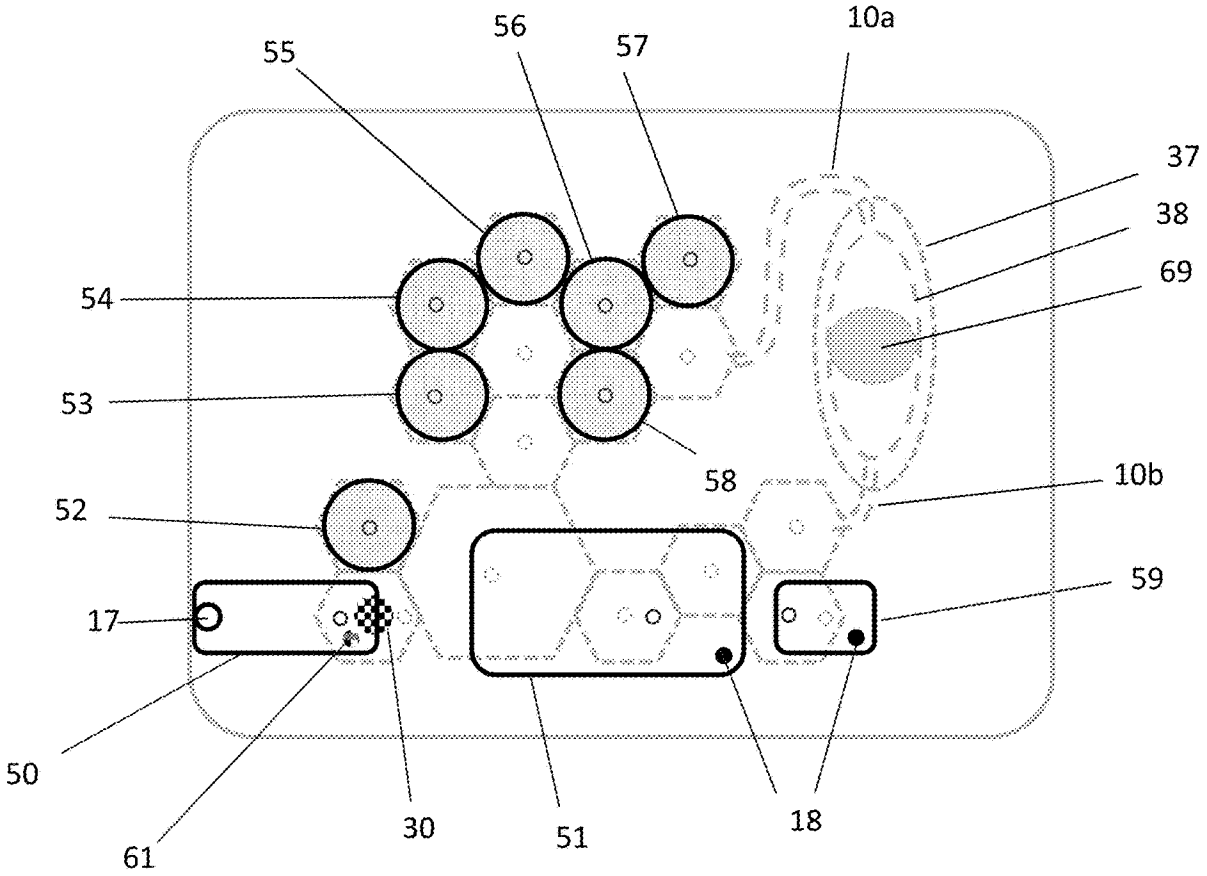
FIG. 36 shows a top plan view of the cartridge component shown in FIG. 35 interfaced with the manifold component shown in FIG. 34, according to an exemplary embodiment of the invention.

FIG. 36 shows a plan view of an alternative configuration of a cartridge component (2) shown in FIG. 35 interfaced with an alternative configuration of a manifold component (20) shown in FIG. 34 for use in a representative assay performing the steps of a traditional nucleic acid assay.

Further alternative configurations such as one or more heater(s) (37) integrated into particular cavities are not shown for clarity though such configurations provide great flexibility in designing systems with multiple heating requirements for interim reactions or incubations. Furthermore, a cartridge component (2) may be configured with more than one or more reactor(s) (38) not associated with any particular cavity (22), providing further degrees of freedom in configuring systems with particular requirements for specific assays. Even further, though nucleic acid based assays were described fully herein, other assay systems (i.e., immunoassays or other known assays requiring fluid mixing and separations performed herein) are easily contemplated using the elements described.

Figure 37:
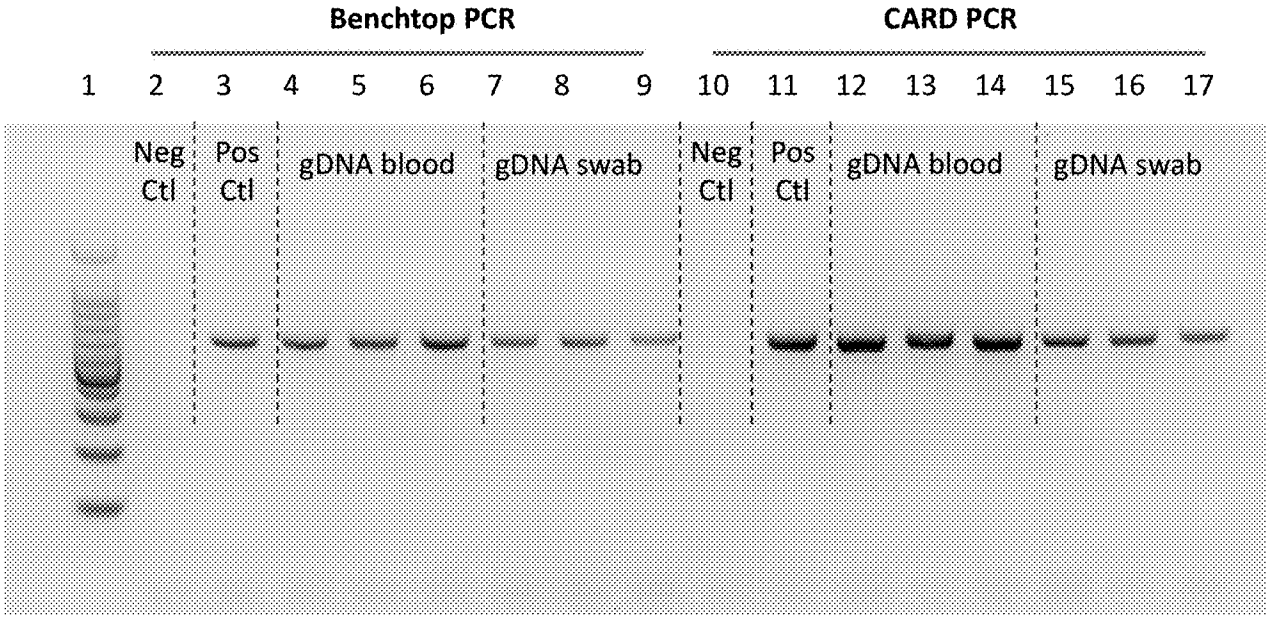
FIG. 37 shows comparative results of using the device and methods described herein for a nucleic acid based assay.

FIG. 37 shows comparative results of using the device and methods described herein for a nucleic acid based assay. The device and methods performed sample preparation and PCR using whole blood and buccal swabs for a supply of genomic material. Each sample was processed using standard benchtop methods and the device and methods described herein. The resulting amplicons from each were subjected to gel electrophoresis to analyze the results. As shown the device and methods described herein provide very comparable results to standard methods.

Figure 38:
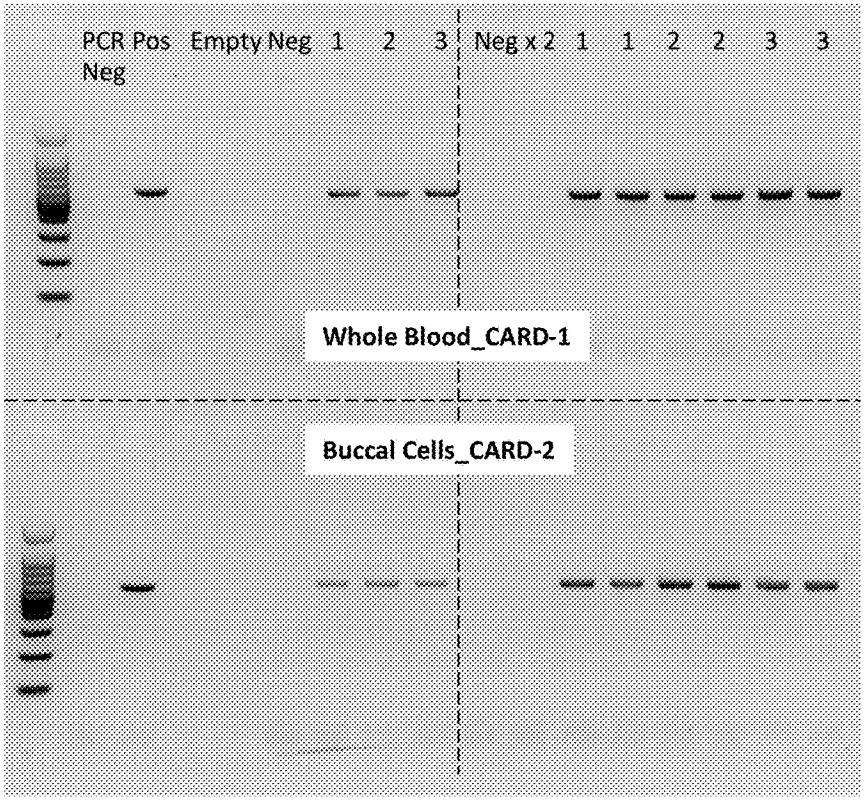
FIG. 38 shows repeatable comparative results of using the device and methods described herein for a nucleic acid based assay.

FIG. 38 shows replicated comparative results of using the device and methods described herein for a nucleic acid based assay. The device and methods performed sample preparation and PCR using whole blood and buccal swabs for a supply of genomic material. Each sample was processed using standard benchtop methods and the device and methods described herein. The resulting amplicons from each were subjected to gel electrophoresis to analyze the results. As shown the device and methods described herein provide very repeatable and comparable results to standard methods.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalents.

We claim:

1. A microfluidic pump, comprising:

a cartridge including a substrate having opposing, flat external surfaces and an actuatable film layer disposed on a one of the external surfaces of the substrate; and a manifold comprising:

at least three separate, actuatable cavities forming at least in part, a top surface of the manifold, wherein in operation, the pump is characterized by one of an unactuated state wherein the actuatable film layer is disposed immediately adjacent the one external surface of the substrate and an actuated state wherein at least a portion of the actuatable film layer is deflected away from a corresponding portion of the one external surface and into a corresponding actuatable cavity thus forming a fluidic volume bounded by the deflected portion of the actuatable film layer and the one external surface of the substrate, further wherein, in the actuated state, the pump is further characterized by a fluidic gap between immediately adjacent fluidic volumes, further wherein the pump contains no dedicated structural fluidic microchannels disposed between the substrate and the actuatable film layer.

2. The microfluidic pump of claim 1, wherein the at least three cavities are separated by at least two wall sections.

3. The microfluidic pump of claim 1, further comprising at least one reservoir disposed in/on the substrate and at least one via in fluidic connection with the reservoir and the film layer.

4. The microfluidic pump of claim 1, further comprising at least one via in the substrate in fluidic connection with the film layer and an external fluid source.

5. The microfluidic pump of claim 1, further comprising an actuatable flexible layer disposed on the top surface of the manifold and disposable in an interfacing relationship with the actuatable film layer.

6. The microfluidic pump of claim 5, further comprising an electromagnetic or a mechanical actuator.

7. The microfluidic pump of claim 5, wherein the actuatable flexible layer has at least one magnetic region.

8. The microfluidic pump of claim 1, wherein the cavities comprise an actuatable foam material.

9. The microfluidic pump of claim 5, wherein the at least three cavities are separated by at least two wall sections.

10. The microfluidic pump of claim 5, further comprising at least one reservoir disposed in/on the substrate and at least one via in fluidic connection with the reservoir and the film layer.

11. The microfluidic pump of claim 5, further comprising at least one via in the substrate in fluidic connection with the film layer and an external fluid source.

12. A method for transporting a fluid in a microfluidic device comprising:

providing a microfluidic pump as set forth in claim 1;

actuating a first one of the cavities;

providing a source of the fluid through the fluidic gap of the first actuated cavity so as to dispose a quantity of the fluid in the fluidic volume of the first actuated cavity;

actuating a second one of the cavities immediately adjacent the first cavity thus forming the fluidic volume of the second actuated cavity and creating the fluidic gap between the first and the second cavities;

de-actuating the first cavity and actuating a third one of the cavities immediately adjacent the second cavity thus forming the fluidic volume of the third actuated cavity and creating the fluidic gap between the second and the third cavities such that the fluid is transported from the first to the second and from the second to the third of the at least three cavities.

13. The microfluidic pump of claim 1, wherein the cartridge substrate further comprises:

a blister material disposed on the opposing external surface from the actuable film layer surface; and a via in fluid communication with at least a portion of the blister material.

14. The microfluidic pump of claim 13, wherein the substrate includes at least one pocket in fluidic contact with at least a portion of the blister material and the via.

15. The microfluidic pump of claim 1, wherein the substrate is a film layer including a via, the cartridge further comprising a fixture having one or more pockets formed therein, at least one vacuum port in the fixture, and a blister material disposed on an external surface of the fixture intermediate the fixture surface and the substrate film layer so as to form a blister reservoir, wherein the actuable film layer is disposed so as to seal the blister reservoir.

16. The microfluidic pump of claim 15, further comprising a protective cover disposed on the surface of the blister material opposite the side of the blister material to which the substrate is disposed.

* * * * *